US006986510B2

(12) United States Patent
Saito et al.

(10) Patent No.: US 6,986,510 B2
(45) Date of Patent: Jan. 17, 2006

(54) OFFSETTING DISCHARGING APPARATUS WITH ALIGNING MEMBER

(75) Inventors: Takashi Saito, Yamanashi-ken (JP); Shinya Sasamoto, Nirasaki (JP)

(73) Assignee: Nisca Corporation, Yamanashi-ken (JP)

( * ) Notice: Subject to any disclaimer, the term of this patent is extended or adjusted under 35 U.S.C. 154(b) by 150 days.

(21) Appl. No.: 10/273,135

(22) Filed: Oct. 18, 2002

(65) Prior Publication Data

US 2003/0085511 A1 May 8, 2003

(30) Foreign Application Priority Data

Oct. 23, 2001 (JP) ..... 2001-324278
Oct. 23, 2001 (JP) ..... 2001-324281

(51) Int. Cl.
*B65H 31/00* (2006.01)

(52) U.S. Cl. ..... 271/220; 271/207; 271/285; 271/251; 414/791.2

(58) Field of Classification Search ..... 271/207, 271/220, 250, 251, 252, 285; 414/791.2
See application file for complete search history.

(56) References Cited

U.S. PATENT DOCUMENTS 4,480,825 A * 11/1984 Landa ..... 271/81
4,981,293 A * 1/1991 Yamashita et al. ..... 271/184
5,219,159 A * 6/1993 Malachowski et al. ..... 271/228
5,273,274 A * 12/1993 Thomson et al. ..... 271/228
5,513,838 A * 5/1996 Van Rossum ..... 269/203
6,142,466 A * 11/2000 Dickhoff ..... 271/220
6,311,971 B1 * 11/2001 Greer et al. ..... 271/220
6,550,758 B2 * 4/2003 Ardery et al. ..... 270/58.12
6,561,504 B2 * 5/2003 Mlejnek et al. ..... 270/58.12

FOREIGN PATENT DOCUMENTS

| | | |
|---|---|---|
| JP | 63-143167 | 6/1988 |
| JP | 01-261161 | 10/1989 |
| JP | 02-028471 | 1/1990 |
| JP | 02028471 A * | 1/1990 |
| JP | 06-312871 | 11/1994 |
| JP | 08-208098 | 8/1996 |
| JP | 2001-240293 | 9/2001 |

* cited by examiner

*Primary Examiner*—Patrick Mackey
(74) *Attorney, Agent, or Firm*—Manabu Kanesaka

(57) ABSTRACT

An offsetting discharging apparatus with aligning member or a sheet discharge apparatus is provided with a sheet discharge device for discharging sheets, a storage device for receiving the sheets discharged from the discharge device, and an alignment reference member for aligning at least one edge of the sheets discharged to the storage means. Furthermore, the sheet discharge apparatus includes rotating bodies (belt unit) that contacts the sheets while the sheets are discharged by the discharge device to move the sheets discharged to the storage device to the alignment reference member. The rotating bodies for alignment do not hinder a discharge operation of discharge rollers of the discharge device, thereby fully utilizing a capacity of a sheet storage tray.

6 Claims, 40 Drawing Sheets

160
161
162
163
67b
67
61
68d
69
62
65
22
8
S

OFFSETTING DISCHARGING APPARATUS WITH ALIGNING MEMBER

BACKGROUND OF THE INVENTION

This invention relates to an offsetting discharging apparatus with aligning member or a sheet discharge apparatus that discharges sheets discharged from an image forming apparatus such as copiers, printers, facsimile machines or a combination of two or more of these, to a storage tray.

Conventionally, sheet discharge apparatuses that are mounted to image forming apparatuses, such as copiers, printers and facsimiles or a combination of two or more of these, and that form aligned sheet bundles urged toward an aligning member such as a side fence by rotating bodies such as rollers, paddles and belts for aligning each sheet fed to a storage tray from the image forming apparatus and for finishing aligned sheet bundles using staples, punching holes or by applying glue, are well known.

These sheet discharge apparatuses, for example a system described in Japanese Patent Publication (Tokkai) No. 228471, are composed to move sheets toward an alignment reference member by touching each sheet with rotating bodies such as rollers, paddles or belts used for alignment after completely discharging the sheets to a storage tray from a discharge means such as discharge rollers used to discharge each sheet to a storage tray.

In the sheet discharge apparatus described above, it is structured to move sheets toward an alignment reference member by touching each sheet with rotating bodies such as rollers, paddles or belts used for alignment after completely discharging sheets to a storage tray from a discharge means such as discharge rollers used to discharge each sheet to a storage tray. Therefore, there is wasted time for moving the aforementioned rotating bodies to a position for contacting the sheet, and for driving the rotating bodies after moving to the contact position.

An object of the present invention is to provide a sheet discharge apparatus and an image forming apparatus equipped with the same that touch sheets while driving rotating bodies such as rollers, paddles or belts, or the like, for alignment while discharging the sheet from a discharge means such as discharge rollers, to a storage tray, and applies the alignment action by the rotating bodies such as rollers, paddles or belts, etc. for alignment on the sheets immediately after the sheets are discharged to the storage tray without a time-lag, to alleviate the problem of the prior art.

SUMMARY OF THE INVENTION

To attain the aforementioned objectives, the sheet discharge apparatus according to the first aspect of the invention comprises discharge means to discharge sheets, storage means to receive the sheets discharged from the aforementioned discharge means, an alignment reference member for aligning at least one edge of the sheets discharged to the aforementioned storage means, and rotating bodies that contact the sheets being transferred by the aforementioned discharge means to move the sheets discharged to the aforementioned storage means to the aforementioned alignment reference member.

It is acceptable to use rollers, paddles or belts as the rotating bodies.

This invention provides the rotating bodies for moving the sheets to the alignment reference member for alignment. The rotating bodies are driven in an alignment direction in advance, and touch the sheets being discharged by the discharge means to move the sheets discharged to the storage means toward the alignment reference member. The rotating bodies start an sheet sweeping operation on the sheets being discharged, specifically, without waiting until the sheets are completely discharged, to align them, so compared to the alignment operation in the prior art, there is no wasted time. In other words, because the prior art is configured to move the sheets toward an alignment reference member by touching each sheet with the rotating bodies for alignment after completely discharging the sheets to the storage tray from the discharge means, the time for the aforementioned rotating bodies to move to a position to touch the sheets, and the time required to drive the rotating bodies after moving to the contact position are wasted. In contrast, this invention eliminates that waste of time.

The second aspect comprises the aforementioned rotating bodies that touch the sheets being discharged by the aforementioned discharge means while rotating in the direction to move the sheets toward the aforementioned alignment reference member in the sheet discharge apparatus of the first aspect.

The rotating bodies can be embodied to be constantly lowered to a predetermined position on the storage tray (an activating position where they can touch the sheets) or they can embodied to switch between the activating position (the position where they can touch the sheets being discharged by the discharge means) and a retracted position (the position where the rotating bodies are separated from the sheets being discharged by the discharge means) so that the rotating bodies are at the activating position only for the necessary amount of time. In either case, it is preferable to drive them in advance in the alignment direction, resulting in a simpler configuration and control.

The third aspect comprises offset means that offset a position of the sheets being discharged to the aforementioned storage means relative to the aforementioned rotating bodies by horizontally moving a position of the aforementioned discharge means in the sheet discharge apparatus of the first aspect.

The horizontal movement means, in which rotating bodies carry the sheets to a pre-alignment position where the sheets are touched and aligned, has no limitation and can use any known means. However, the offset means for offsetting the position of the sheets being discharged to the storage means relative to the rotating bodies can be shared, thereby eliminating the need for any particular dedicated movement means to be disposed and enabling the sheet discharge apparatus to be compact.

The fourth aspect comprises control means to vary a timing to start the aforementioned offset means or a drive speed of the aforementioned offset means according to a size of the sheet in the sheet discharge apparatus of the third aspect.

The rotating bodies for the alignment described above are embodied to be constantly lowered to a predetermined position (the activating position to touch the sheets) on the storage means, or embodied to be able to switch between the activating position and the retracted position, but the following problems exist because of a relationship between the sheet contact position and the sheet size, a difference in the discharge reference position and a change in the sheet stacking height (the number of the sheets).

Specifically, assuming the former aspect wherein the rotating bodies are constantly lowered to the activating position, for example, even when the sheets are discharged with a center reference, there are differences in an amount of horizontal movement to carry the sheets to the pre-alignment position between using landscape sized A4 sheets and portrait sized A4 sheets.

Also, between a center reference discharge for the sheet discharge reference position and a rear reference discharge (when using the sheet edge on the alignment reference member side in the sheet width direction as the discharge reference of the discharge means), an amount of horizontal movement to the pre-alignment position X1 differs even for the same size sheet.

Still further, when there are a small number of the sheets to be discharged, the rotating bodies activating position matches to the pre-alignment position. However, as the number of the sheets increases, the rotating bodies activating position (pre-alignment position) becomes slightly offset, corresponding to the height of the stack of the sheets, to a front edge of the sheets (the sheet edge on the side separated from the alignment reference member in the sheet width direction) to become the pre-alignment position.

There are two methods to absorb this offsetting, namely varying the startup timing and the drive speed of the offset means.

The fourth aspect particularly handles such a case in which the sheet sizes vary and provides control means to vary the timing to start the offset means or the drive speed of the offset means according to the sheet size.

The fifth aspect comprises the aforementioned control means to quicken the timing to start the aforementioned offset means or to increase the drive speed of the aforementioned offset means according to the sheet size in the sheet discharge apparatus of the fourth aspect.

When the size of the sheets is small, more specifically, when the distance of travel to the pre-alignment reference position is long, the timing to start the offset means is quickened, or the drive speed of the offset means is increased, so that the sheet reaches the pre-alignment reference position at the same time, regardless of the size of the sheet. At this time, it is possible that the sheet horizontal movement speed by the offset means be constant.

On the other hand, when the size of the sheets is large, more specifically, when the distance of travel to the pre-alignment reference position is short, the timing to start the offset means is delayed, or the drive speed of the offset means is slowed, so that the sheet reaches the pre-alignment reference position at the same time, regardless of the size of the sheet. At this time, it is possible that the sheet horizontal movement speed by the offset means be constant.

The sixth aspect comprises control means for controlling the aforementioned offset means to vary the timing to start the aforementioned offset means or the drive speed of the aforementioned offset means according to the sheet size in the third aspect of the sheet discharge apparatus.

The sixth aspect particularly handles a case in which the sheet discharge reference position varies, and provides control means to vary the timing to start or the drive speed of the offset means according to the sheet discharge reference by the discharge means.

The seventh aspect, in addition to the sheet discharge apparatus of the sixth aspect, comprises a function for the aforementioned control means to quicken the timing to start the aforementioned offset means or to increase the drive speed of the offset means when the center of the sheet in the width direction is used as the aforementioned discharge means discharge reference (center discharge reference) or the sheet edge on the side separated from the alignment reference member in the sheet width direction (front discharge reference) as the aforementioned discharge means sheet discharge reference rather than the sheet edge on the aforementioned alignment reference member side (rear discharge reference) as the aforementioned discharge means reference.

When using the center discharge reference or the front discharge reference, more specifically, when the distance of movement to the pre-alignment reference position is long, the timing to start the offset means is quickened, or the drive speed of the offset means is increased, so that the sheet reaches the pre-alignment reference position at the same time, regardless of the size of the sheet. At this time, it is preferable that the sheet horizontal movement speed by the offset means be constant.

On the other hand, when using rear discharge reference, more specifically, when the distance of movement to the pre-alignment reference position is short, the timing to start the offset means is delayed, or the drive speed of the offset means is slowed, so that the sheet reaches the pre-alignment reference position at the same time, regardless of the size of the sheet. At this time, it is preferable that the sheet horizontal movement speed by the offset means be constant.

The eighth aspect comprises control means to vary the timing to start the aforementioned offset means or the drive speed of the aforementioned offset means according to the number of sheets discharged to the aforementioned storage means from the aforementioned discharge means in the sheet discharge apparatus of the third aspect.

This specifies a control for when the rotating bodies' activating position moves according to the aforementioned number sheets discharged (the stack height of the sheets).

As the number of the sheets stacked on the storage means increases and the stack height of the sheet bundle rises, the position where the rotating bodies for alignment actually touch the sheets moves toward the front (in the direction traversing the sheet discharge direction) obliquely to the rotating bodies. Specifically, displacement occurs in the position where the rotating bodies sweep the sheets. For that reason, by applying a constant amount to the movement of the pre-alignment, the rotating bodies effectively sweep in the sheets. The eighth aspect compensates the move of the rotating bodies activating position based on the change in the stack height by adjusting the offset means drive timing or drive speed.

The ninth aspect comprises a function for the control means to quicken the timing to start the aforementioned offset means or to increase the drive speed of the aforementioned offset means when number of sheets is lower than when the number of sheets is higher in the sheet discharge apparatus of the eighth aspect.

When the number of sheets is small, more specifically, when the distance of travel to the pre-alignment reference position is long, the timing to start the offset means is quickened, or the drive speed of the offset means is increased, so that the sheet reaches the pre-alignment reference position at the same time, regardless of the size of the sheet. At this time, it is preferable that the sheet horizontal movement speed by the offset means be constant.

When the number of sheets is large, more specifically, when the pre-alignment position changes, and the distance of travel is short, the timing to start the offset means is delayed, or the drive speed of the offset means is slowed, so that the sheet reaches the pre-alignment reference position at the same time, regardless of the size of the sheet. At this time, it is preferable that the sheet horizontal movement speed by the offset means be constant.

The tenth aspect comprises support means for movingly supporting the aforementioned rotating bodies between an activating position that touches sheets discharged by the aforementioned discharge means and a retracted position that is retracted from the sheets discharged by the aforementioned discharge means in the sheet discharge apparatus of the second aspect.

Regarding the support means that movingly supports the rotating bodies between the activating position and the retracted position, for example, the rotating bodies for alignment such as rollers, paddles or belts frictionally abut to slide around the drive support shaft and normally the rotationally drive of the support shaft is transmitted to the rotating bodies. However, when a force greater than a constant is applied, the rotating bodies revolve relatively around the support shaft to enable their switching between the activating position and the retracted position. It is possible to employ another actuator as the drive source that applies a force greater than the constant required to revolve the rotating bodies.

The eleventh aspect comprises control means for controlling the aforementioned support means to move the aforementioned rotating bodies between an activating position from the aforementioned retracted position to the aforementioned activating position so the rotating bodies touch the portion separated a predetermined distance from the trailing edge of the sheet in the discharge direction discharged by the aforementioned discharge means, regardless of the sheet discharge reference and sheet size in the sheet discharge apparatus of the tenth aspect.

In the aspect where the rotating bodies are constantly lowered, a load is applied by the force of resistance to the discharged sheet when the rotating bodies touch the sheet. For that reason, the effect of the sweeping action by the rotating bodies cause the sheet to push back and cause the edge of the sheet not to be completely discharged or to be discharged and arranged obliquely.

However, as with the eleven aspect of the invention, a structure to enable the rotating bodies to switch between the retracted position and the activating position eliminates the problem of the sheets being arranged obliquely.

The twelfth aspect in the image forming apparatus comprises the sheet supply means for feeding one sheet at a time, the image forming means for forming desired images on sheets fed by the aforementioned sheet supply means and the sheet discharge apparatus of the first aspect that finishes sheets formed thereupon by the aforementioned image forming means.

The sheet discharge apparatus according to the thirteenth aspect comprises discharge means for discharging sheets, storage means to receive sheets discharged from the aforementioned discharge means, an alignment reference member for aligning at least one edge of sheets discharged to the aforementioned storage means, rotating bodies that touch sheets being transferred by the aforementioned discharge means to move sheets discharged to the aforementioned storage means to the aforementioned alignment reference member, and the forcible discharge means disposed on the upstream position substantially opposing the aforementioned aligning rotating bodies in the sheet discharge direction for discharging the trailing edge of the sheets to the aforementioned storage means.

The fourteenth aspect of the sheet discharge apparatus structures the aforementioned discharge means by paired rotating shafts and discharge rotating bodies supported each on rotating shafts, and structures the aforementioned forcible discharge means by a forcible discharge rotating bodies supported by at least one of the aforementioned paired rotating shafts.

The fifteenth aspect of the sheet discharge apparatus comprises shift means to move the aforementioned discharge means in the shift direction along the aforementioned rotating shaft.

The sixteenth aspect of the sheet discharge apparatus comprises positioning means for positioning the aforementioned forcible discharge means in the aforementioned shift direction to a position upstream substantially opposing the aforementioned aligning rotating bodies even when the aforementioned discharge means are shifted by the aforementioned shift means.

In the seventeenth aspect of the sheet discharge apparatus, the aforementioned shift means move the aforementioned rotating bodies mounted with the aforementioned discharge rotating bodies in the shift direction along the aforementioned rotating shaft.

The eighteenth aspect of the sheet discharge apparatus comprises the aforementioned positioning means of the bearing portion for the aforementioned forcible discharge means that slidingly mates with the aforementioned rotating shaft and the positioning member that regulates the movement to the shift direction of the forcible discharge means.

In the nineteenth aspect of the sheet discharge apparatus, by shifting the aforementioned rotating shaft by the aforementioned shift means, a portion of the aforementioned rotating shaft that slidingly mates with the aforementioned forcible discharge means shaft bearing portion or all of the aforementioned rotating shaft sectional shape is non-cylindrical.

The twentieth aspect of the image forming apparatus comprises the sheet supply means for feeding one sheet at a time, the image forming means for forming desired images on sheets fed by the aforementioned sheet supply means and the sheet discharge apparatus of the first aspect that finishes sheets formed thereupon by the aforementioned image forming means.

DETAILED DESCRIPTION OF PREFERRED EMBODIMENTS

The following describes in detail the preferred embodiments according to the present invention in reference to the drawings provided.

A. Mounting Structure and Transport System (FIG. 1)

Figure 1:
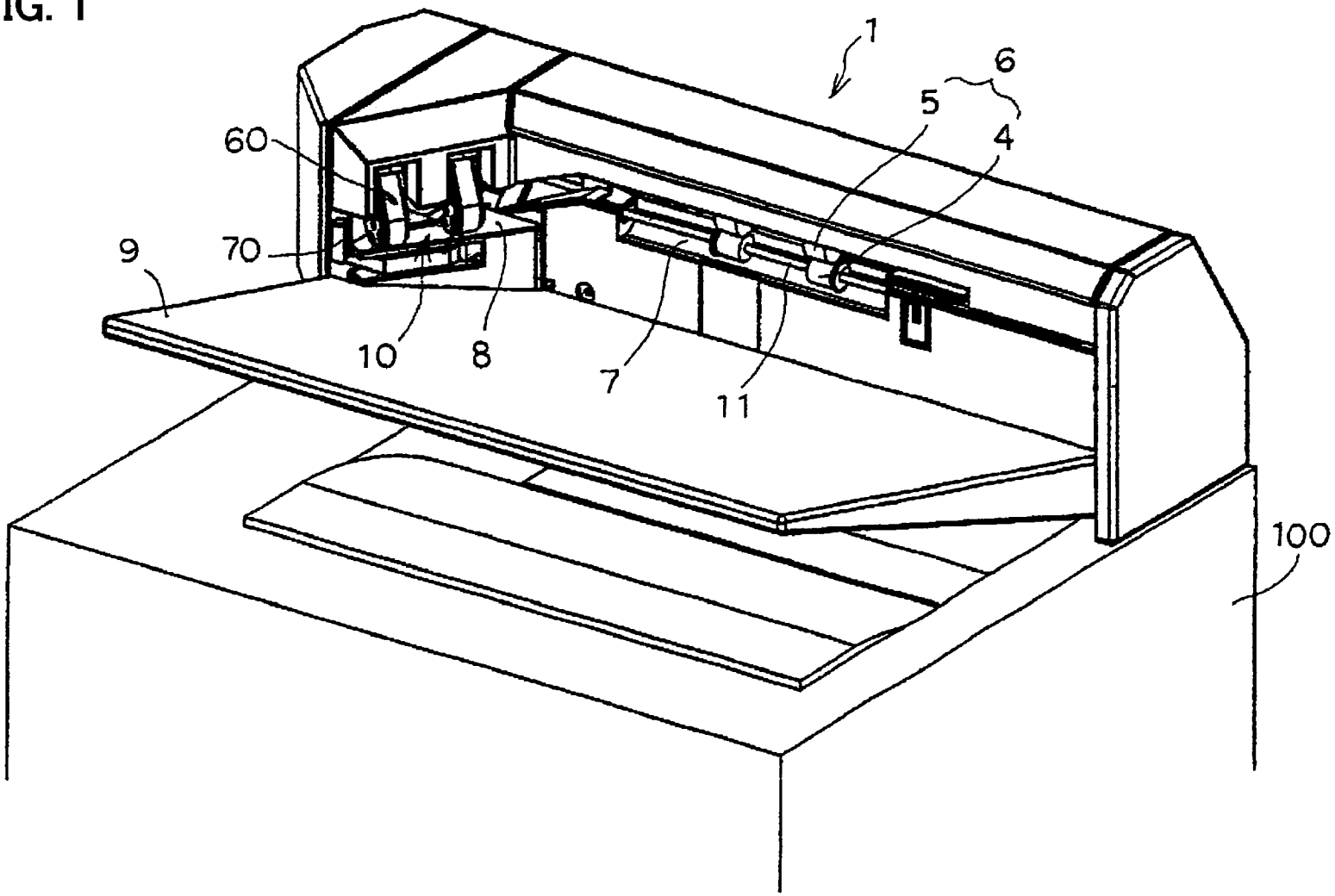
FIG. 1 is an external view of a sheet discharge apparatus of the present invention.

FIG. 1 shows one embodiment of the image forming apparatus provided with the sheet discharge apparatus according to the present invention. In this embodiment, the sheet discharge apparatus 1 according to the present invention is structured to be detachably mounted to the top of the image forming apparatus 100 comprising a page printer. More specifically, to connect the sheet discharge apparatus 1 and the image forming apparatus 100, a lock arm 1*a* (FIG. 2) is protrudingly established on the lower side of the sheet discharge apparatus 1, the lock arm mating with a holding portion (not shown in the drawings) inside of the image forming apparatus 100 to mount the sheet discharge apparatus 1 on the top of the image forming apparatus 100.

Note that although in this embodiment, the image forming apparatus 100 comprises a page printer, it is also perfectly acceptable to apply the sheet discharge apparatus according to the present invention to a copier as well.

Figure 2:
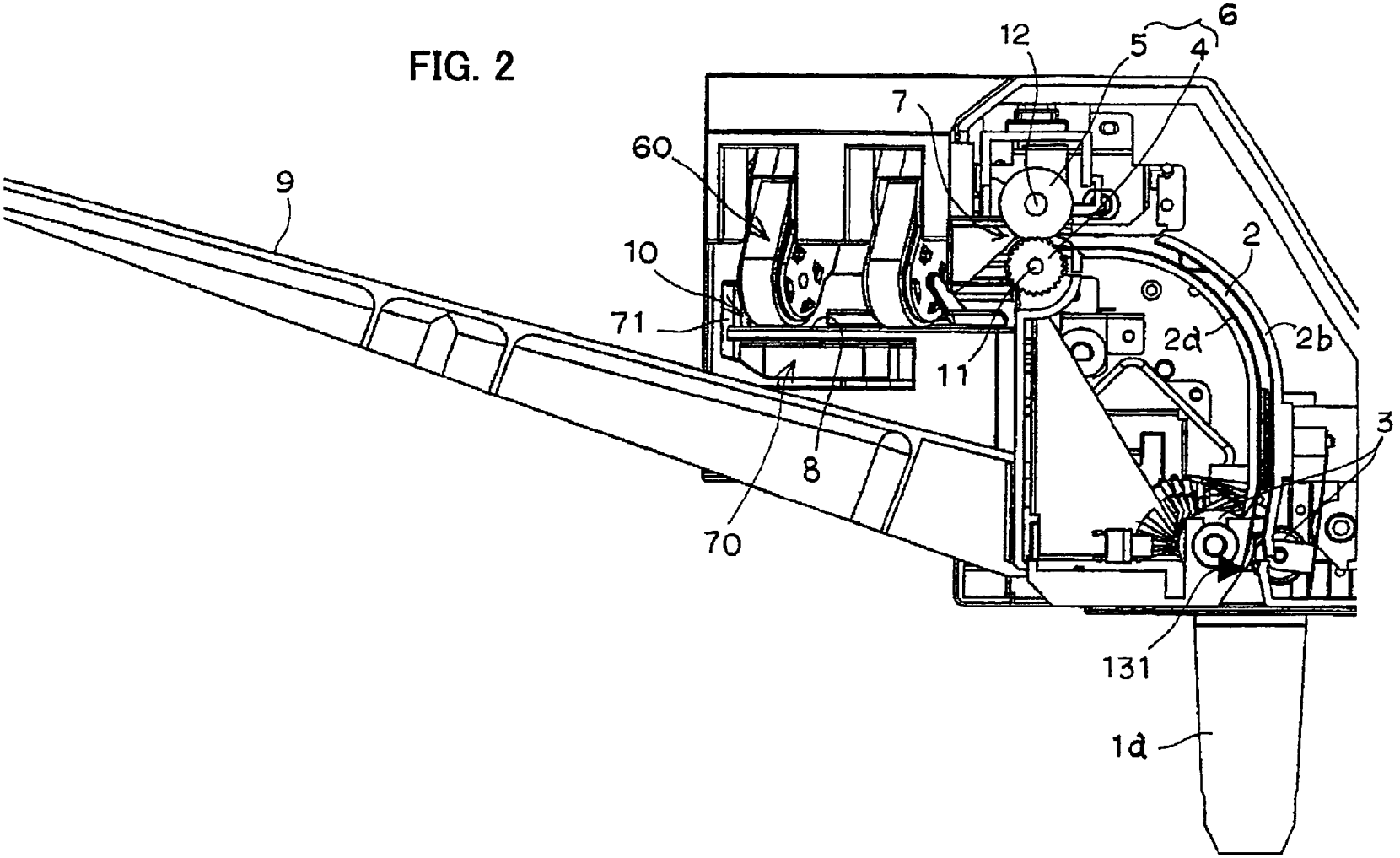
FIG. 2 is a sectional view showing the sheet discharge apparatus separated vertically at a paper path portion according to the present invention.

FIG. 2 shows the configuration of the transport system to receive, then to discharge printed or copied sheets (called sheets below) from the image forming apparatus 100.

Sheets discharged toward the top from the discharge portion, not shown in the drawings, on the image forming apparatus 100 are fed to the paper path (sheet transport path) 2 formed by the upper guide 2*a* and the lower guide 2*b* inside of the sheet discharge apparatus 1. This paper path 2 extends substantially vertically to the back of the sheet discharge apparatus 1 and bends to the front. To the lower edge, the inlet the paired transport rollers 3 are disposed. In other words, the aforementioned copy sheets are fed into the paper path 2 by the paired transport rollers 3 disposed at the lower edge inlet of the paper path 2, and further downstream into the sheet discharge apparatus and are discharged from the discharge outlet 7.

B. Sheet Discharge Means 6

In FIG. 1, to the discharge outlet 7 on the sheet discharge apparatus 1 are arranged the paired tray discharge rollers 4 and 5 composed of the discharge roller 4 which is a follower roller and the tray discharge roller 5 which is a drive roller as the sheet discharge means 6.

Figure 20:
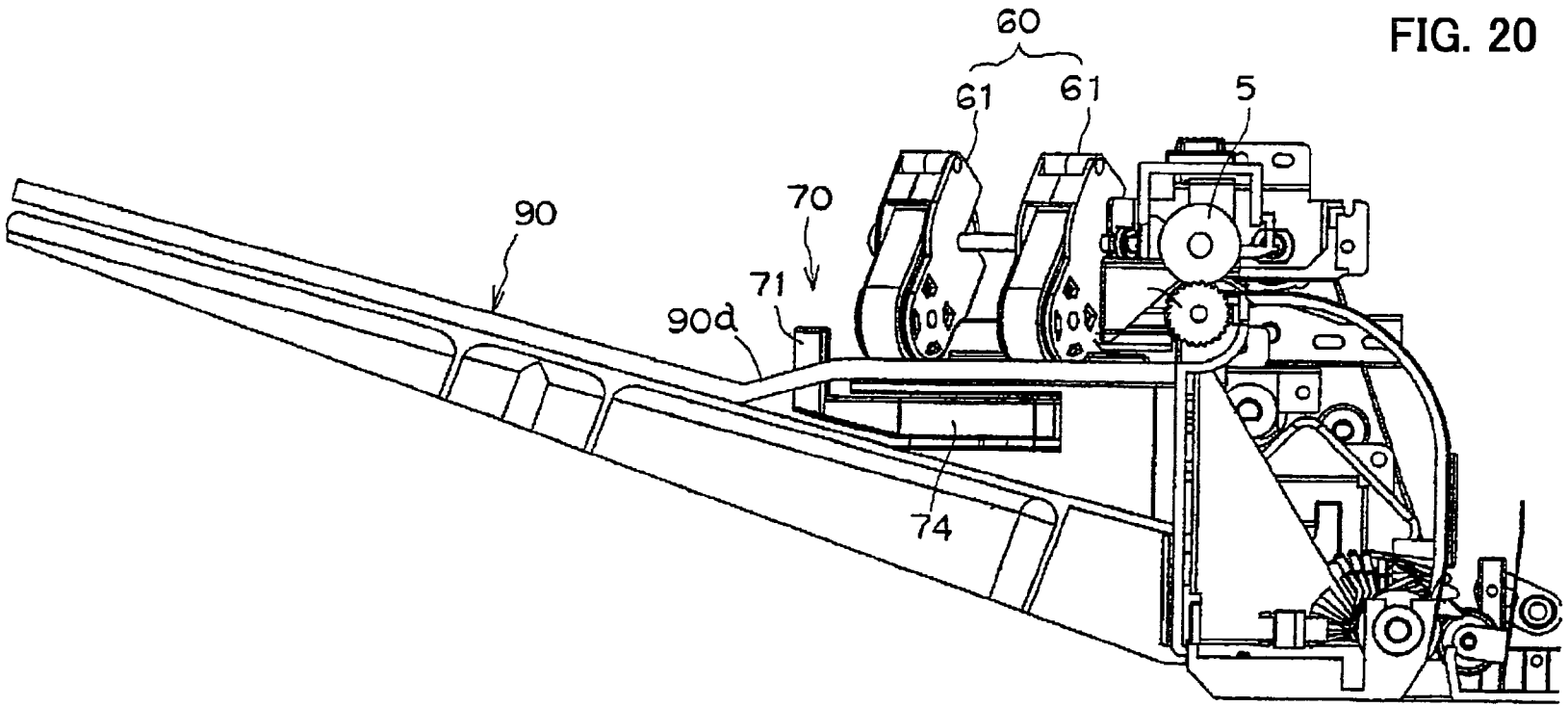
FIG. 20 is a partially sectional view showing a positional relationship in the vertical direction among the fixed stacking portion (the first tray), the storage tray (the second tray), and the sheet bundle in the sheet discharge apparatus according to the present invention.
Figure 21:
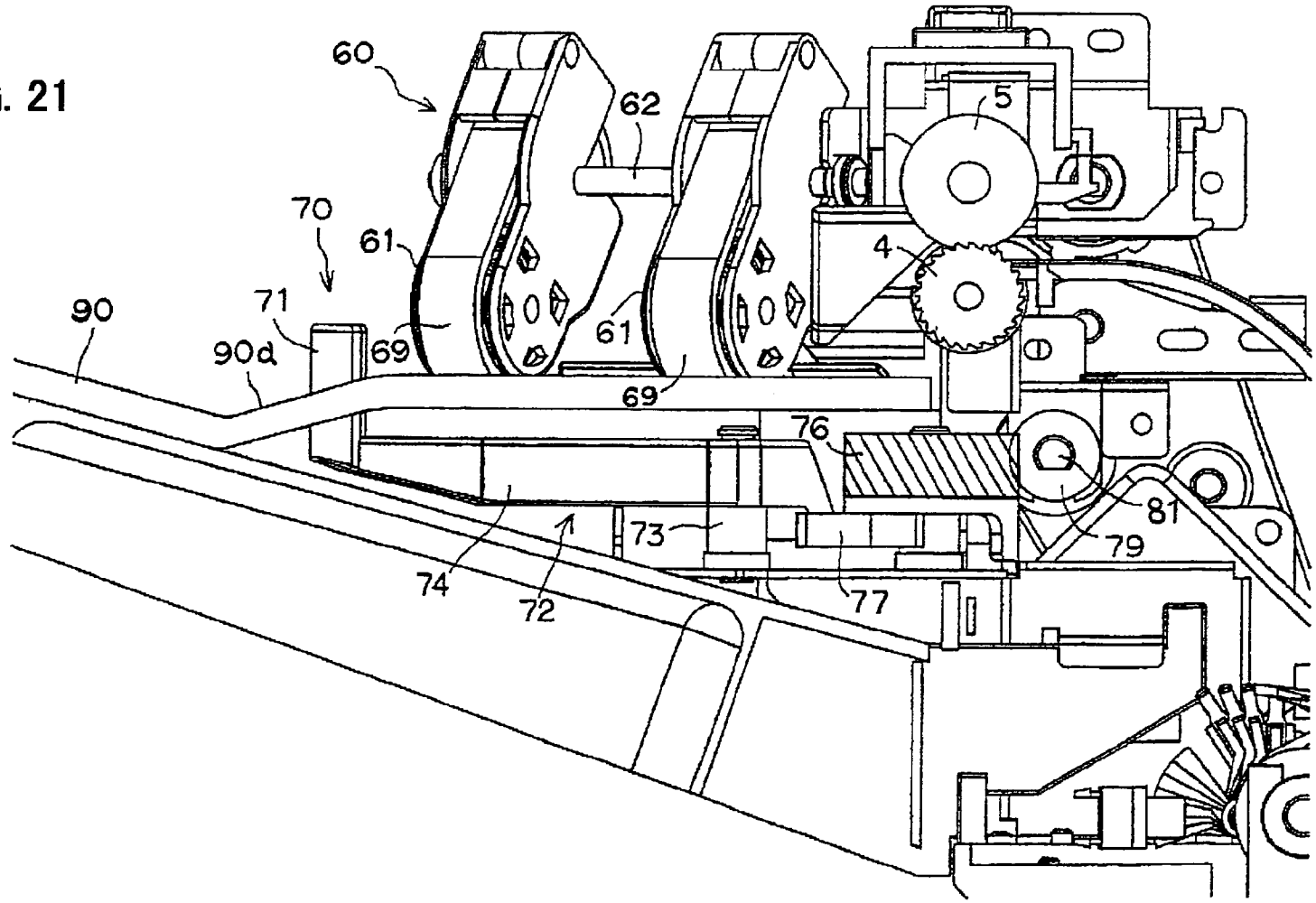
FIG. 21 is a side view showing a partial section of the sheet bundle discharge means (sheet moving means) in the sheet discharge apparatus according to the present invention.

Also, downstream of the direction of sheet transport of the paired tray discharge rollers 4 and 5 is established the sheet storage means composed of the first tray (fixed stacking portion 8) and the second tray (storage tray 9). Also, the fixed stacking portion 8 (the first tray) is disposed as a configuring element of the support means (the sheet single corner portion support means) 10 that supports one corner of sheets discharged by the aforementioned discharge means 6 in the upstream side in the discharge direction. In this embodiment, the fixed stacking portion 8 is configured to form a substantial triangle shape to support a corner of the trailing edge of the sheets, but it is also perfectly acceptable for it to be an oblong shape, any polygonal shape, or a circular shape. Furthermore, below the fixed stacking portion 8 is disposed the storage tray 9 (the second tray) having a size large enough to receive the maximum sized sheets discharged. Also, sheets are discharged by the paired tray discharge rollers 4 and 5 from the discharge outlet 7 to the fixed stacking portion 8 and the top of the stacking surface on the storage tray 9 and are stacked as shown in FIG. 20 and FIG. 21.

To enable a configuration for the paired tray discharge rollers 4 and 5 on the sheet discharge means 6 to rotate, near the discharge outlet 7 inside of the sheet discharge apparatus 1 are rotatingly arranged the two support shafts 11 and 12 that extend in parallel vertically, the aforementioned paired tray discharge rollers 4 and 5 being mounted in an appropriate plurality (in this case, a pair of two) midway on the each of the support shaft 11 and the support shaft 12.

Figure 5:
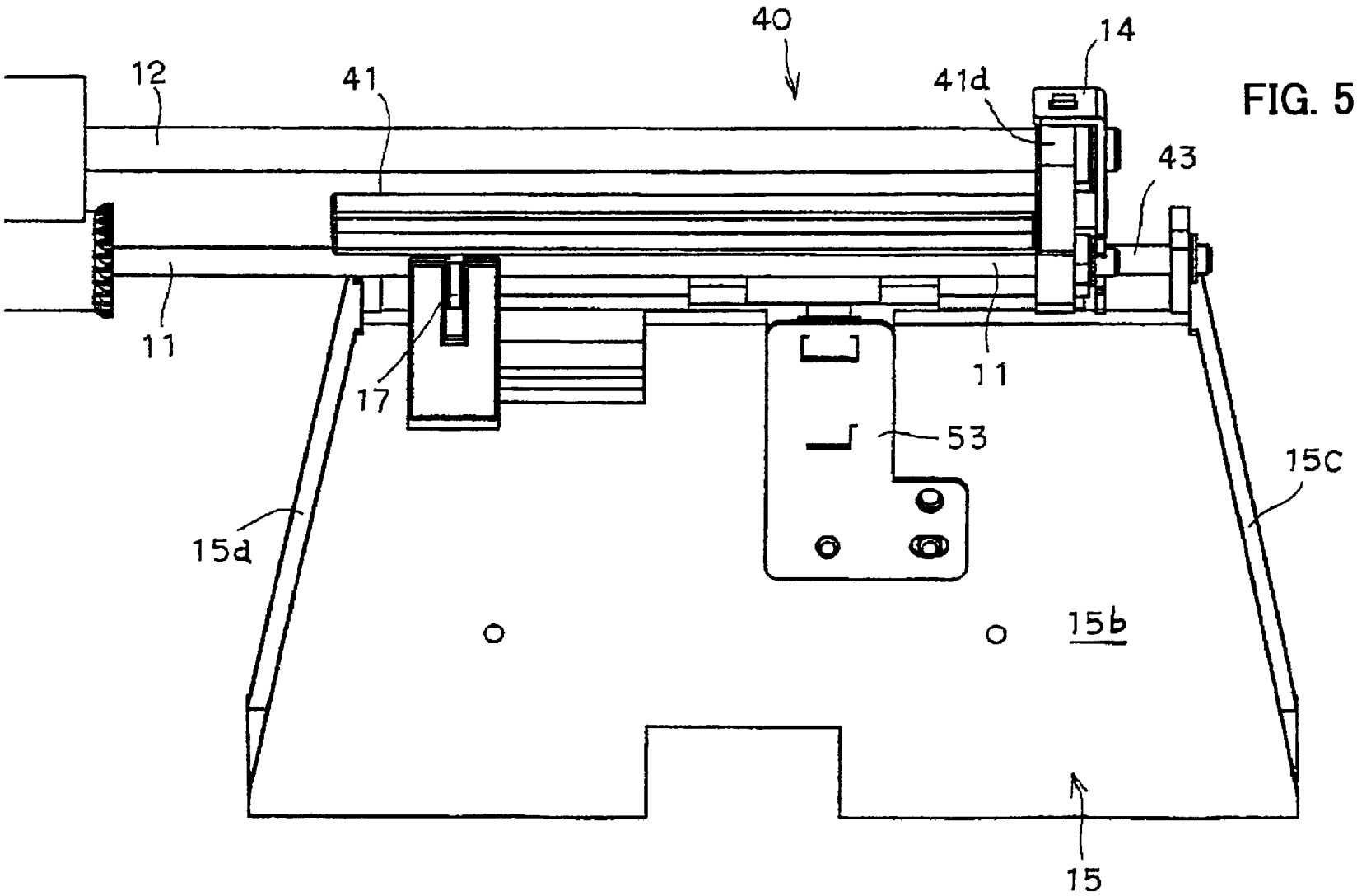
FIG. 5 is an expanded view showing a stand frame that supports a right edge of a support shaft of the sheet discharge apparatus shown in FIG. 4.
Figure 6:
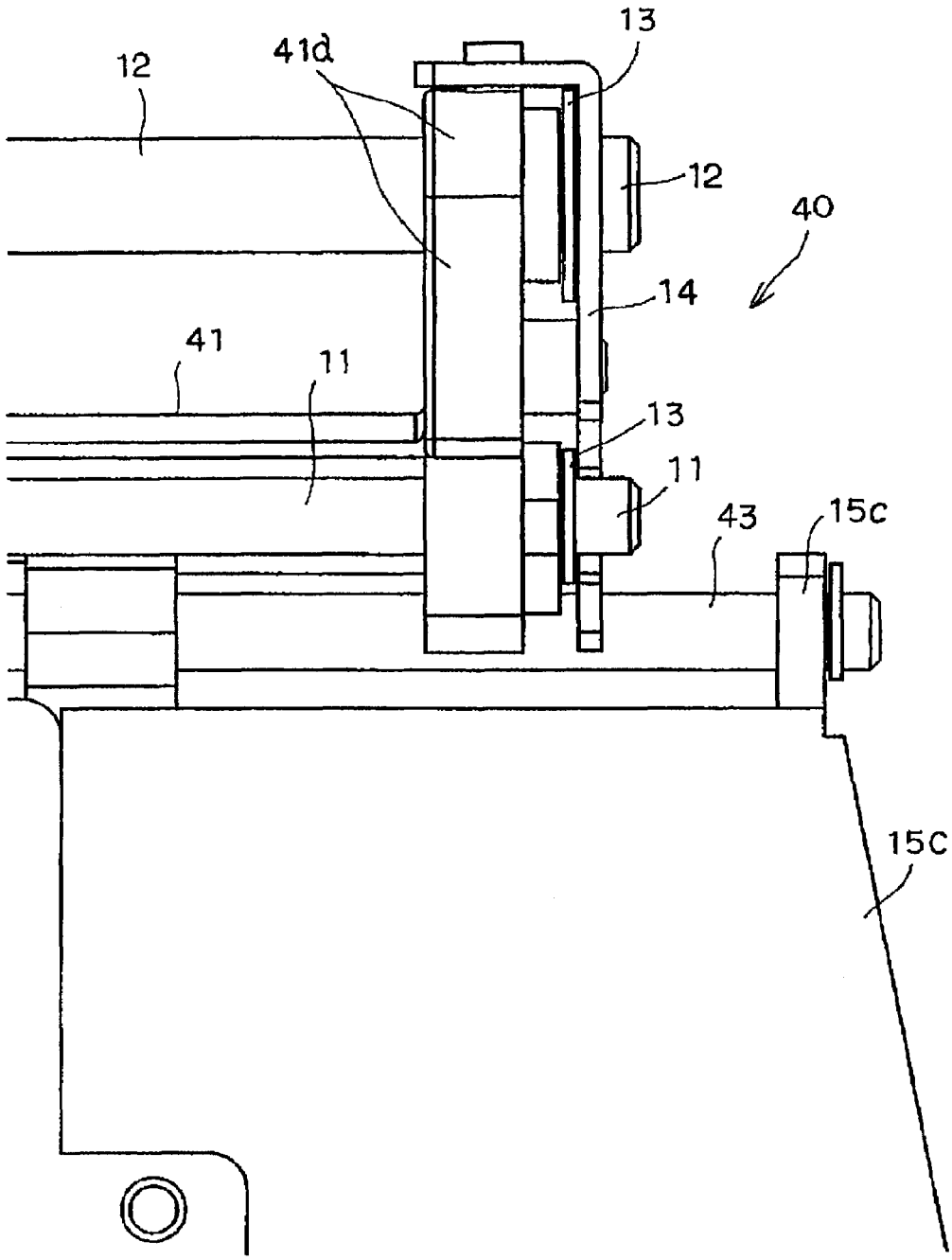
FIG. 6 is a view showing an enlarged portion of FIG. 5.

As is clearly shown in FIG. 5 and FIG. 6, the leading ends (the right side of FIG. 3) of both of the two support shafts 11 and 12 are inserted into the ear portion 41*a* protrudingly established on the outer edge of the upper surface on the sliding joint plate 41 which is a part of the sheet pre-alignment moving means (side alignment means) 40 dually used with the sheet side feed means of the sorting means (jog means) and are unitized to enable move according to the sliding joint plate 41.

More specifically, to the leading edges of each of the support shafts of 11 and 12 beyond their penetration of the ear portion 41*a* of the sliding joint plate 41 is disposed the E ring 13. The removal preventing member 14 used commonly on both support shafts 11 and 12 is disposed on the outer ends in the shaft direction of both the support shafts 11 and 12. The actions of the E ring 13 and the commonly used removal preventing member 41*a* disposed on the outer ends are unitized so that the shafts do not come out in the shaft direction.

Also, of the two support shafts 11 and 12, unitized as described above, the leading end of the lower support shaft 11 is rotatingly and in the shaft direction, movingly supported by a resilient vertically movable U-shaped first bearing member 17 on the upper portion of the U-shaped stand frame 15 established on one side in the sheet width direction of the base frame 1*c* (FIG. 7) in the sheet discharge apparatus 1.

Figure 10:
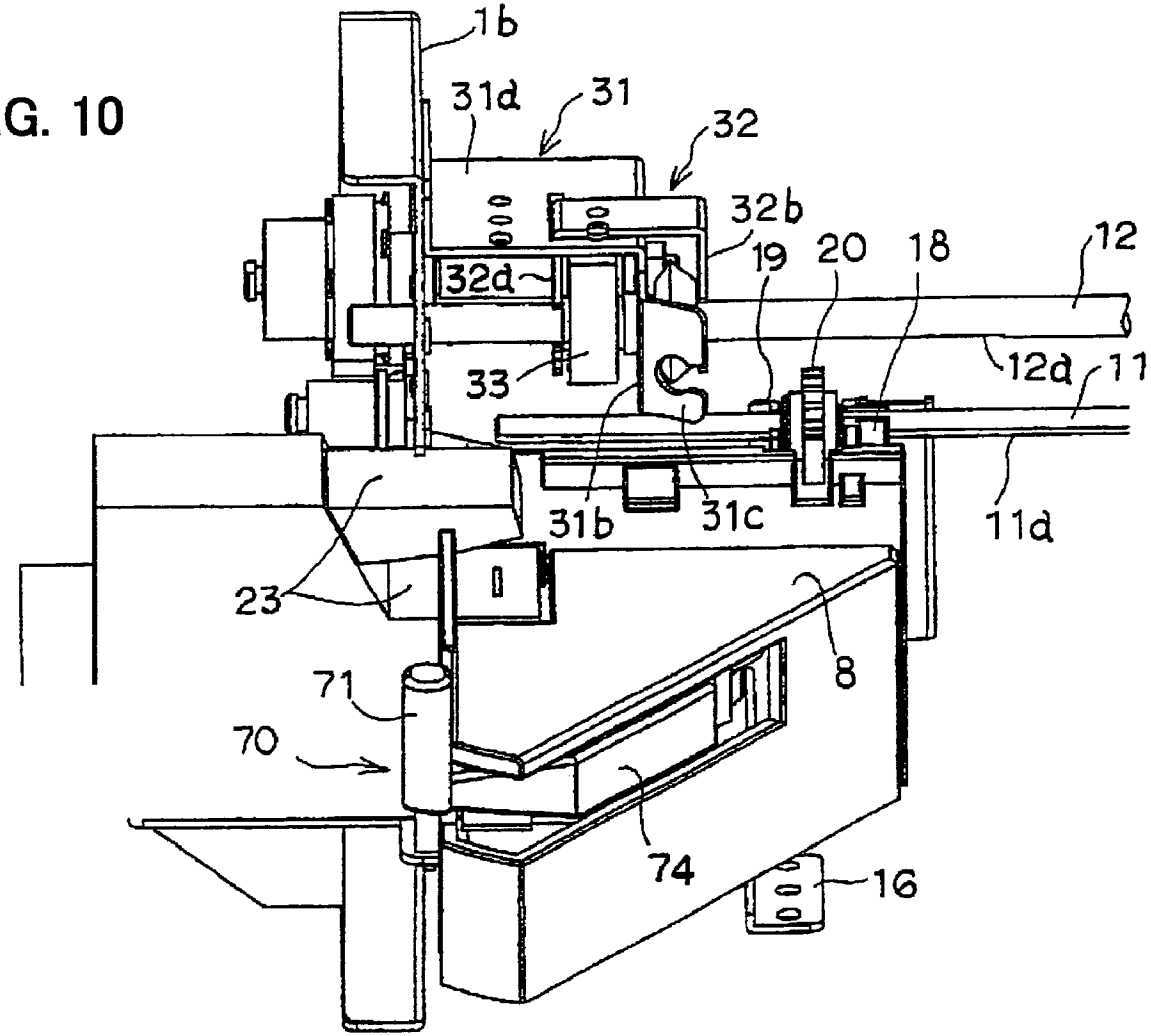
FIG. 10 is an enlarged view showing a structure that supports a left edge of the support shaft of the sheet discharge apparatus shown in FIG. 4.
Figure 11:
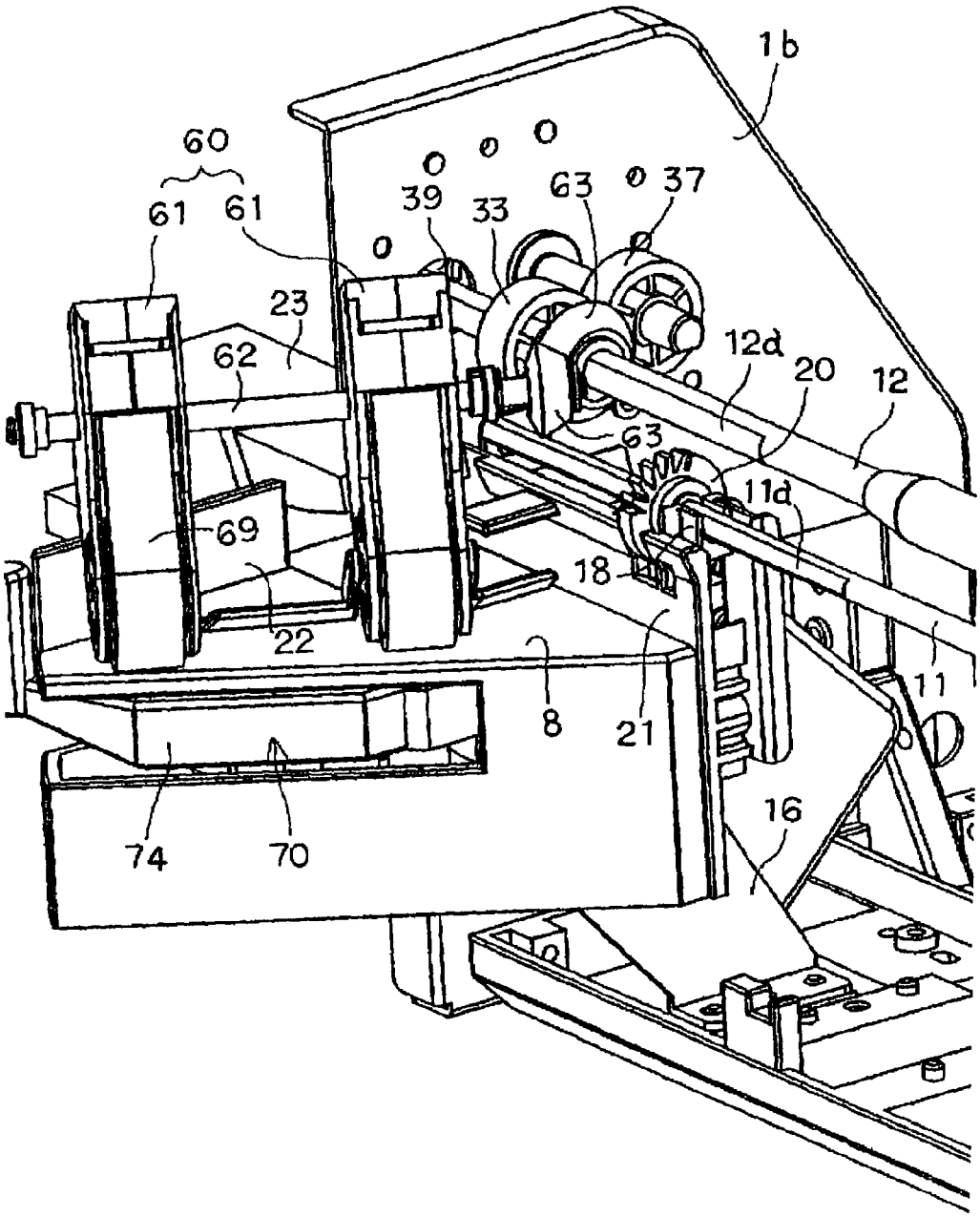
FIG. 11 is an enlarged view showing a left side of the support shaft of the sheet discharge apparatus shown in FIG. 4.

On the other hand, with regard to the reference side (the left side of FIG. 3) of the aforementioned two support shafts 11 and 12, the shafts are rotatingly and slidingly supported in the shaft direction. More specifically, in FIG. 10 and FIG. 11, the reference side of the supporting shaft 11 of the two support shafts 11 and 12, is rotatingly and in the shaft direction, movingly supported by a resilient vertically movable U-shaped second bearing member 18 on the first support member 16 which is mounted to the side frame 1*b* of the sheet finishing apparatus 1. In this embodiment, as shown in FIG. 10 and FIG. 11, the reference side of the shaft 11 is formed as an angled shape 11*a* having a sectional D shape, the angled shape 11*a*. This angled shape 11*a* is supported by the U-shaped second bearing member 18, resiliently supported for vertical movement with regard to the first support member 16, and is rotatingly and in the shaft direction, movingly supported.

Also, to this squared shape 11*a* on the supporting shaft 11 the discharge paddle 20 made of a resilient material (rubber, in this case) comprising a plurality of teeth in the circumference direction is mated to allow the free sliding on the squared shape 11*a* in the shaft direction. To fix the absolute position of this discharge paddle 20 in the shaft direction, to the supporting shaft 11 the first slide regulating member 19 is mounted at a position slightly separated from the aforementioned second bearing member 18, the discharge paddle 20 is disposed between the aforementioned second bearing member 18 and the first slide regulating member 19 so the supporting shaft 11 moves relative to the discharge paddle 20 but the discharge paddle 20 position is not changed. Also, the supporting shaft 11 is configured to advance and retract in the shaft direction penetrating the first slide regulating member 19 shaft hole and the notched opening portion 38 established in the side frame 1*b* while leaving the discharge paddle 20, the movement thereof in the shaft direction regulated by the first slide regulating member 19, between the first slide regulating member 19 and the second bearing member 18. Note that the aforementioned sectional D shaped squared shape 11*a* formed on the reference side of the supporting shaft 11 slidingly penetrates in the shaft direction not only the discharge paddle 20, but the first slide regulating member 19 as well.

In other words, from both sides of the discharge paddle 20, the supporting shaft 11 is formed in a D shape for at least for the distance for the support shaft to advance and retract, the shaft hole in the discharge paddle 20 also is formed into a D shape. Such configuration enables the rotation of the supporting shaft 11 to be transmitted to the discharge paddle 20 positioned between the second bearing member 18 and the first slide regulating member 19 even when the supporting shaft 12 and the supporting shaft 11 are advanced or retracted (sliding in the shaft direction). Therefore, while the paired tray discharge rollers 4 and 5 are advancing and retracting in the shaft direction along with the support shafts 11 and 12, and sheets are being discharged, the discharge paddle 20 is at a predetermined position between the first slide regulating member 19 and the second bearing member 18. In other words, by rotating without moving in the shaft direction, the discharge paddle 20 is configured to discharge sheets, at an upstream position substantially opposing the aligning means 60, described later, in the sheet discharge direction.

Furthermore, the reference side of the upper supporting shaft 12 also is movingly supported in the shaft direction with regard to the second supporting member 31 mounted on the side frame 1*b*. In other words, as shown in FIG. 10, to the inner wall of the side frame 1*b* are disposed the upper surface wall 31*a* that extends slightly inside from the side frame 1*b* and the second supporting member 31 that comprises the vertical downward bent wall 31*b* that continues downward therefrom. Further, the upside-down U-shaped second slide regulating member 32 that comprises the leg portion 32*a* and the leg portion 32*b* is disposed with its one leg portion 32*a* penetrating vertically downward the aforementioned second supporting member 31 upper surface wall 31*a*. Also, between the leg portion 32*a* on the second slide regulating member 32 and the vertical downward wall 31*b* on the second supporting member 31, the interlock gear 33 is disposed on the supporting shaft 12, the aforementioned interlock gear 33 allows a relative sliding of the shaft direction with regard to the supporting shaft 12 penetrating therethrough, but is supported not to allow relative rotation.

In this embodiment, as is shown in FIG. 10 and FIG. 11, the reference side of the supporting shaft 12 is formed as the squared shape 12*a* having a sectional D shape, the cooperative action of the squared shape 12*a* and the bearing portion of the second supporting member 31 allows the rotation of the reference side of the supporting shaft 12 by the interlock gear 33 and movement in the shaft direction.

The slide support structure described above allows the supporting shafts 11 and 12 to rotate and to move together accompanying the movement of the slide joint plate 41 in the shaft direction, the leading ends thereof joined together by the slide joint plate 41.

Figure 12:
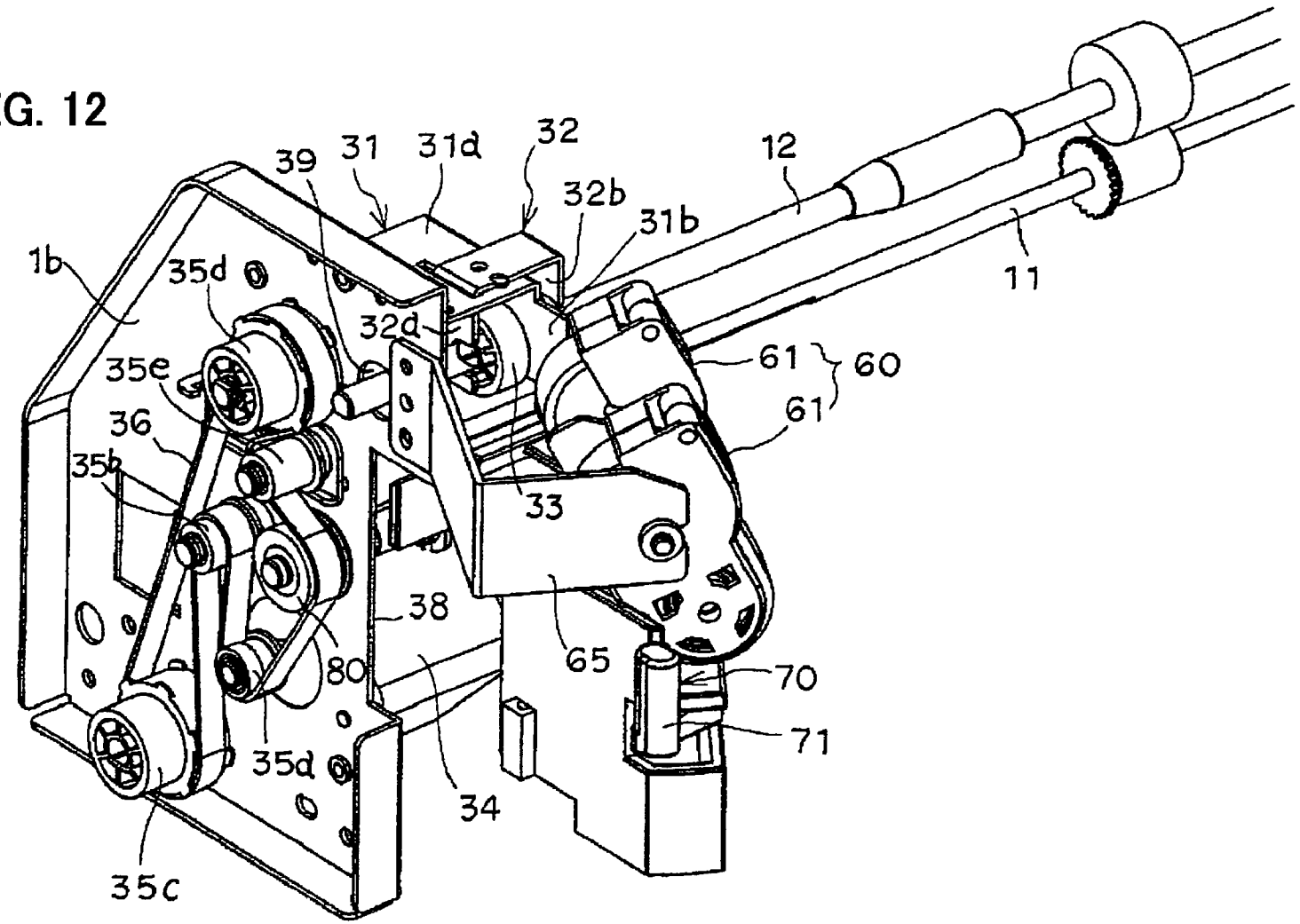
FIG. 12 is a perspective view of a drive mechanism of the support shaft of the sheet discharge apparatus shown in FIG. 4.

As shown in FIG. 12, to the side frame 1*b* are disposed the transport motor 34 that rotatingly drives the aforementioned supporting shaft 12 and that applies transport force to the sheets and the force transmission mechanism. Specifically, the output from the transport motor 34 is transmitted from the motor pulley 35*a* mounted on that output shaft to the relay pulley 35*b*, the transport roller pulley 35*c* and the follower pulley 35*d* via the timing belt 36 and the force transmission mechanism is configured so that transmits to the interlock pulley 37 disposed on the same shaft as the follower pulley 35*d*. The interlock gear 33 disposed on the aforementioned supporting shaft 12 mates with the interlock gear 37 that is the output side of the force transmission mechanism. Thus, the drive from the transport motor 34 is received by the interlock gear 33 and rotates the supporting shaft 12, accompanying that, the follower side supporting shaft 11 also rotates.

Specifically, the tray discharge roller 5 is the drive roller rotated by the transport motor 34 via the aforementioned force transmission mechanism. The other, the tray discharge roller 4, is a follower roller in contact with the tray discharge roller 5 and rotates by the rotation of the tray discharge roller 5.

Figure 13:
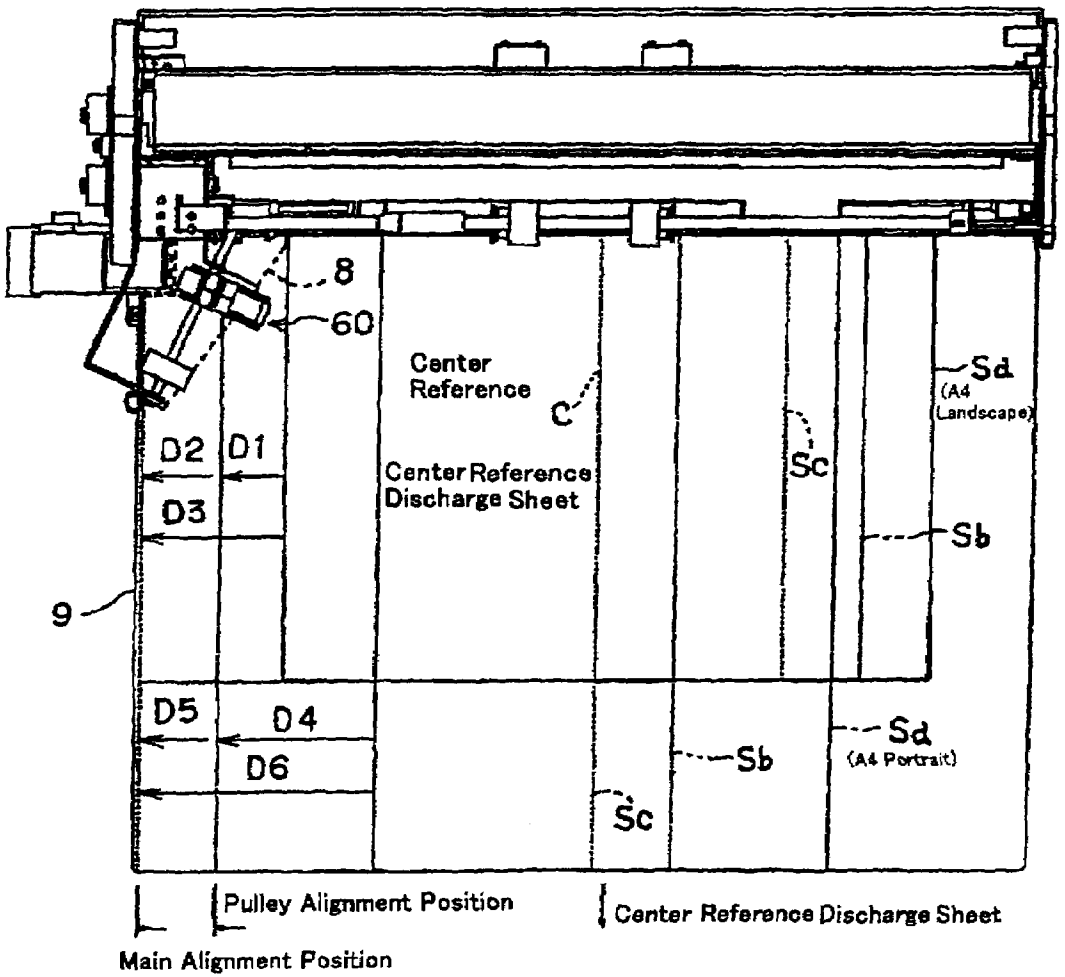
FIG. 13 is a drawing showing a relationship among a position of the sheets discharged from the sheet discharge apparatus according to the present invention with center reference, the pre-alignment position and the alignment position.
Figure 14:
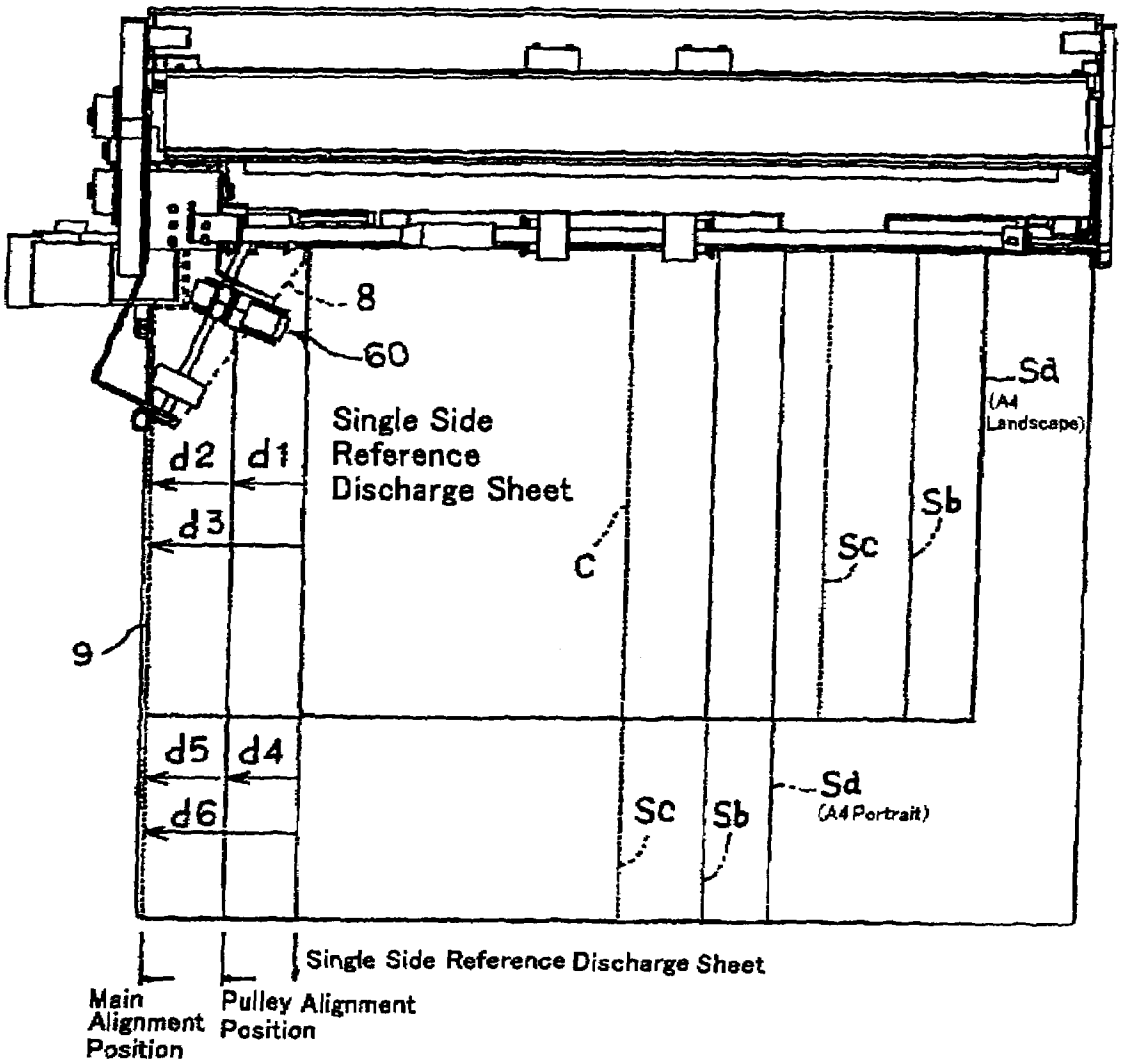
FIG. 14 is a drawing showing a relationship among a position of the sheet discharged from the sheet discharge apparatus according to the present invention with one side reference, the pre-alignment position and the alignment position.

C. Alignment Reference Position and Finishing Means (FIG. 13 and FIG. 14)

In the sheet discharge means 6 of the aforementioned configuration, the sheets are nipped by the rotating paired tray discharge rollers 4 and 5 and are fed from the discharge outlet 7 with the applied transport force and are discharged to the sheet storage means composed of the fixed stacking portion 8 (the first tray) and storage tray 9 (the second tray). FIG. 13 shows an embodiment of discharging sheets using center reference, and FIG. 14 shows an embodiment of discharging sheets using a front side reference.

Figure 15:
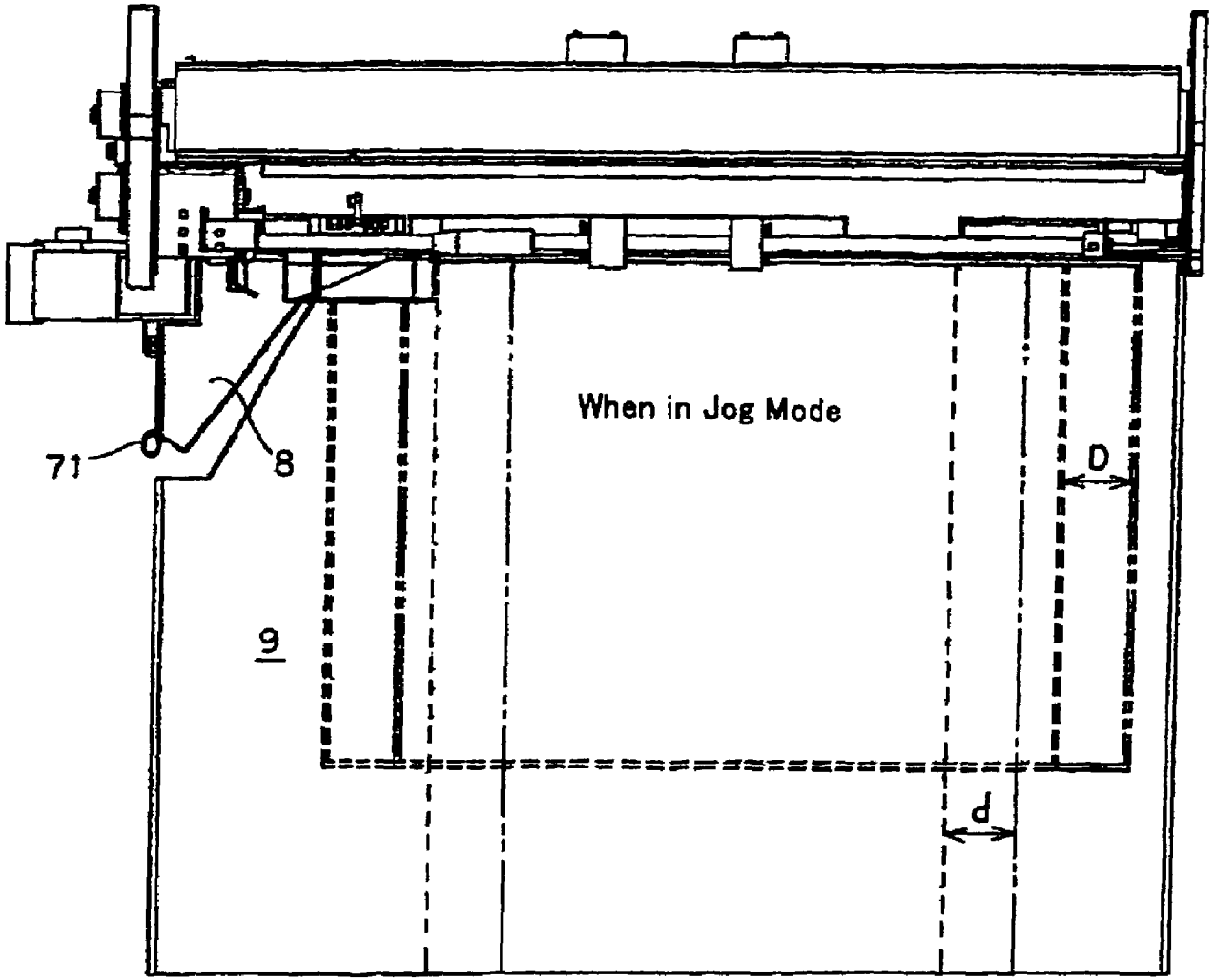
FIG. 15 is a drawing showing the sheet discharge position when the sheet discharge apparatus according to the present invention is operated on the jog mode.

Also, FIG. 15 shows the sheets being discharged when in the jog mode, which is described below. In the jog mode, while shifting each of the sheet bundles alternately a distance of D5, which is the offset amount, they are sequentially stacked when discharged, thereby offsetting each of the sheet bundles that are stacked, vertically.

The storage tray 9 (the second tray) is established to support three corners, excluding the sheet corner portion supported by the sheet single corner portion support means when finishing sheets by the stapler (finishing means) 23, which is described later. However, it is also perfectly acceptable for a size that supports one of the upstream corners of the three corners and a part of the back surface of the sheets. In this example, the storage tray 9 (the second tray) is long. That size has a dimension capable of storing the vertically long size of full sized sheets such as A3 or B4 (in this case, the length of A3 size).

The fixed stacking portion 8 (the first tray) as the aforementioned sheet single corner portion support means is formed so that the edge of the upper surface that supports sheets on the fixed stacking portion 8 (the first tray) is on the side of the single corner of the sheets from the diagonal line drawn between the two corners neighboring the single corner of the sheets when discharging the smallest size of sheet handled using the sheet discharge means 6. Here, the fixed stacking portion 8 (the first tray) as the aforementioned sheet single corner portion support means, is arranged above the single corner portion (the upper left corner in FIG. 13) upstream of the sheet discharge direction of the storage tray 9, to be a portion of the sheet storage surface for the storage tray 9 when looking from above.

Figure 3:
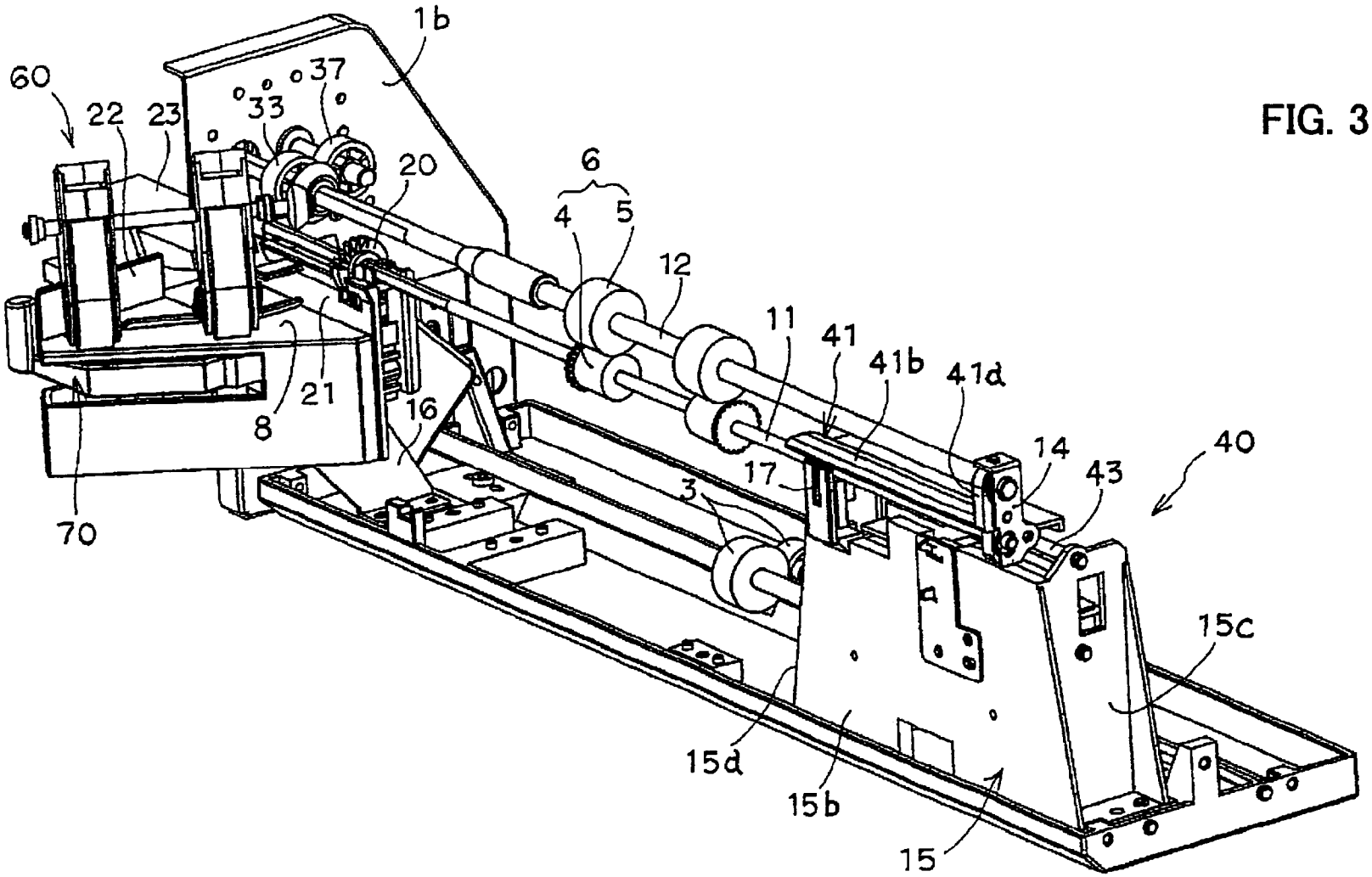
FIG. 3 is a perspective view of the sheet discharge apparatus with a cover and a storage tray removed according to the present invention.
Figure 4:
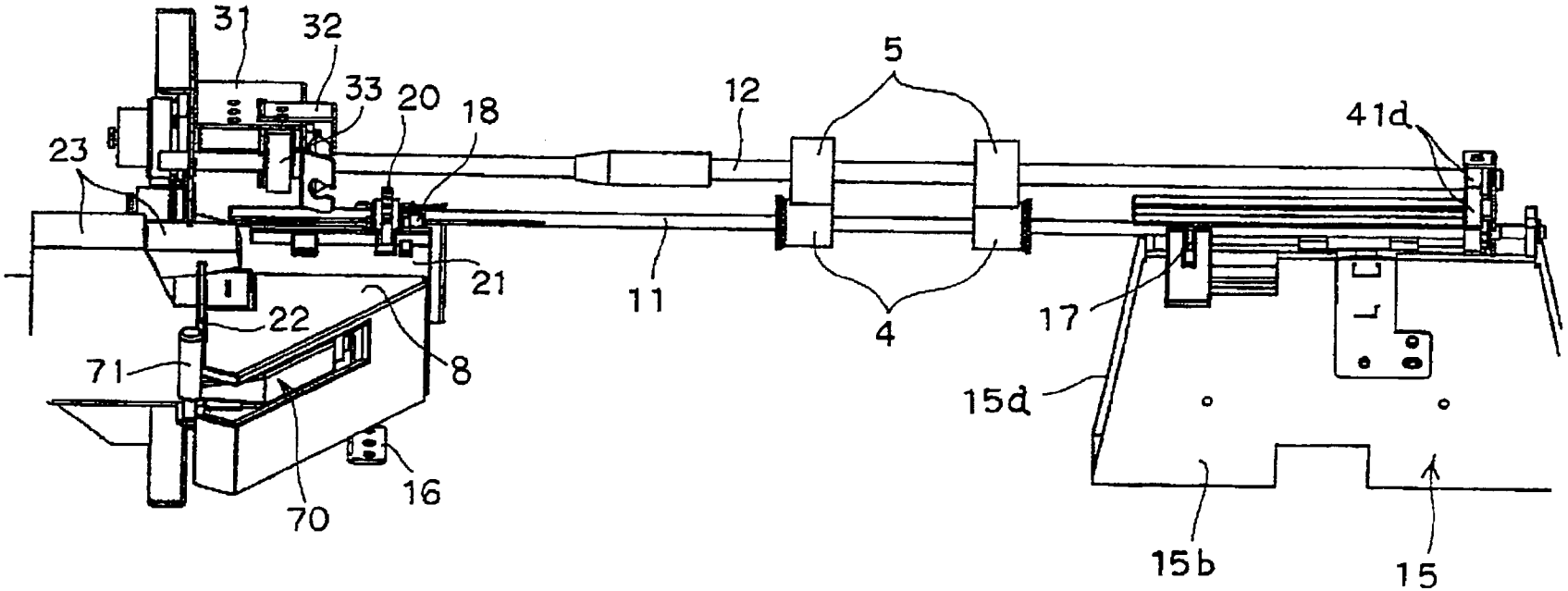
FIG. 4 is a perspective view of the sheet discharge apparatus shown in FIG. 3 viewed from above with a base frame removed.

As shown in FIG. 3 and FIG. 4, upstream of the fixed stacking portion 8 is established the abutting plate 21, either fixed or semi-fixed, as one of the positioning reference means (alignment reference member) to align at least one side of the sheets discharged by the discharge means 6, configuring the discharge direction reference surface that applies the discharge direction alignment reference position when aligning sheets.

On one side of the fixed stacking portion 8 is arranged the positioning plate 22 composed of the abutting reference (width direction alignment reference position) in the direction traversing the sheet discharge direction (hereinafter referred to as the width direction), as one of the position alignment reference means (alignment reference member) to align at least one side of the sheets discharged by the discharge means 6.

The finishing position is regulated by the abutting plate 21 (the discharge direction alignment reference position) and the positioning plate 22 (the width direction alignment reference position).

To the aforementioned fixed stacking portion 8 (the first tray) established as the finishing means is the stapler 23 that piercingly drives staples into and binds sheet bundles aligned by being pushed against this finishing position.

D. The Pre-alignment Movement Means (Sheet Horizontal Feed Means) 40

When discharging sheets with the side reference and the center reference, sheets are moved horizontally to the width direction alignment reference position only the distance of D1 to D4 in FIG. 13 and FIG. 14, by the sheet horizontal feed means of the jog means described below along with the pre-alignment movement means (side alignment means) 40 and are bound by the aforementioned stapler 23. Also, when in the jog mode, sheets are horizontally fed (traverse movement) only the amount of D5 in FIG. 15 for sorting.

For that purpose, the pre-alignment movement means 40 assumes the aforementioned sliding structure wherein the supporting shafts 11 and 12 on the paired tray discharge rollers 4 and 5 retract in the shaft direction. Furthermore, the structure is equipped with the sliding joint plate 41 and its sliding drive portion 45 to move together with the supporting shafts 11 and 12 in the shaft direction.

Figure 7:
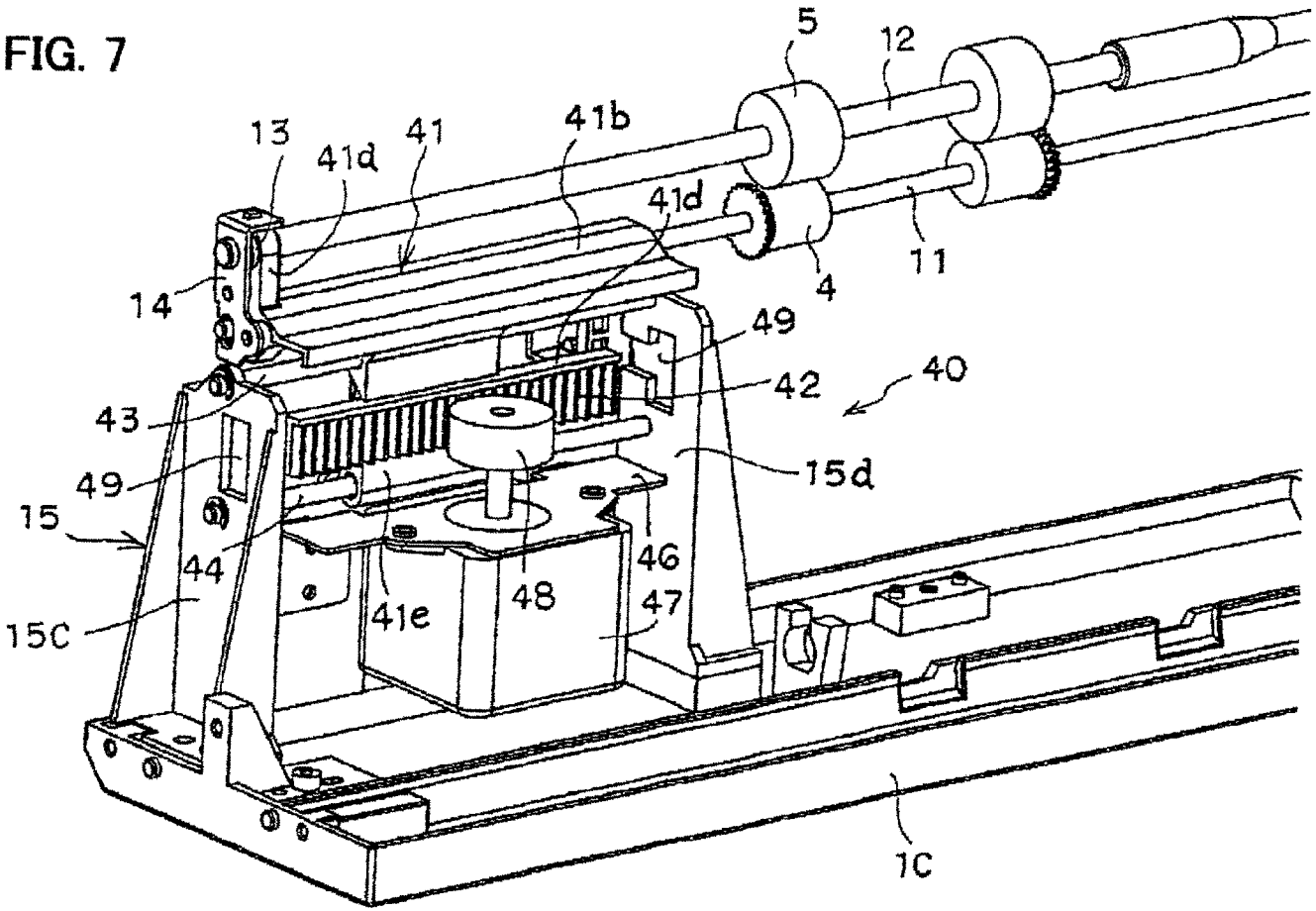
FIG. 7 is a perspective view showing the sheet horizontal feeding means (used as both the pre-alignment moving means and the sorting means) built into the stand frame shown in FIG. 5 seen from the inside of the apparatus.

As has already been described, the sliding joint plate 41, as shown in FIG. 7 which is one configuring element of the pre-alignment movement means 40 is equipped with the head portion 41*b* forming a guide surface for the sheets, the ear portion 41*a* protrudingly established on the upper surface thereof, the neck portion 41*c* vertically downward in the lower surface of the head portion 41*b*, the torso portion 41*d* that continues widthwise and one leg portion 41*e* formed to approximately the same thickness as the neck portion. Also, the neck portion 41*d* and the leg portion 41*e* are movingly supported in the shaft direction by the two upper and lower guide rods 43 and 44 suspended in the horizontal direction between the side walls 15*a* and 15*c* on the U-shaped stand frame 15.

The supporting shafts 11 and 12 are rotatingly supported, the leading ends thereof inserted into the ear portion 41*a* on the sliding joint plate 41 and are configured to slide together in the shaft direction, being unitized by the sliding joint plate 41.

Next, the explanation shall focus on the structure of the sliding drive portion 45.

To configure the sliding drive portion 45, the rack 42 is established to the along the supporting shaft 11 direction torso portion 41*d* on the aforementioned sliding joint plate 41. Also, as a slide support frame, to the inner wall of the stand frame 15 is established the slide motor 47, via the mounting plate 46, the pinion gear 48 mounted to the output shaft of the slide motor 47 mates with the aforementioned rack 42.

The aforementioned configuration of the sliding drive portion 45 transmits drive to the sliding joint plate 41 along the guide rods 43 and 44 by rotating while the pinion gear 48 mates with the rack 42 on the sliding joint plate 41, according to the forward and reverse drive of the slide motor 47 controlled by a control means which is described below and in the end, advances and retracts the supporting shafts 11 and 12 linked to the sliding joint plate 41 and the paired tray discharge rollers 4 and 5 which are mounted on each of the supporting shafts.

Viewed differently, the sliding drive portion 45 is composed of the slide motor 47 which is equipped with the sliding joint plate 41 that rotatingly links the supporting shafts 11 and 12, the guide rods 43 and 44 that retractably supports the sliding joint plate 41 in the shaft direction, the stand frame 15 that mountingly supports the guide rods 43 and 44 mounted to the base frame 1*c* and the pinion gear 48 rotatingly mounted on the shaft of the sliding drive portion 45. Furthermore, the sliding joint plate 41 configuration is equipped with the linking portion (the ear portion 41*a*) the supporting portions (neck portion 41*c* and leg portion 41*e*) that comprises the shaft hole for the penetration of the guide rods 43 and 44 and the rack 42 that mates with the pinion gear 48 mounted on the rotating shaft of the slide motor 47.

To the side walls 15*a* and 15*c* on the stand frame 15, which acts as the slide supporting frame is formed the slide opening portion 49 for the rack 42 to enter to the outside of the side walls 15*a* and 15*c* on the stand frame 15 when the pinion gear 48 advances and retracts the sliding joint plate 41.

Figure 8:
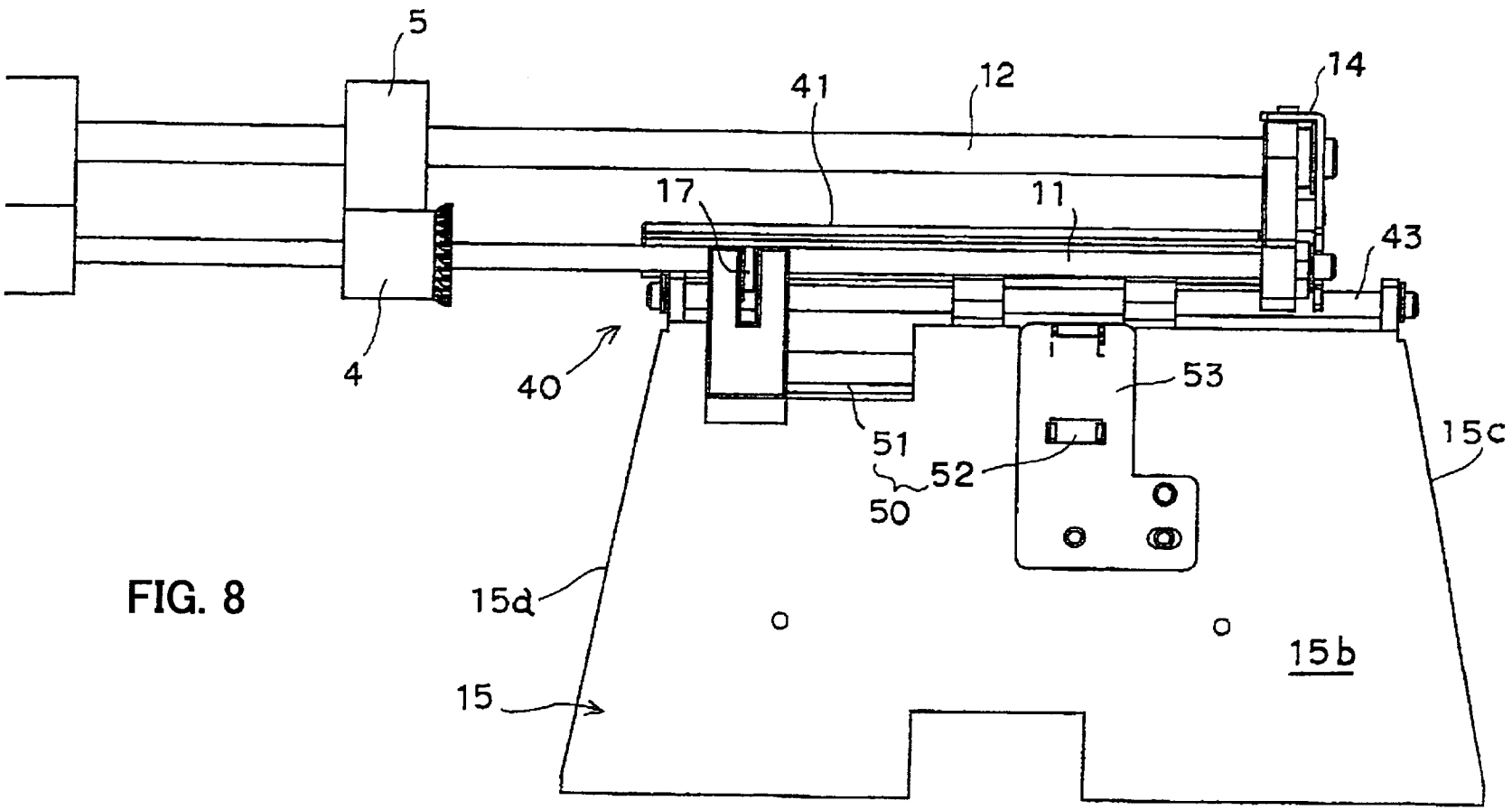
FIG. 8 is a drawing showing the HP detection sensor established in the stand frame on the sheet discharge apparatus.
Figure 9:
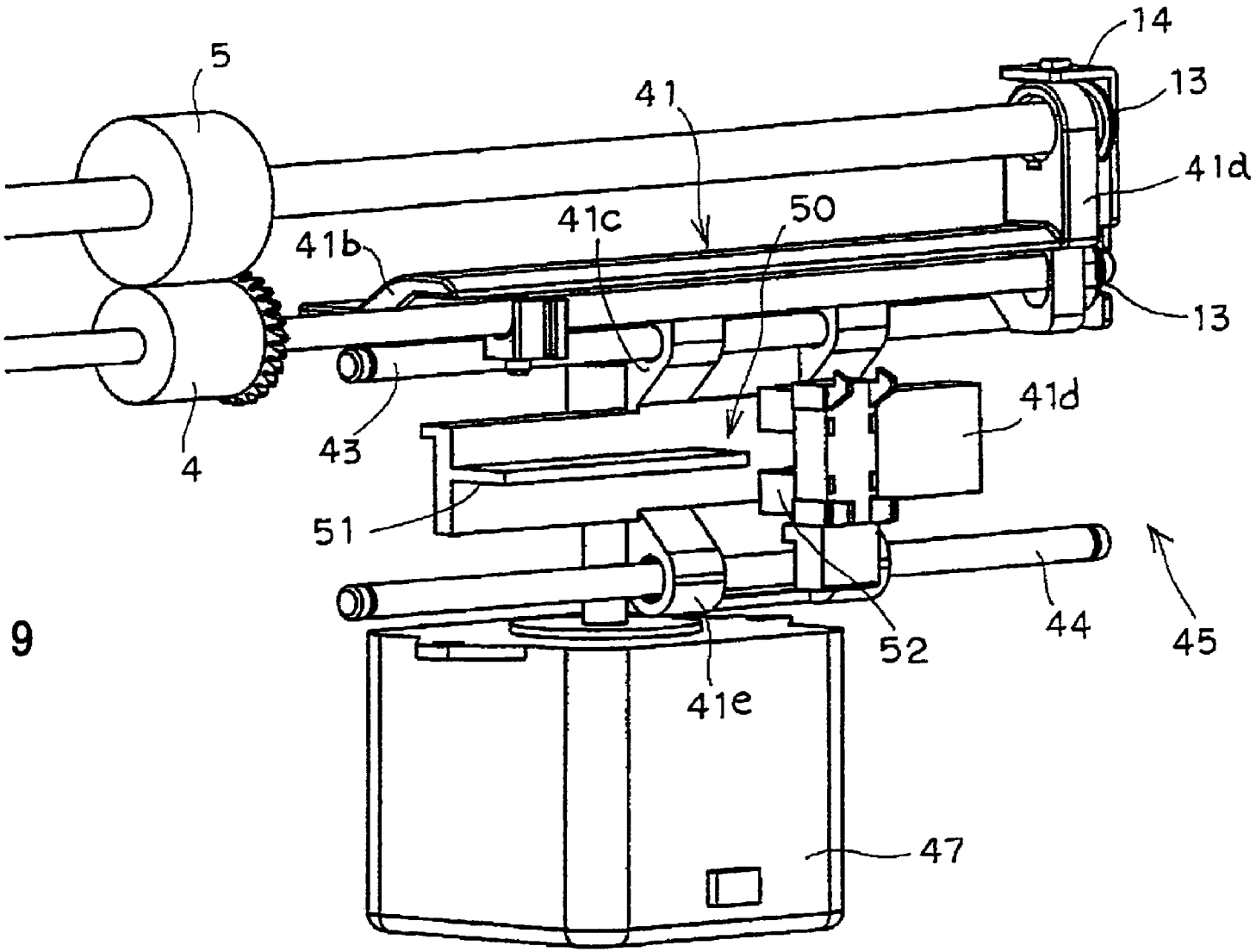
FIG. 9 is a perspective view showing the structure of the HP detection sensor.

Further, to the backside of the torso portion 41*d* on the sliding joint plate 41 is established the position detection protrusion 51 that extends with a plate shape in the horizontal direction, as shown in FIG. 9. This position detection protrusion 51 also functions to prevent warping by the bending of the sliding joint plate 41. Also, as shown in FIG. 8 and FIG. 9, to the front wall 15*b* on the stand frame 15, the interrupter 52 (paired optical elements for emitting and receiving) composing the transmissive type optical sensor that cooperate with the position detection protrusion 51 are mounted via the auxiliary plate 53. Also, the transmissive type optical sensor configured by the position detection protrusion 51 and the interrupter 52 (paired optical elements for emitting and receiving) function as the HP detection sensor 50 that detect the home position (HP) of the sliding joint plate 41, namely the supporting shafts 11 and 12 and turn ON when the position detection protrusion 51 interrupts the light of the interrupter 52 (paired optical elements for emitting and receiving).

In conventional apparatuses, after the paired discharge rollers have nipped the sheet, and have stopped the transport of the sheet, the sheet is discharged after sliding the discharge rollers. However, with this sheet discharge apparatus 1, according to the aforementioned configuration, even while the supporting shafts 11 and 12 are advancing or retracting in the shaft direction, it is possible to transmit drive from the transport motor 34 being sent via the linking gear 33 to the supporting shaft 12. That is to say, that the advancing and retracting in the shaft direction of the tray discharge roller 5 mounted to the supporting shaft 12 and the tray discharge roller 4 mounted supporting shaft 11 and the transport of the sheet by the paired tray discharge rollers 4 and 5 occur simultaneously.

Through this configuration, the alignment process and the sorting process times can be shortened.

The supporting shaft 11 linked to the supporting shaft 12 by the sliding joint plate 41 is configured to advance and retract in the shaft direction by the sliding drive portion 45 (FIG. 9) which is described later, penetrating the first slide regulating member 19 shaft hole and the notched opening portion 38 established in the side frame 1*b* while leaving the discharge paddle 20, the movement thereof in the shaft direction regulated by the first slide regulating member 19, between the first slide regulating member 19 and the second bearing member 18.

According to this structure, the tray discharge roller 4, which is mounted on the supporting shaft 11 advances and retracts in the shaft direction along with the tray discharge roller 5 that is the drive roller mounted to the supporting shaft 12 and simultaneous to the advancing and retracting, the tray discharge roller 4 nips and transports the sheet along with the tray discharge roller 5.

Furthermore, from both sides of the discharge paddle 20, the supporting shaft 11 is formed in a D shape for at least for the distance for the support shaft to advance and retract, the shaft hole in the discharge paddle 20 also formed into a D shape. By arranging this type of structure, it is possible to transmit the rotation of the supporting shaft 11 to the discharge paddle 20 positioned between the first slide regulating member 19 and the second bearing member 18 by the sliding drive portion 45 while the supporting shaft 11 is advancing and retracting in cooperation with the supporting shaft 12. The sheets are discharged while the paired tray discharge rollers 4 and 5 advance and retract in the shaft direction along with the supporting shafts 11 and 12, the discharge paddle 20 acts to discharge sheets to a predetermined position between the first slide regulating member 19 and the second bearing member 18.

E. The Alignment Means (Pulling Means) 60 (FIG. 16 to FIG. 19)

The sheet discharge apparatus 1 comprises the alignment means 60 equipped with the belt unit (rotating bodies) for aligning sheets by securely pulling them to a finishing position on the fixed stacking portion 8. The following shall describe the configuration of the alignment means 60 using FIG. 16 to FIG. 19.

Figure 16:
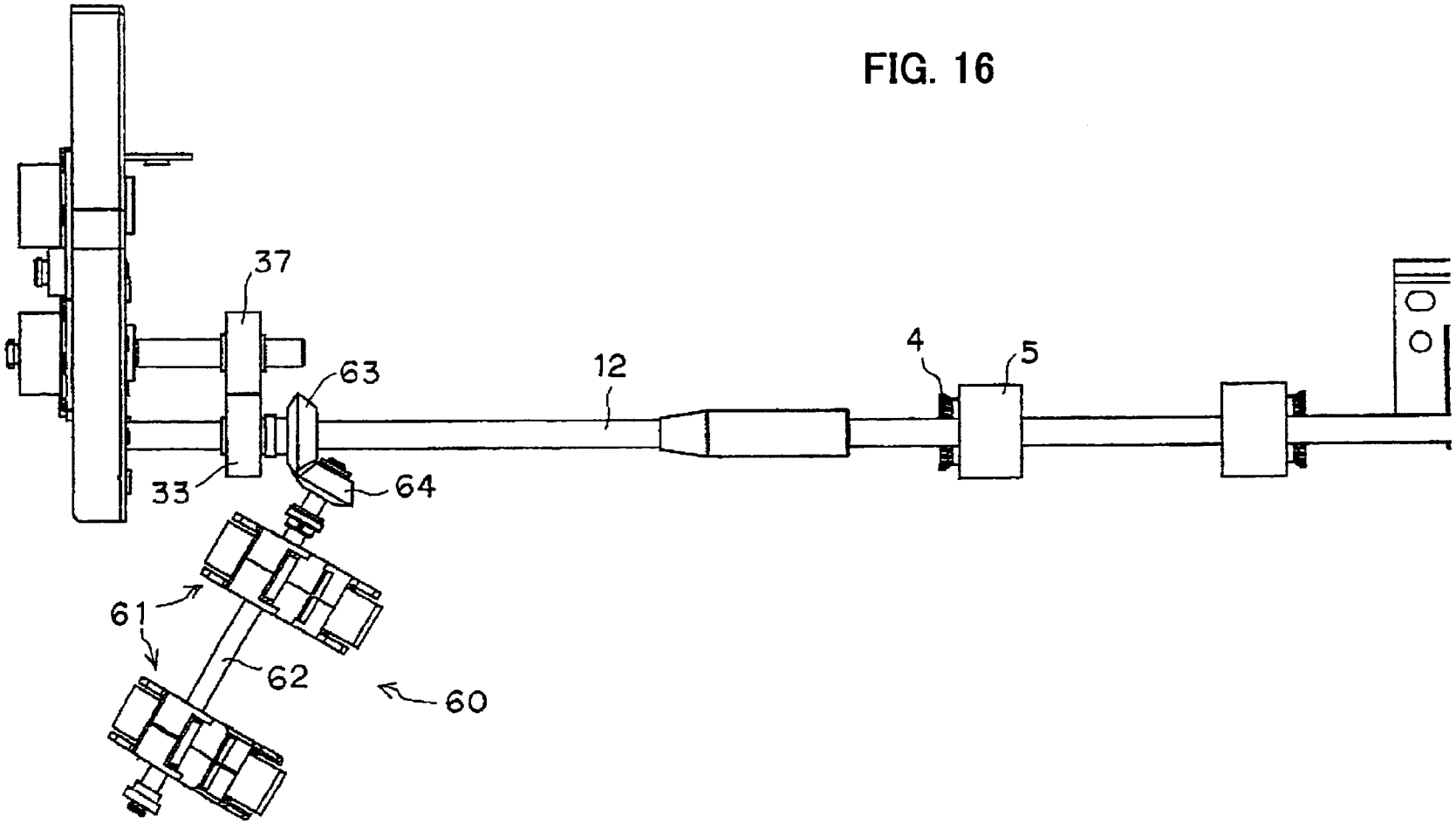
FIG. 16 is a plan view showing a drive force transmission system for rotating a support shaft of a belt unit disposed in the sheet discharge apparatus according to the present invention as the alignment means.
Figure 17:
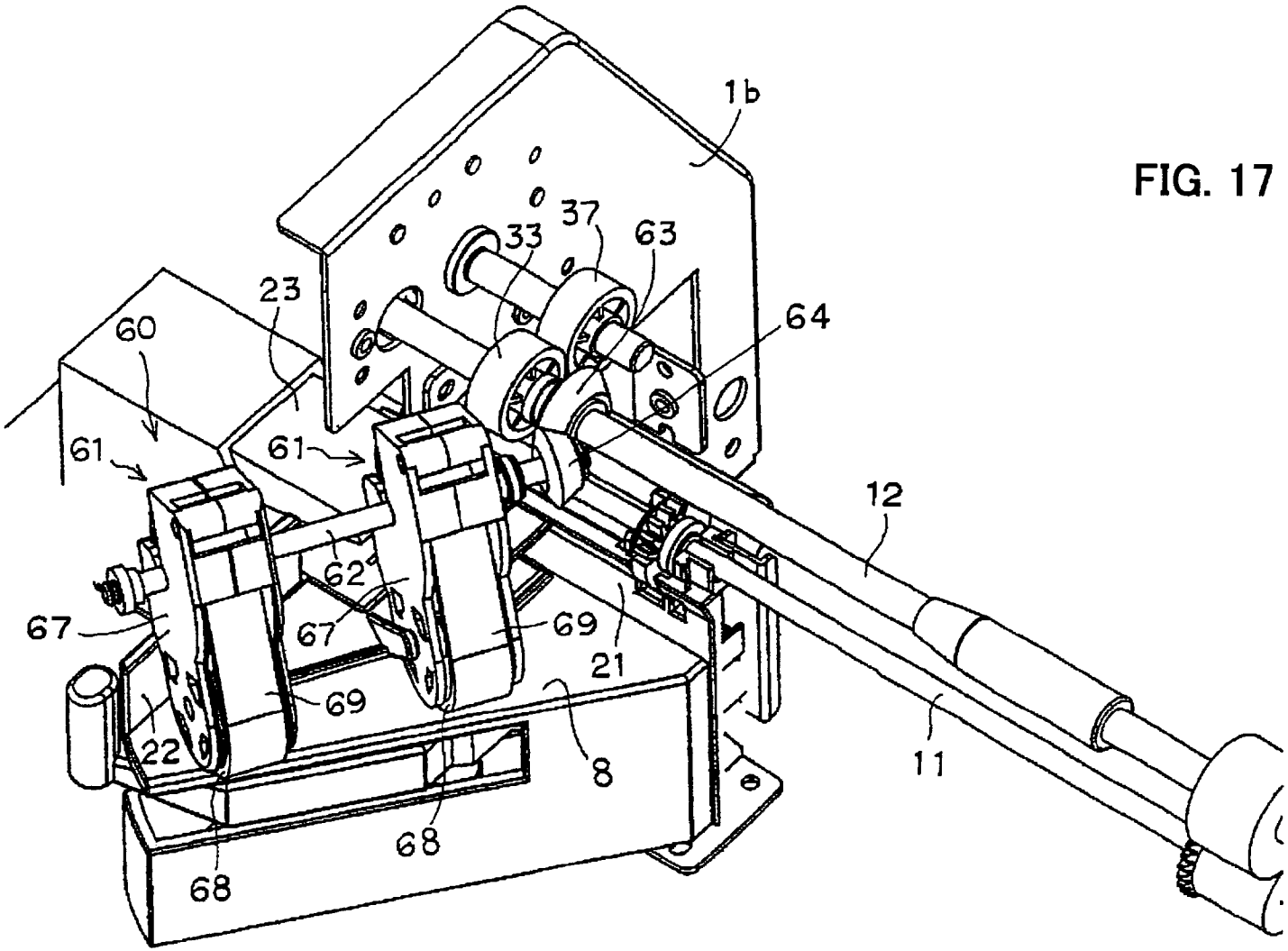
FIG. 17 is a perspective view showing the belt unit portion disposed in the sheet discharge apparatus according to the present invention as the alignment means.

As shown in FIG. 16 and FIG. 17, the alignment means 60 is composed of the belt unit 61 (rotating bodies) that sweeps sheets to pull them to the finishing position. According to this embodiment, two units are mounted in serial to the supporting shaft 62 thereto is applied the rotational drive force from the aforementioned supporting shaft 12 on the upper side. These two belt units 61 and 61 are operated together by the forward rotation of the supporting shaft 62 and are configured to urgingly move sheets that are being discharged to one side toward the pre-alignment position (nipping position) or the width direction alignment reference position by the paired tray discharge rollers 4 and 5, for accurate alignment at a finishing position determined by both the abutting plate 21 (the discharge direction alignment reference position) and the positioning plate 22 (the width direction alignment reference position).

Here, in this specification, the "pre-alignment position" is the nipping position of the belt unit 61 and more accurately, it is the furthermost inner position of the nipping position where sheets can be nipped by the belt unit 61.

As has already been described with FIG. 12, the upper supporting shaft 12 is the drive shaft rotated by the transport motor 34 via the linking gear 33 mated thereto and the force transmission mechanism (35*a* to 35*d* and 37). Furthermore, the movement to the shaft direction of the supporting shaft 12 of the linking gear 33 mated to the supporting shaft 12 is regulated by the leg portion 32*a* on the second slide regulating member 32 and the downward wall 31*b* on the second supporting member 31 (see FIG. 10).

Figure 18:
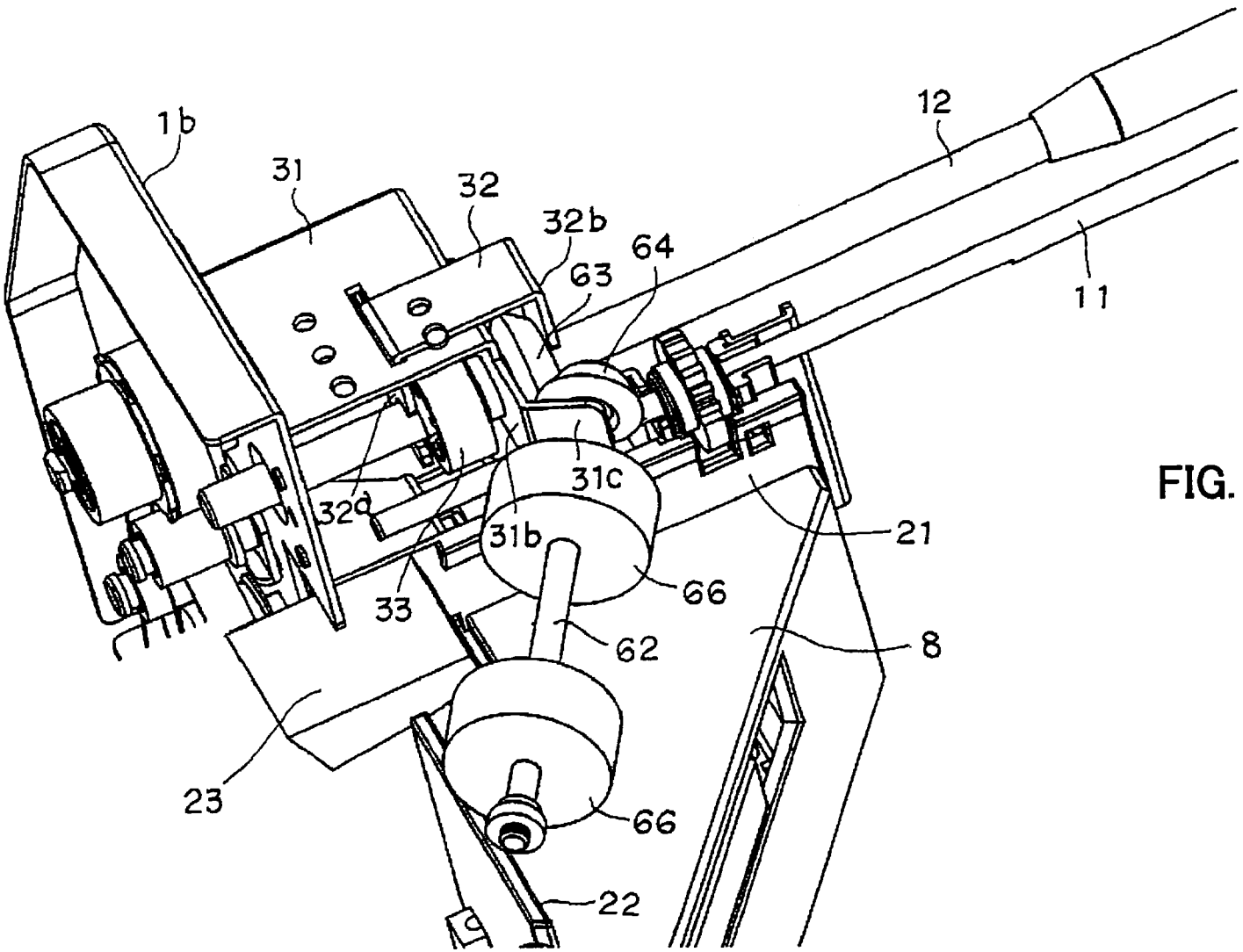
FIG. 18 is a perspective view showing the belt unit in FIG. 17 in a state that follower support pulleys and alignment belts are removed and only drive pulleys are left.
Figure 19:
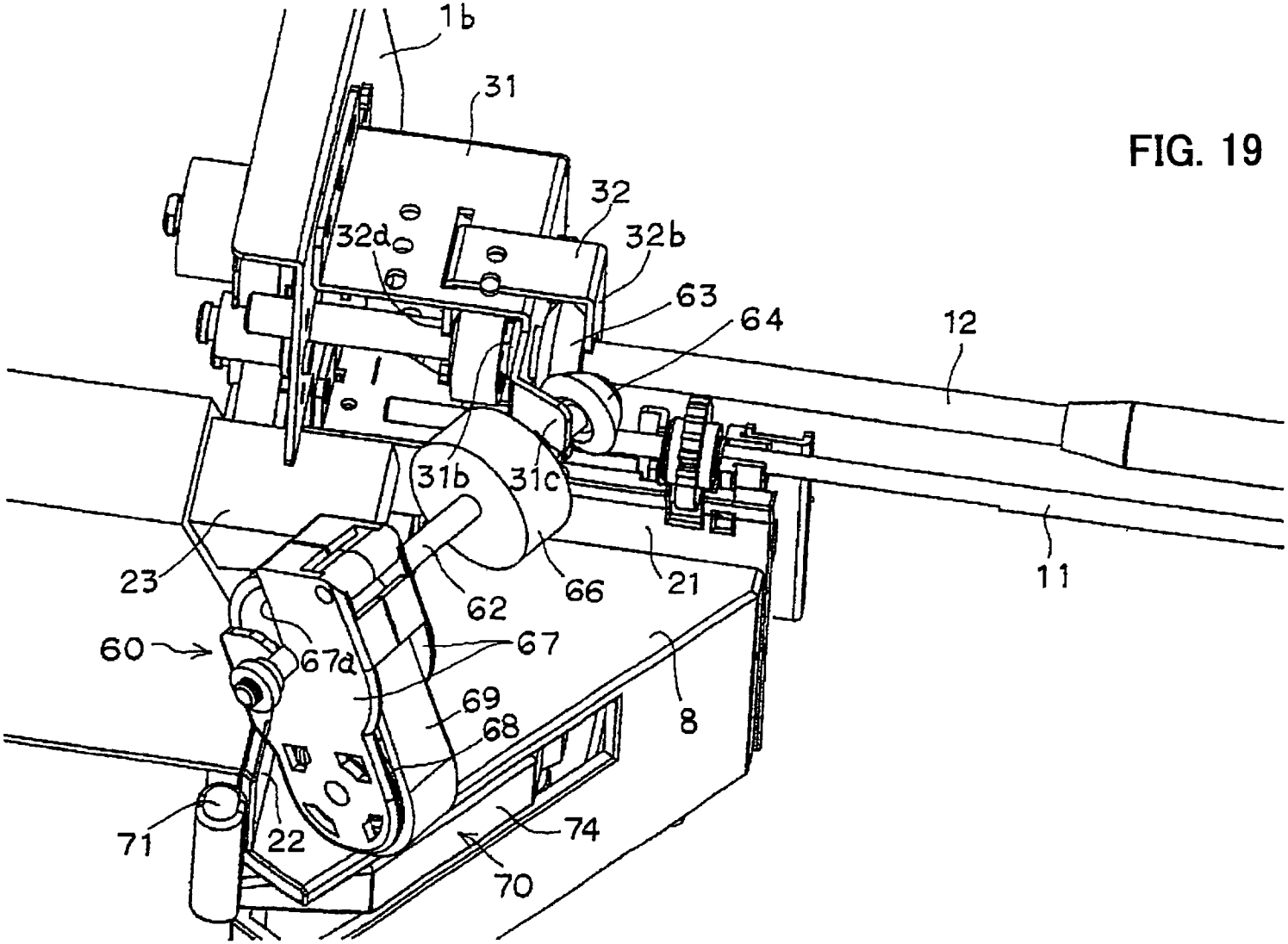
FIG. 19 is a perspective view showing one of a pair of the belt units in FIG. 17 with only the drive pulley.

To attain drive force for the belt units 61 from the supporting shaft 12, in other words, to transmit the rotational drive force from the supporting shaft 12 to the supporting shaft 62, as shown in FIG. 16 and in FIG. 17, to the inside in the shaft direction from the linking gear 33 on the supporting shaft 12 is disposed the first beveled gear 63. The first beveled gear 63, as shown in FIG. 18 and in FIG. 19, is positioned between the downward wall 31*b* on the second supporting member 31 and the leg portion 32*b* on the second slide regulating member 32, the downward wall 31*b* on the second supporting member 31 and the leg portion 32*b* on the second slide regulating member 32 regulating its movement in the supporting shaft 12 shaft direction.

To that regard, the supporting shaft 12 penetrates a plurality of members and is retractably mounted in the shaft direction. In other words, the supporting shaft 12 is retractably disposed in the shaft direction, penetrating the linking gear 33 shaft hole, the shaft holes for the leg portions 32*a* and 32*b* in the second slide regulating member 32 and the shaft hole in the vertical downward wall 31*b* on the second supporting member 31 and the opening portion 39 established in the side frame 1*b*. Furthermore, the supporting shaft 12 can slide in the shaft direction with the linking gear 33 the movement thereof in the shaft direction regulated by the second slide regulating member 32 leg portion 32*a* and the second supporting member 31 vertical downward wall 31*b* therebetween, by the slide drive portion 45, and can slide in the shaft direction with the first beveled gear 63 the movement thereof in the shaft direction regulated by the second supporting member 31 vertical downward wall 31*b* and the second slide regulating member 32 leg portion 32*b*.

Note that from both sides of the linking gear 33 and the first beveled gear 63 the supporting shaft 12 is formed in a D shape for at least for the distance for the support shaft to advance and retract, the interlock gear 33, the discharge paddle 20 and the first beveled gear 63 also formed into a D shape.

On the other hand, to rotatingly support one end of the supporting shaft 62 on the belt units 61, as shown in FIG. 12, the L shaped mounting plate 65 is mounted to the side frame 1*b*, and thereto one end of the supporting shaft 62 is rotatingly supported while the support arm portion 31*c* is established extending from the vertical downward wall 31*b* on the second supporting member 31 to above the fixed stacking portion 8 (the first tray), thereto the other end of the supporting shaft 62 is rotatingly supported.

To the end of the support arm portion 31*c* on the supporting shaft 62, the second beveled gear 64 is mounted. The movement to the shaft direction of the second beveled gear 64 is regulated at a predetermined position in the shaft direction of the supporting shaft 12 and mates with the first beveled gear 63 that is established. This structure receives the drive from the transport motor 34 to rotate the supporting shaft 62.

One of the two belt units 61 and 61 which are the rotating bodies that compose the alignment means is disposed in a position near the discharge outlet of the supporting shaft 62, the other is disposed at the supporting shaft 62, in a position far from the discharge outlet 7. Both of the belt units 61 and 61 have the same configuration, so an explanation of one will be duly representative.

The belt units 61 which are the rotating bodies are composed of the drive pulley 66 (FIG. 18) mounted to the supporting shaft 62 and rotates along with the supporting shaft 62, the support plate 67 (FIG. 17) the arranged on both side, the trailing end mounted to the supporting shaft 62, the follower supporting pulley 68 (FIG. 19) positioned at the fixed stacking portion 8 side with a determined gap with the drive pulley 66 by being rotatingly supported on the leading end of the support plate 67 and the alignment belt 69 (FIG. 19) trained between the drive pulley 66 and the follower support pulley 68.

The support plate 67, as shown in FIG. 19, comprises the notch 67*a* for mating the trailing end thereof to the supporting shaft 62, the back portion of the notch portion 67*a* detachably mounted to the supporting shaft 62 with a constant gripping force. Therefore, the support plate 67 revolves as a unit with the supporting shaft 62 with the constant frictional force, and is configured to slidingly rotate around the supporting shaft 62 when an external force enough to overcome that constant frictional force is applied.

The supporting shaft 12 receives the drive of the transport motor 34 (FIG. 12) and when the tray discharge roller 5 rotates in the direction to discharge the sheet S, the supporting shaft 62 is rotatingly driven from the supporting shaft 12, to rotate the alignment belt 69 on the belt units 61 to sweep the sheet. The direction of rotation is where the alignment belt 69 intersects the positioning plate 22 and the abutting plate 21, in other words, the rotation in the direction to transport the sheet toward the stapler 23, which is the finishing position. To express this differently, the belt units 61 are arranged in the direction to transport the sheet S toward the stapler 23, which is the finishing position. The support arm portion 31*c* and the support plate 67 position the supporting shaft 62 so that the belt units 61 and 61 urge sheets discharged by the paired tray discharge rollers 4 and 5 to the abutting plate 21 and the positioning plate 22 on the fixed stacking portion 8, for alignment.

The length from the supporting shaft 62 on the belt unit 61 is determined so that it is longer than the distance from the supporting shaft 62 to the top surface of the fixed stacking portion 8 (the first tray). Therefore, when the belt units 61 are revolving operated unitized with the supporting shaft 62 by frictional force, the leading end of the belt units 61 touch the upper surface of the fixed stacking portion 8 (the first tray) from above at an angle and are unable to revolve in any other way. The support plate 67 on the belt units 61 overcome the frictional force and slip with regard to supporting shaft 62 thereby maintaining the idling position (the activating position where the alignment belt 69 touches the sheet discharged to the storage means) shown in FIG. 19. In other words, by applying only enough external force to overcome the constant frictional force between the support plate 67 and the support shaft 62, the belt unit 61 revolves round the support shaft 62 to enable it to switch to the position (retracted position) which is separated from the sheet discharged to the storage means.

The aforementioned support shaft 62 and support plate 67 function as the support means to movingly support the belt unit 61 which is the rotating bodies, between the activating position that touches the sheet discharged to the trays 8 and 9 which are the storage means, and the retracted position to separate from the sheet.

In the belt units 61 at the idling position (activating position) described above, the position where the alignment belt 69 touches the sheet is the pre-alignment position (nipping position), described above. As described with FIG. 13 and FIG. 14, when in the operating mode comprising pre-alignment, the sheet is pulley aligned to the pre-alignment position the distance of D1 or d1 (the distance of D4 or d4), and moved to the finishing position the distance of D2 or d2 (D5 or d5) by the belt units 61 to touch the sheet to the abutting plate 21 and the position plate 22 to be aligned. Or, the sheet is moved directly to the finishing position the distance of D3 or d3 (D6 or d6) passing through the pre-alignment position, to touch the abutting plate 21 and the position plate 22 to be aligned.

Figure 40:
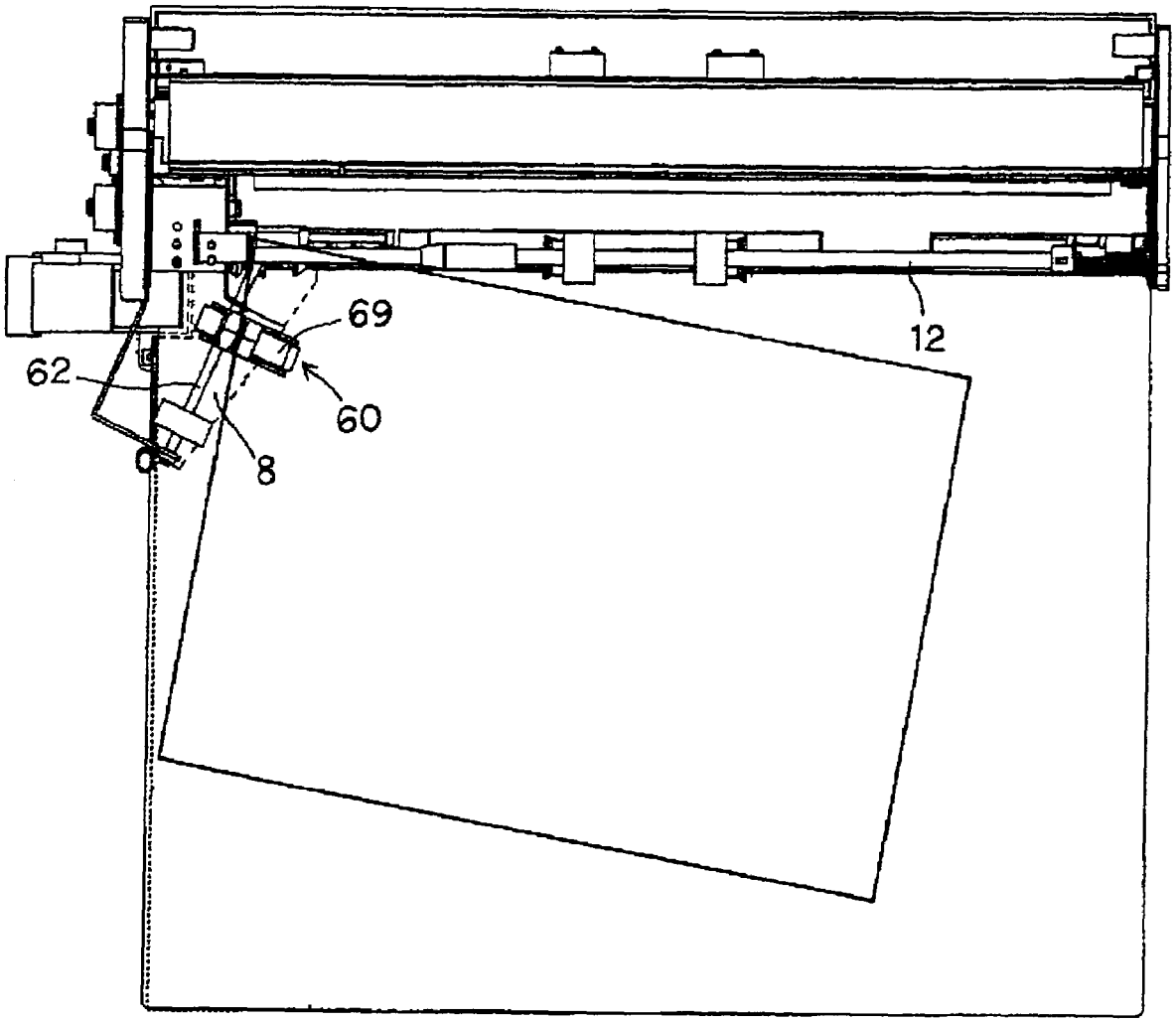
FIG. 40 is a view showing a problem when the sheet is discharged.

However, the alignment means (pulling means) 60 operates constantly hanging downward at an angle toward the sheet from the supporting shaft 62 while the supporting shaft 12 is rotating in forward so it acts as a load that applies a resistance force to the discharging sheets. For that reason, as shown in FIG. 40, the effect of reverse transport (sweeping in) by the alignment belts 69 push the sheet back, causing the sheet to be arranged obliquely, if the edges of the sheet are not completely discharged toward the fixed stacking portion 8. When a sheet is discharged in this state, the leading edge of subsequent sheets strike the trailing edge of a prior sheet and cause paper jams, or prior sheets get pushed while angled along with the subsequent making it impossible for the aligning means 60 to fully align the sheets when stacked (sheets become stacked in misalignment). To eliminate this problem, to the supporting shaft 11 is established the discharge paddle 20. The paddle 20 is disposed between the first slide regulating portion 19 and the second bearing member 18 mounted on the support member 16 at an upstream position opposing the fixed stacking portion 8 and aligning means 60 on the supporting shaft 11. Also, the discharge paddle 20 comprises the bearing opening that fits the angled portion 11*a* of the sectional D shape on the supporting shaft 11, the supporting shaft 11 slidingly mating through this bearing opening. Through this, even if the supporting shaft 11 slidingly moves by the pre-alignment movement means 40, the discharge paddle 20 does not move from the predetermined position corresponding to the aligning means 60, and can rotate by receiving the drive from the supporting shaft. While the discharge paddle 20 rotates, it touches the sheet portion corresponding to the fixed stacking portion 8 and the aligning means 60. By kicking the trailing edge of the sheet, an additional discharging force (force to forcibly push the sheet) is applied to the sheet portion to completely discharge the trailing edge of the sheet discharge direction to the fixed stacking portion 8. Furthermore, in this embodiment of the present invention, the trailing edge of the sheets are completely discharged to the fixed stacking portion 8 by the discharge paddle 20 but it is also perfectly acceptable to use belts, rollers or other rotating bodies as the forcible discharge means.

Also, in this embodiment of the invention, only the discharge paddle is arranged above the supporting shaft 11, but it is perfectly acceptable to arranged it on at least one of the supporting shafts 11 and 12 or on both of them.

Still further, in this embodiment, the reference side section on the supporting shaft 11 and the shaft bearing hole for the discharge paddle 20 have a D shape but, the reference side section on the supporting shaft 11 and the shaft bearing hole for the discharge paddle 20 are not limited to that and can have a non-circular shape that tolerates the relative sliding of the bearing hole and the supporting shaft 11 to transmit the drive of the supporting shaft 11 to the discharge paddle 20.

F. Sheet Bundle Discharge Means 70 (FIG. 21 to FIG. 23)

As described above, the sheets pass through the pre-alignment (pre-alignment movement means 40) and this alignment (belt units 61) and are aligned sequentially at the finishing position and are stacked. When that is a sheet bundle having a determined number of sheets, the stapling operation is performed on a single corner by the stapler 23 which is the finishing means. The sheet bundle 90, as shown in FIG. 20, is stacked from the fixed stacking portion 8 (the first tray) to the storage tray 9 (the second tray) therebelow. Because there is a space for stacking and storing sheets between the fixed stacking portion 8 (the first tray) and the storage tray 9 (the second tray) therebelow, in other words, because there is a level, the sheet bundle 90 has the bending portion 90*a* configured by the level bent along that level.

Figure 22:
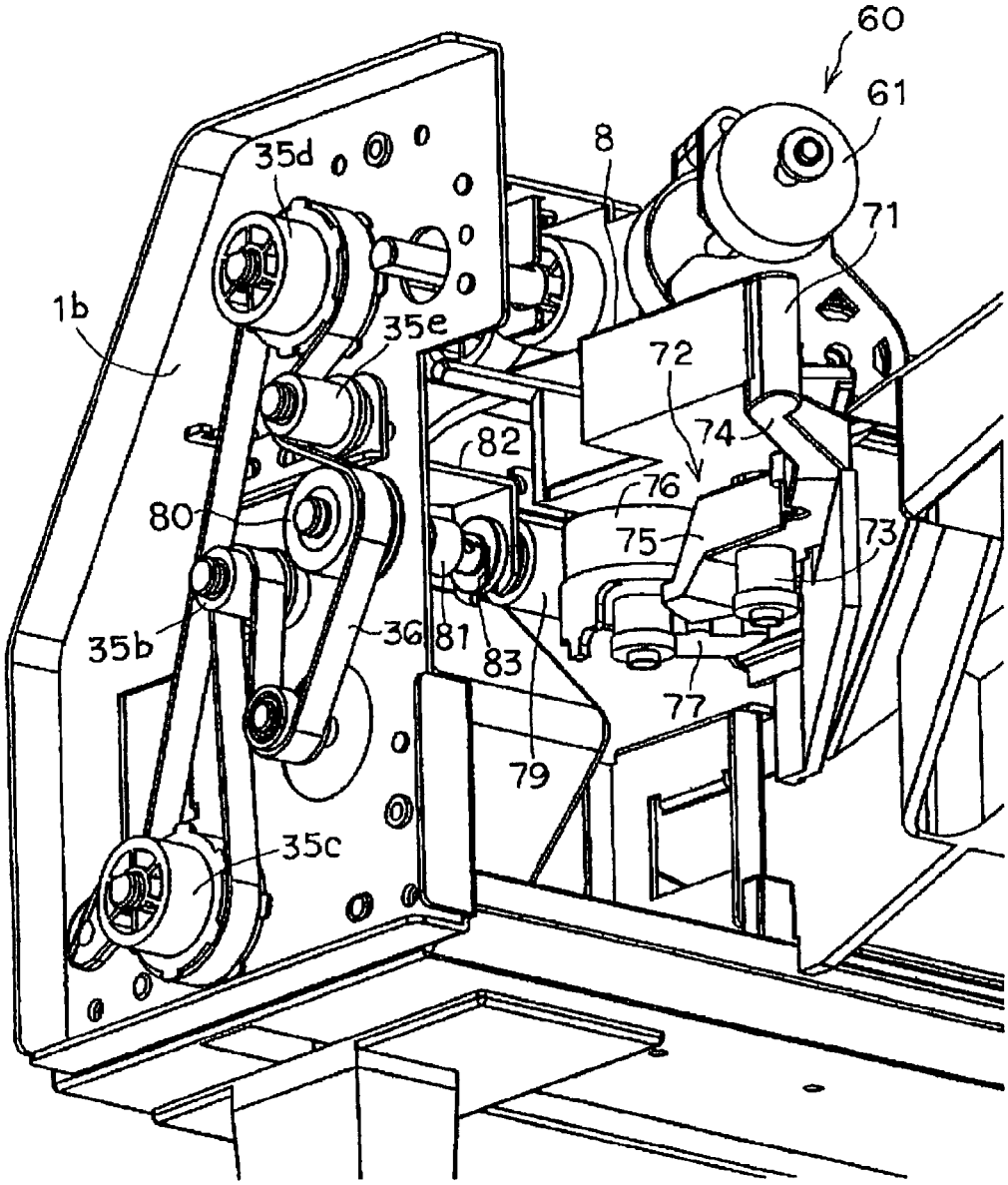
FIG. 22 is a perspective view seen from above showing the sheet bundle discharge means (sheet moving means) in the sheet discharge apparatus according to the present invention.
Figure 23:
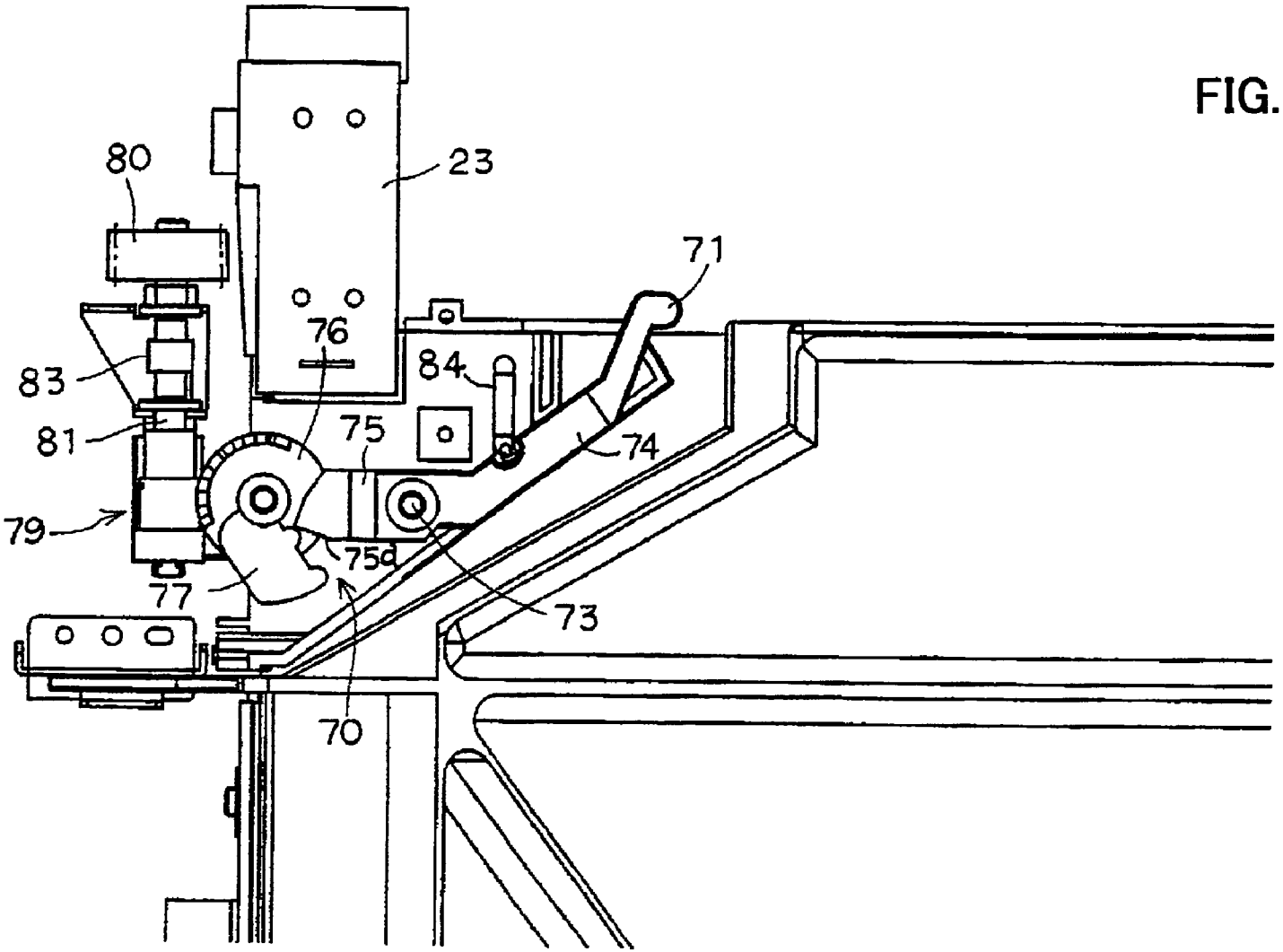
FIG. 23 is a rear view seen from below showing the sheet bundle discharge means (sheet moving means) structure in the sheet discharge apparatus according to the present invention.

The sheet bundle discharge means 70 shown in FIG. 21 to FIG. 23 pushes the sheet bundle 90 in this state in the direction traversing the sheet transport direction, from the side and is the means for discharging it to a region outside of the fixed stacking portion 8 (the first tray). The sheet bundle discharge means 70, in this embodiment, is composed of the pushing member 71 that pushes the curved portion 90*a* of the sheet bundle 90 in a direction traversing the direction of transport to move the sheet bundle from the fixed stacking portion 8 (the first tray) to the storage tray 9 (the second tray) therebelow, and the revolution drive mechanism 72 (drive means) that revolves that member.

Arranged to configure the revolution drive mechanism 72 is the rotating lever 74 that rotates around the rotating center 73 in the gap between the fixed stacking portion 8 (the first tray) and the storage tray 9 (the second tray) therebelow, as shown in FIG. 21. To the leading edge of the rotating lever 74 is disposed the aforementioned pushing member 71, extending up and down forming a pushing bar. This rotating lever 74 is equipped with the contact arm 75 formed with the contact portion 75*a* on the leading end thereof (FIG. 23), extending obliquely downward in the opposite side from the rotating center shaft 73.

To rotatingly drive the aforementioned rotating lever 74, to the circumference of the shaft 78 is rotatingly mounted near the contact portion 75*a*, the worm-wheel 76 having a cam equipped with the cam 77 to act on the contact portion 75*a*. When the cammed worm-wheel 76 reciprocally rotates around the shaft 78, which is described below, the cam 77 touches the aforementioned contact portion 75*a* and revolves it a determined amount. Also, the worm gear 79 that mates with the cammed worm wheel 76 is established on the side opposite to the side where the aforementioned rotating lever 76 exists. This worm gear 79 is established on the shaft 81 which is established on the single direction clutched pulley 80, the single direction clutched pulley 80 mounted to form the gear train composing the rotating drive mechanism for the aforementioned supporting shaft 11 and supporting shaft 12.

Specifically, as shown in FIG. 22, the shaft 81 on the single direction clutched pulley 80 is rotatingly mounted to the side frame 1*b* and the support plate 82 and the relay pulley 35*e* is rotatingly mounted to the side frame 1*b*. Then, the output from the transport motor 34 is transmitted from the motor pulley 35*a* mounted on that output shaft via the timing belt 36 to the relay pulley 35*b*, the transport roller pulley 35*c* and the follower pulley 35*d*, and the force transmission mechanism is configured to transmit to the unidirectional clutched pulley 80 via the relay pulley 35*e*. To the shaft 81 that is the output side of the single direction clutched pulley 80 the aforementioned worm gear 79 is mated and through the action of the single direction clutch, the single direction clutch shuts off when the transport motor 34 is rotated in forward causing the single direction clutched pulley 80 to idle. The other way, when the transport motor 34 is rotated in reverse, the single direction clutch turns on transmitting rotational drive force to the shaft 81 to rotate the worm gear 79.

Figure 24A:
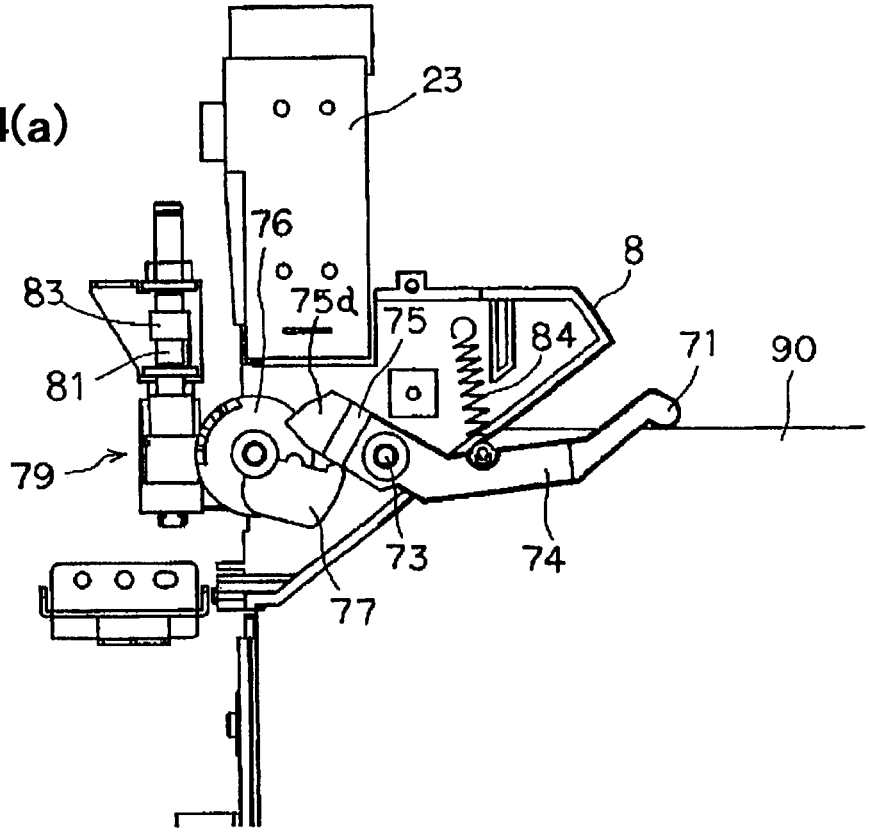
FIGS. 24(*a*) and 24(*b*) are rear side views showing an operation of the sheet bundle discharge means (sheet moving means) in the sheet discharge apparatus according to the present invention, wherein FIG. 24(*a*) shows the middle of the discharge operation and FIG. 24(*b*) shows a state immediately after the discharge is completed.
Figure 24B:
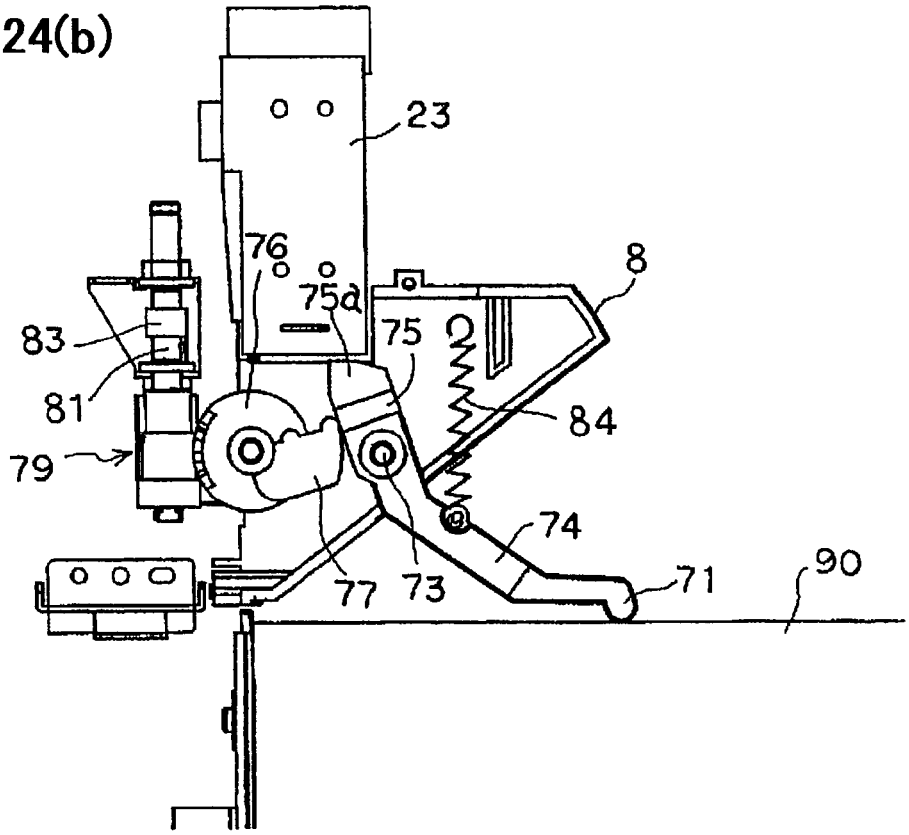

When the worm gear 79 rotates, the cammed worm wheel 76 mated thereto rotates. The cam 77 in the state shown in FIG. 23, unitized thereto the worm wheel, touches and presses the contact portion 75*a* on the contact arm 75 to rotate the rotating lever 74 around the rotating center shaft 73 as depicted in FIGS. 24(*a*) and 24(*b*). This revolves the pushing member 71 around the rotating center shaft 73 as depicted in FIGS. 24(*a*) and 24(*b*) to push the sheet bundle 90 to outside of the region of the fixed stacking portion 8 (the first tray).

Figure 25C:
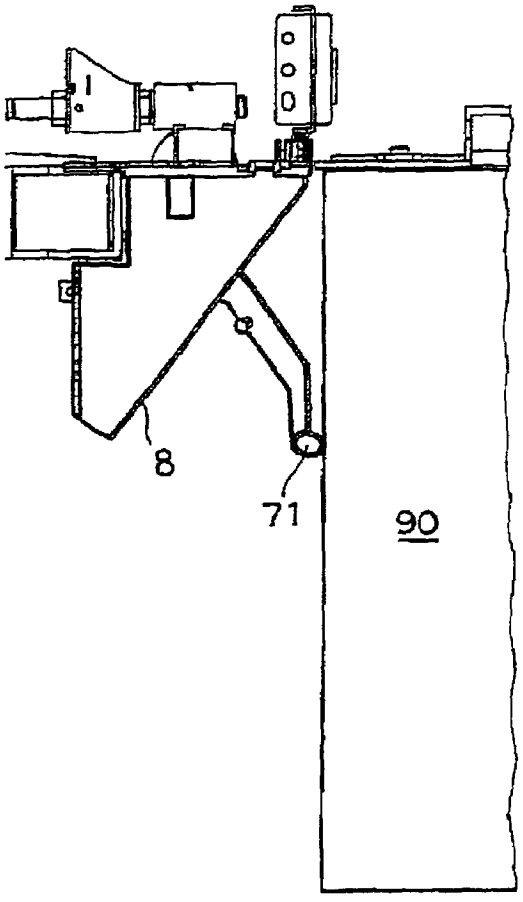
FIGS. 25(*a*), 25(*b*) and 25(*c*) are partial plan views showing the operation of the sheet bundle discharge means (sheet moving means) in the sheet discharge apparatus according to the present invention, wherein FIG. 25(*a*) shows prior to the discharge operation, FIG. 25(*b*) shows the middle of the discharge operation, and FIG. 25(*c*) shows a state immediately after the discharge is completed.
Figure 25B:
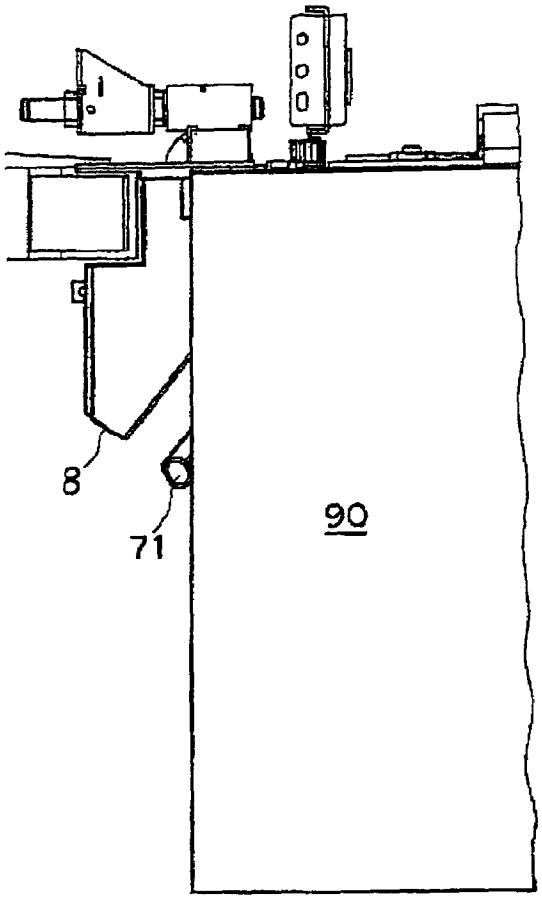
Figure 25A:
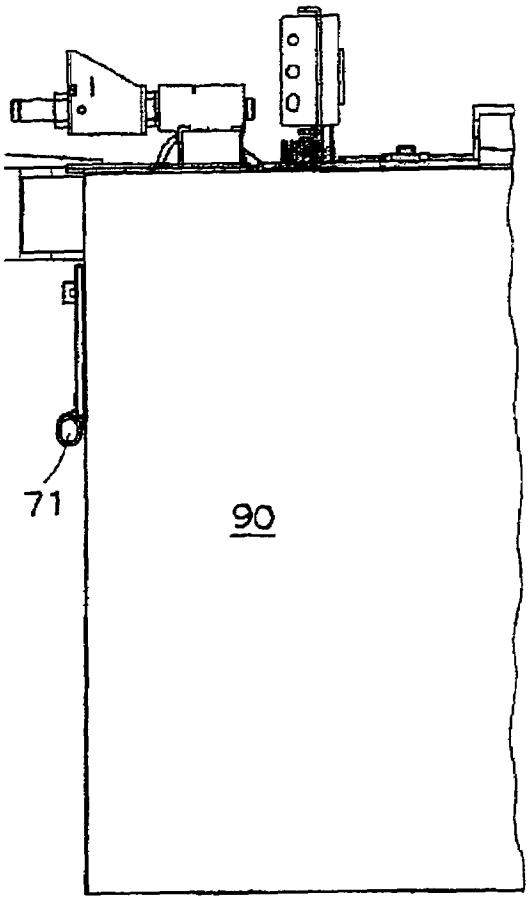

In this way, the sheet bundle 90, as shown in FIG. 25(*a*) to FIG. 25(*c*), is discharged from the fixed stacking portion 8 (the first tray) to the top of the storage tray 9 (the second tray).

When the sheet bundle 90 reaches the position shown in FIG. 24(*b*) pushed out of the region of the fixed stacking portion 8 (the first tray), the direction of rotation of the transport motor 34 switches from reverse rotation to forward rotation, the shaft 81 becomes free and the recovery spring 83 mounted to the shaft 81 returns the cammed worm wheel 76 to the state depicted in FIG. 23. The rotating lever 74 also returns to the state depicted in FIG. 23 by the action of the recovery spring 84.

The mechanism (revolving drive mechanism 72) to revolving drive the pushing bar 72 is configured by the aforementioned elements 74 to 84.

G. Control Means (FIG. 26)

The following shall describe the control apparatus (FIG. 26) that is the control means.

Figure 26:
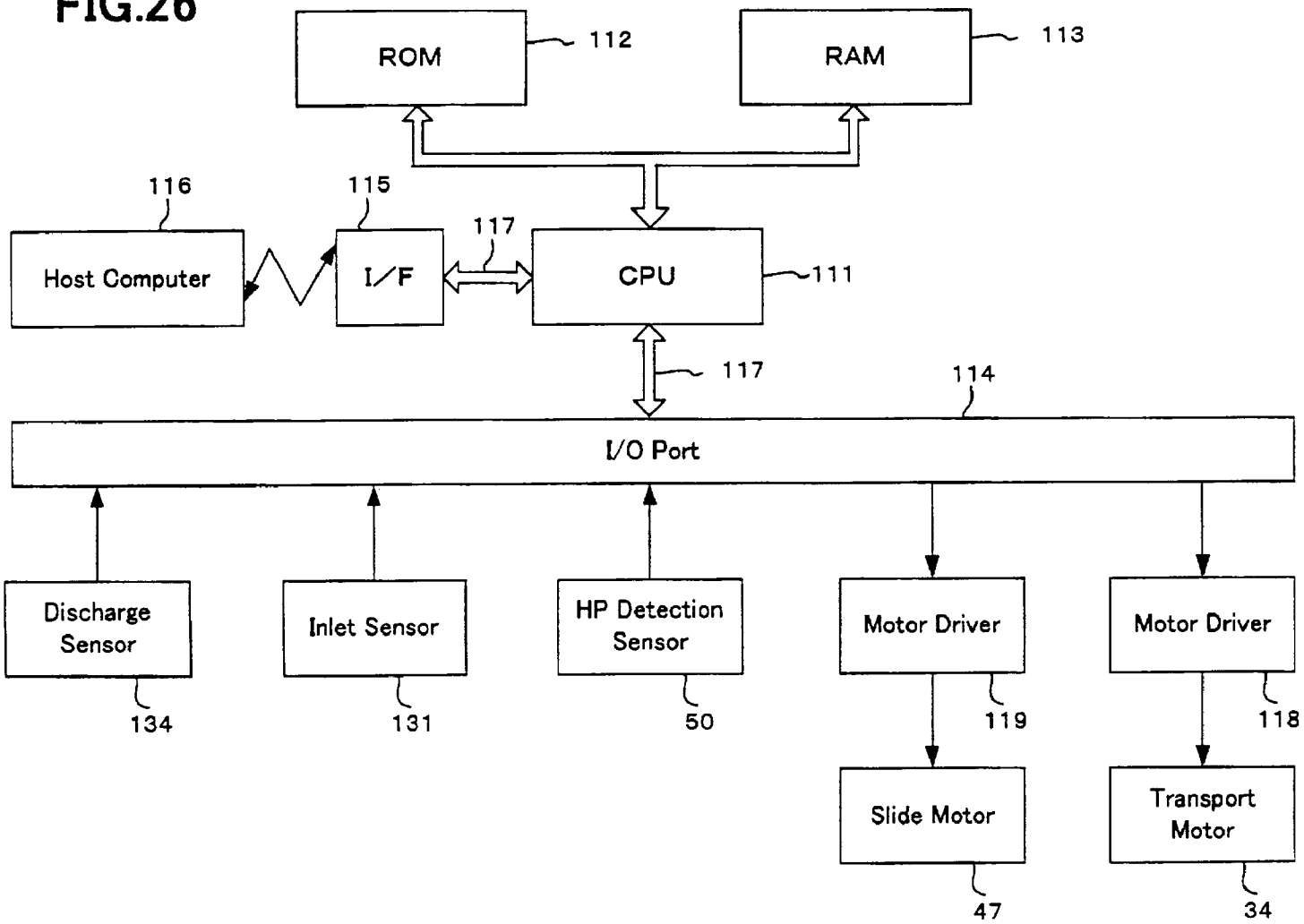
FIG. 26 is a drawing showing a configuration of the control apparatus in the sheet discharge apparatus according to the present invention.

FIG. 26 is a block diagram showing the circuit configuration of the control apparatus on the sheet discharge apparatus according to this embodiment. 111 is the microcomputer CPU (central processing unit) composing this control unit, 112 is the ROM (read only memory) storing the program data that the CPU 111 uses to control each part, 113 is the RAM (random access memory) disposed with memory for the CPU 111 to use to process data, 114 I/O port, and 115 is the interface (I/F) for the host computer 116 on the image forming apparatus main unit 100 to connect externally using a communications line.

The aforementioned CPU 111, ROM 112, RAM 113, I/O port 114 and interface 115 are electrically connected via a bus line 117. To the aforementioned I/O port 114 are connected the HP detection sensor 50 that detects the home position of the supporting shafts 11 and 12 on the paired tray discharge rollers 4 and 5, the inlet sensor 131 (FIG. 2) established at the paper path 2 inlet that is the transport path and the discharge sensor 134 established on the discharge outlet 7 on the paper path 2. The discharge sensor 134 is a supplementary disposed sensor and can be omitted.

The inlet sensor 131 and the discharge sensor 134 are composed of the light source arranged sandwiching the sheet transport path and the transmissive type light sensor composed from the light receptor elements, turning ON when the sheet passes therethrough and interrupts the light. In other words, the sheet S passes through the paper path 2 between the upper guide 2*a* and the lower guide 2*b* in the processing apparatus 1 and is discharged, the detection sensors composed of the light source arranged to sandwich the paper path 2 and the light receptor elements determine whether or not the sheet S has passed therethrough, for each sheet, to perform detection for passing sheets and for retained sheets. Also, it is detected whether or not the sheet S has been discharged or not by the detection sensor composed of the light source arranged sandwiching the sheet discharge outlet 7 downstream of the paired tray discharge rollers 4 and 5 and the light receptor elements.

Still further, to the I/O port 114, are connected the motor driver 118 on the transport motor 34 that rotatingly drives the supporting shafts 11 and 12 on the paired tray discharge rollers 4 and 5 according to the data from the host computer 116, and the motor driver 119 on the slide motor 47 that moves the supporting shafts 11 and 12 on the paired tray discharge rollers 4 and 5 in the shaft direction according to the data from the host computer 116.

The aforementioned transport motor 34 and slide motor 47 are configured, for example, by stepping motors. The CPU 111 controls drive by supplying the determined pulse motor control signals to the motors 34 and 47.

The output from the inlet sensor 131, the discharge sensor 134 and the HP detection sensor 50 are applied to the finisher apparatus' micro-computer CPU 111. Also, information from operating means composed of the start key, the sorting sheet count setting keys, the total recording count setting keys and the tenkeys from the image forming apparatus main unit 100 are input to the finisher apparatus micro-computer CPU 111.

Figure 27A:
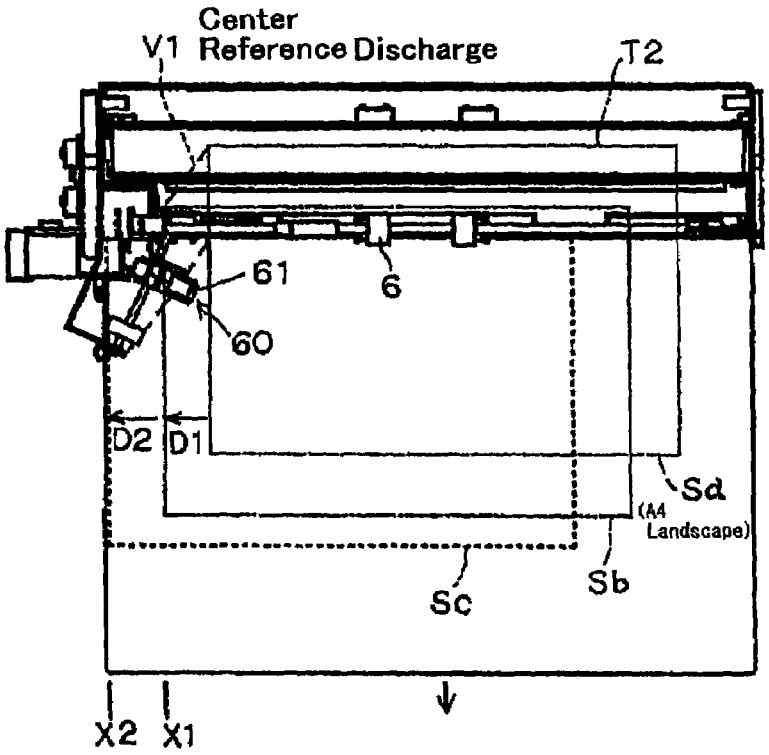
FIGS. 27(*a*) and 27(*b*) are views showing a state that the sheet is discharged while moving horizontally toward the rotating bodies for alignment under start timing control in the present invention.
Figure 27B:
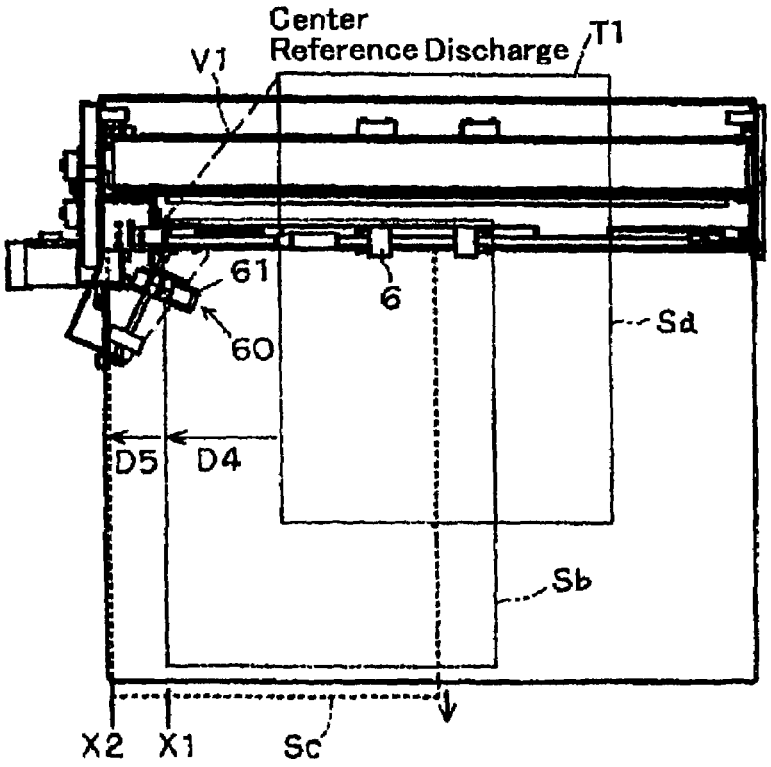
Figure 29A:
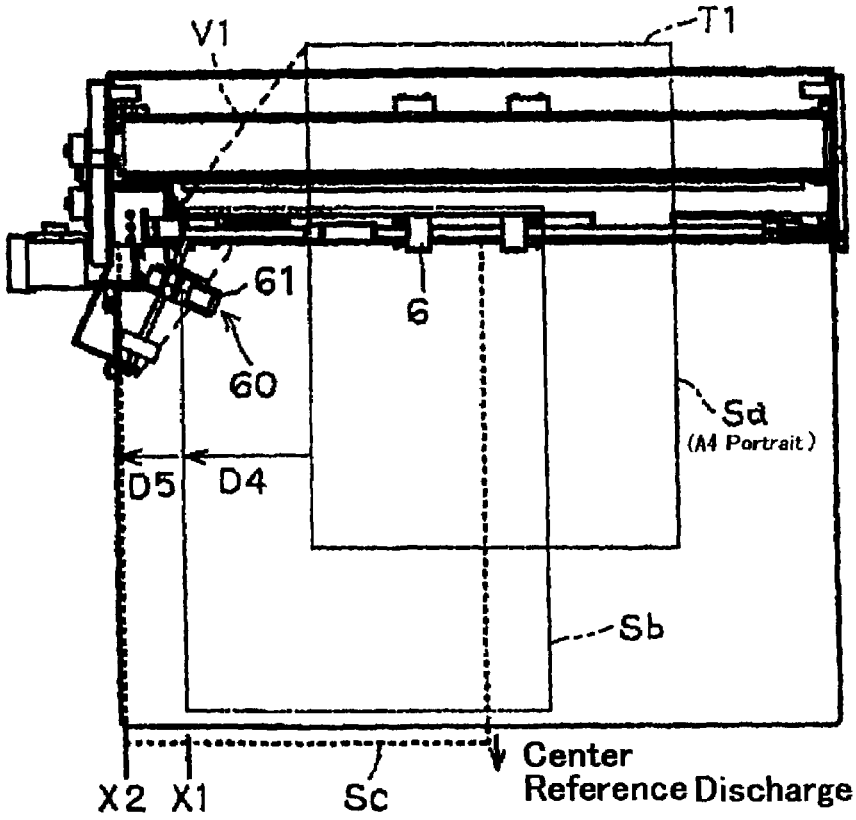
FIGS. 29(*a*) and 29(*b*) are views showing a state that the sheet with the same size is discharged while moving horizontally toward the rotating bodies for alignment under start timing control in the present invention.
Figure 29B:
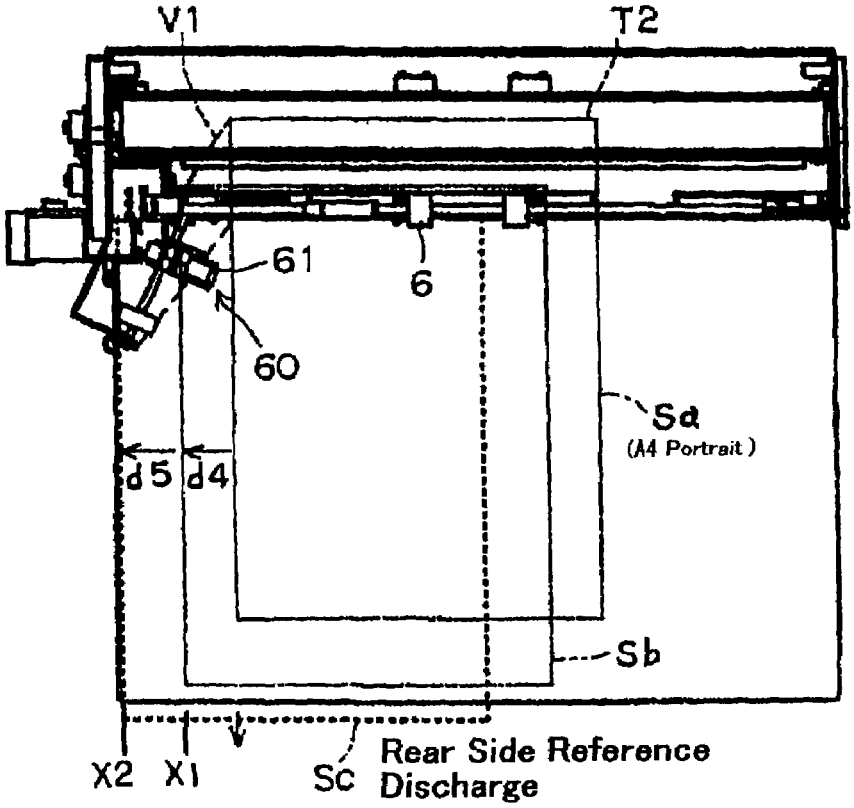
Figure 33A:
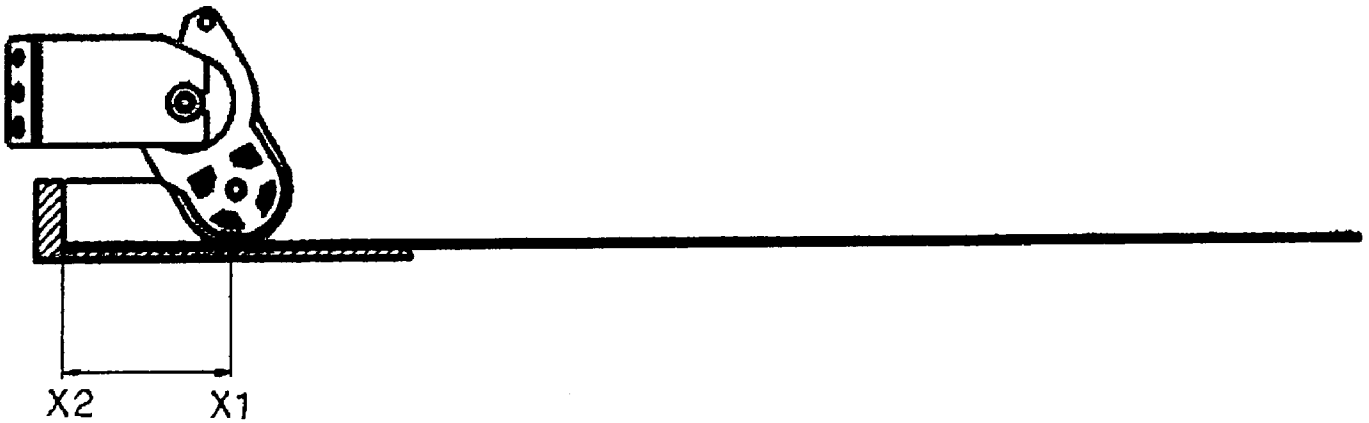
FIGS. 33(*a*) and 33(*b*) are views showing the belt unit as the rotating bodies in the present embodiment of the invention, wherein FIG. 33(*a*) shows the belt unit when there is a small number of the sheets, and FIG. 33(*b*) shows the belt unit when there is a large number of the sheets.
Figure 33B:
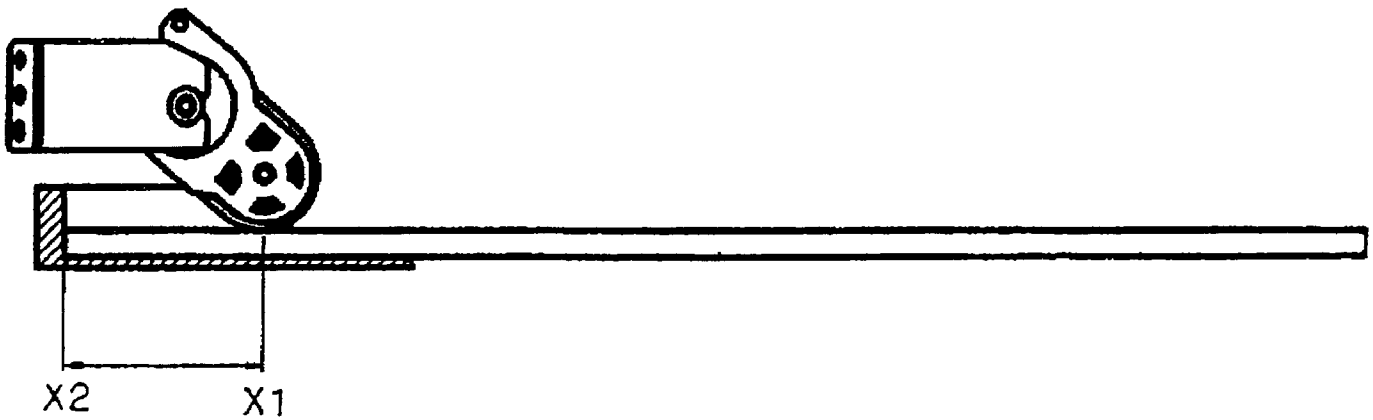
Figure 34:
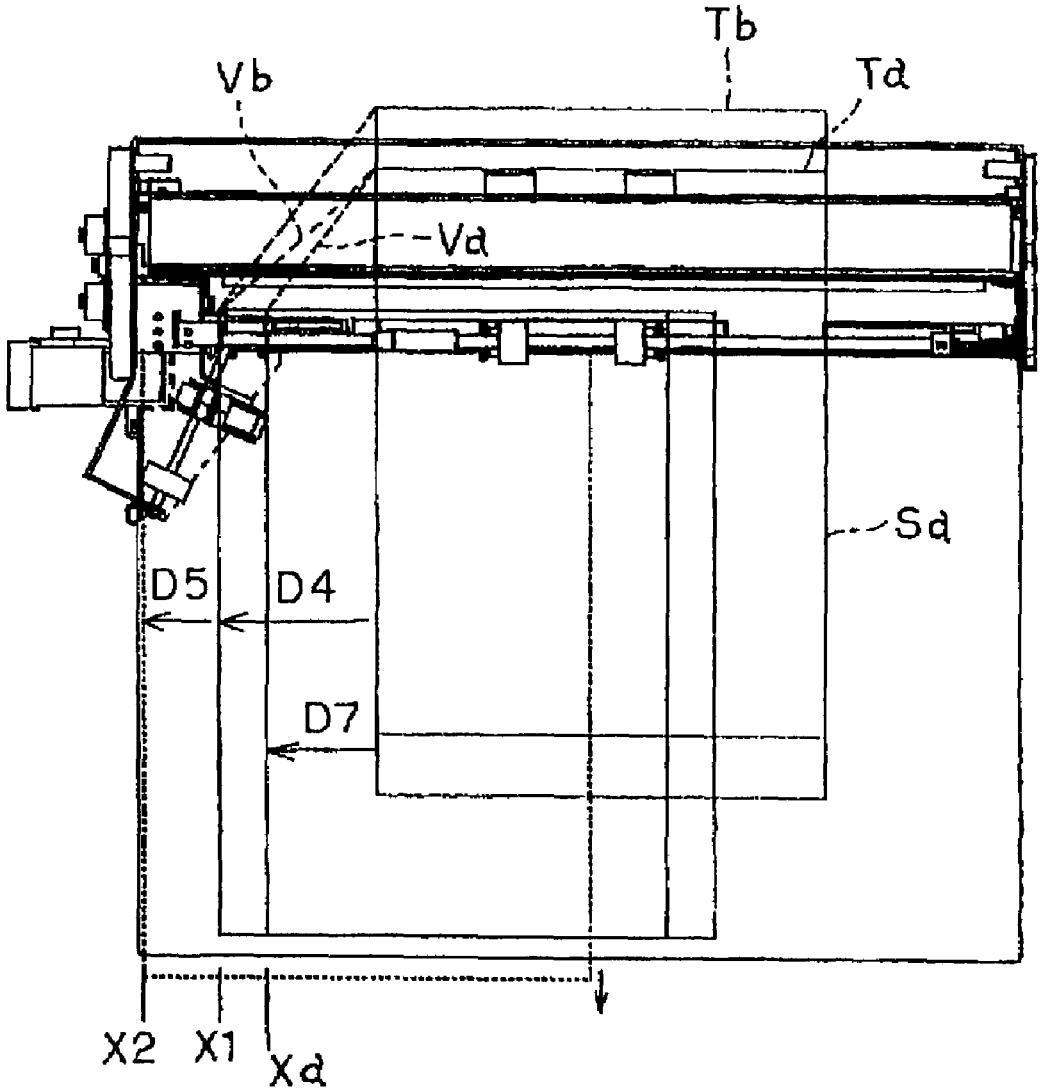
FIG. 34 is a view showing an operational position of the belt unit when there are a small number of the sheets and a large number of the sheets according to the present invention.

Example of Control (FIGS. 27(*a*) and 27(*b*) to FIGS. 29(*a*) and 29(*b*), and FIGS. 33(*a*) and 33(*b*) to FIG. 34)

Figure 38:
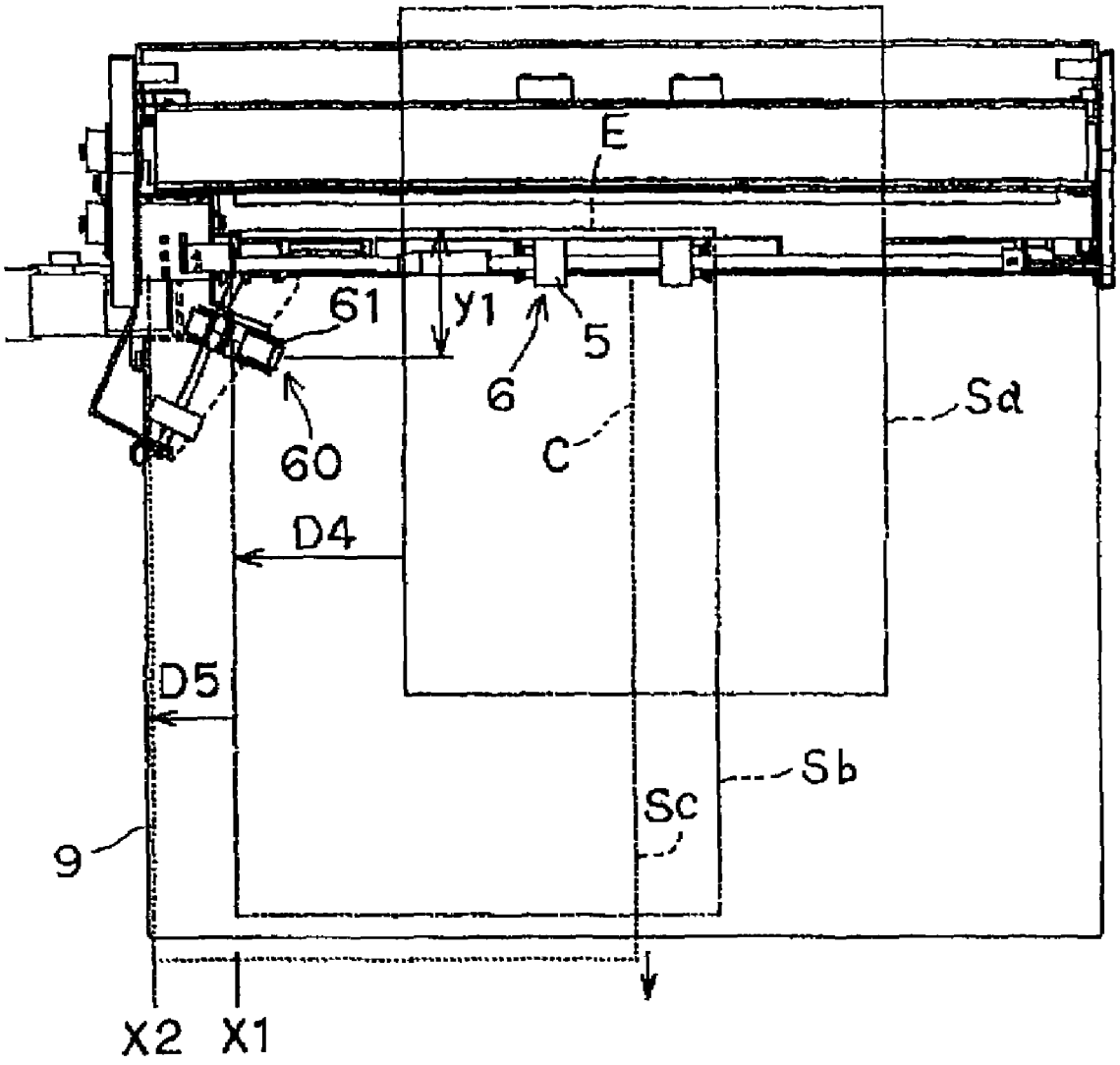
FIG. 38 is a view showing a relationship between a horizontal movement and a discharge direction distance of the sheet aligned by the rotating bodies arranged to be able to rise and lower in the present invention.

FIGS. 27(*a*), 27(*b*) to FIGS. 29(*a*), 29(*b*), and FIG. 34 and FIG. 38 show the sheet being discharged while moving horizontally toward the belt unit 61 that are the rotating bodies for alignment. In the drawings, the edge of the sheet moving horizontally while being discharged by the discharge means 6 is carried to the alignment X1. Then, it is moved by the belt unit (rotating bodies) 61 to the aligning position X2 (aligning operation) where the positioning plate 22 exists. While the sheets S is being discharged, it is simultaneously moving horizontally. When the sheet edge touches the belt units 61 (rotating bodies), the position above the storage means looking to the horizontal position is the pre-alignment position X1, but the position when looking to the sheet discharge direction above the sheets Sa is a position downstream only the determined distance of y1 from the sheet trailing edge E, as shown in FIG. 38. If the distance of y1 is too long, the belt units 61 (rotating bodies) will touch the sheet over the entire area, and resistance on the sheet discharge operation will apply a revolutionary force on the sheet centering on the point where the sheet is touched by the belt units 61. Therefore, it is preferred that this distance be as short as possible.

Figure 28A:
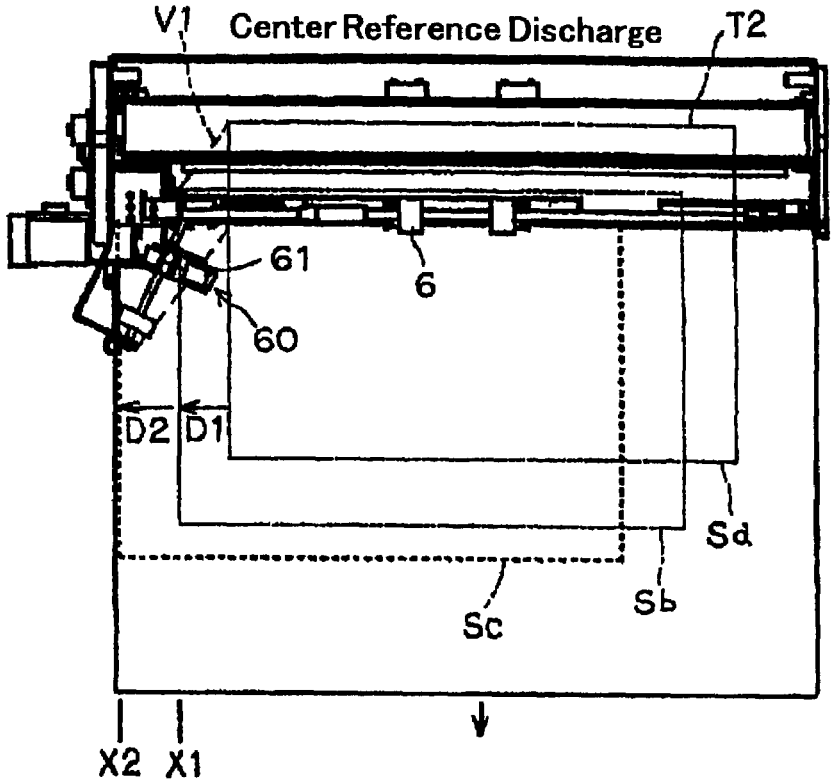
FIGS. 28(*a*) and 28(*b*) are views showing a state that the sheet is discharged while moving horizontally toward the rotating bodies for alignment under speed control in the present invention.
Figure 28B:
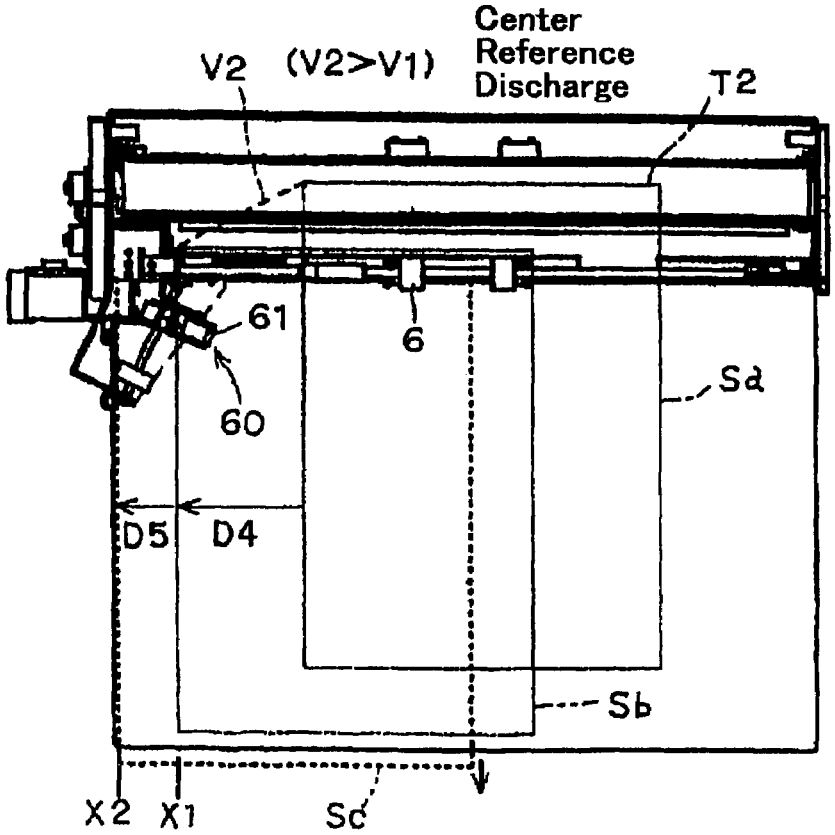

(a) Controls According to Differences in Sheet Sizes (FIGS. 27(*a*) and 27(*b*) to FIGS. 28(*a*) and 28(*b*))

FIG. 27(*a*) and FIG. 28(*a*) show a landscape size A4 sheet; FIG. 27(*b*) and FIG. 28(*b*) show a portrait size A4 sheet Sa. Each is being discharged using a center reference while simultaneously being moved horizontally a distance of D1 or D4, the sheet edge reaching the pre-alignment position X1.

It should be noted here that while both sheets are being discharged to a center reference, the movement distances of D1 and D4 for the same pre-alignment position X1 differ for A4 landscape and A4 portrait sizes and that the distance of movement D4 for A4 portrait size is longer than that of the landscape size A4 sheet. The control means, therefore, absorbs the relative differences of sheet sizes by varying the timing or the drive speed to start the pre-alignment movement means 40 (offset means) according to the size of the sheet, when sheet sizes differ.

Specifically, when the size of the sheets is small, the distance of travel to the pre-alignment reference position X1 is long, thus the timing to start the offset means is quickened from T2 (FIG. 27(*a*)) to T1 (FIG. 27(*b*), or the drive speed of the offset means is increased from V1 (FIG. 28(*a*)) to V2 (FIG. 28(*b*)), so that the sheets reach the pre-alignment reference position X1 at the same time, regardless of the size of the sheet. At this time, it is preferable that the sheet horizontal movement speed V2 by the offset means be constant. On the other hand, when the size of the sheets is large, more specifically, when the distance of travel to the pre-alignment reference position X1 is short, the timing to start the offset means is delayed (see FIG. 27(*a*)), or the drive speed of the offset means is slowed (see FIG. 28(*a*)), so that the sheet reaches the pre-alignment reference position at the same time, regardless of the size of the sheet. At this time, it is preferable that the sheet horizontal movement speed V1 by the offset means be constant.

(b) Controls According to Differences in Sheet Sizes (FIG. 29)

FIG. 29(*a*) and FIG. 29(*b*) show the case in handling sheets when the sheet discharge reference position varies, the control means varying the timing to start or the drive speed of the offset means according to the sheet discharge reference by the discharge means.

FIG. 29(*a*) shows the sheet discharge when the sheet discharge reference is a center reference; FIG. 29(*b*) shows the sheet discharge when the sheet discharge reference is a rear reference (when the left side of the sheet is the reference when looking at the discharge outlet from downstream of the discharge direction).

When carrying the sheet to the pre-alignment position X1 using the same speed, the start up for sheets to move varies, even if the sheet sizes are the same (A4 portrait size). Specifically, when discharging a portrait size A4 size sheet using a center reference, the start timing position is T1, as shown in FIG. 29(*a*), but when discharging the same A4 portrait size sheet with a rear side reference, the sheet comes closer to the pre-alignment position X1 so the start timing position to start the pre-set means (pre-alignment movement means 40), is controlled to T2 as shown in FIG. 29(*a*), to absorb the offset distance of movement according to the difference in the discharge references.

Specifically, when using the center discharge reference or the front discharge reference, the distance of travel to the pre-alignment reference position X1 is long, so the timing to start the offset means is quickened (see FIG. 29(*a*)), or the drive speed of the offset means is increased (see FIG. 29(*a*), so that the sheets reach the pre-alignment reference position X1 at the same time, regardless of the size of the sheet. At this time, it is preferable that the sheet horizontal movement speed V1 by the offset means be constant.

On the other hand, when using rear discharge reference, more specifically, when the distance of travel to the pre-alignment reference position is short, the timing to start the offset means is delayed, or the drive speed of the offset means is slowed, so that the sheets reach the pre-alignment reference position X1 at the same time, regardless of the size of the sheet. At this time, it is preferable that the sheet horizontal movement speed V1 by the offset means be constant.

(c) Controls According to Differences in the Number of Sheets (FIG. 33 to FIG. 34)

As shown in FIG. 33(*a*), when there are few sheets to be discharged, the rotating bodies activating position matches the pre-alignment position X1, but as shown in FIG. 33(*b*), as the number of sheets increases, the activating position where the rotating bodies actually touch the sheet becomes slightly offset, corresponding to the height of the stack of sheets, from the pre-alignment position X1 to the front edge of the sheets (the sheet edge on the side separated from the alignment reference member in the sheet width direction) which changes to the pre-alignment position Xa.

There, as shown in FIG. 33(*a*), when the number of sheets is low, more specifically, when the distance of movement to the pre-alignment reference position X1 is long (the distance of movement D4 in FIG. 34), the timing to start the offset means is quickened from Ta to Transport belt 18, as shown in FIG. 34, or the drive speed of the offset means is increased from Va to Vb (Vb>Va), so that the sheets reach the pre-alignment reference position X1 at the same time, regardless of the size of the sheet.

On the hand, as shown in FIG. 33(*b*), when the number of sheets is high, more specifically, as a result of the change of the pre-alignment position from X1 to Xa, the distance of movement to Xa is short (in FIG. 34, D7<D4), the timing to start the pre-alignment means 40 which is the offset means is delayed, as shown in FIG. 34, or the drive speed of the offset means is slowed, so that the sheets reach the pre-alignment reference position X1 at the same time, regardless of the size of the sheet.

Figures 37A, 37B:
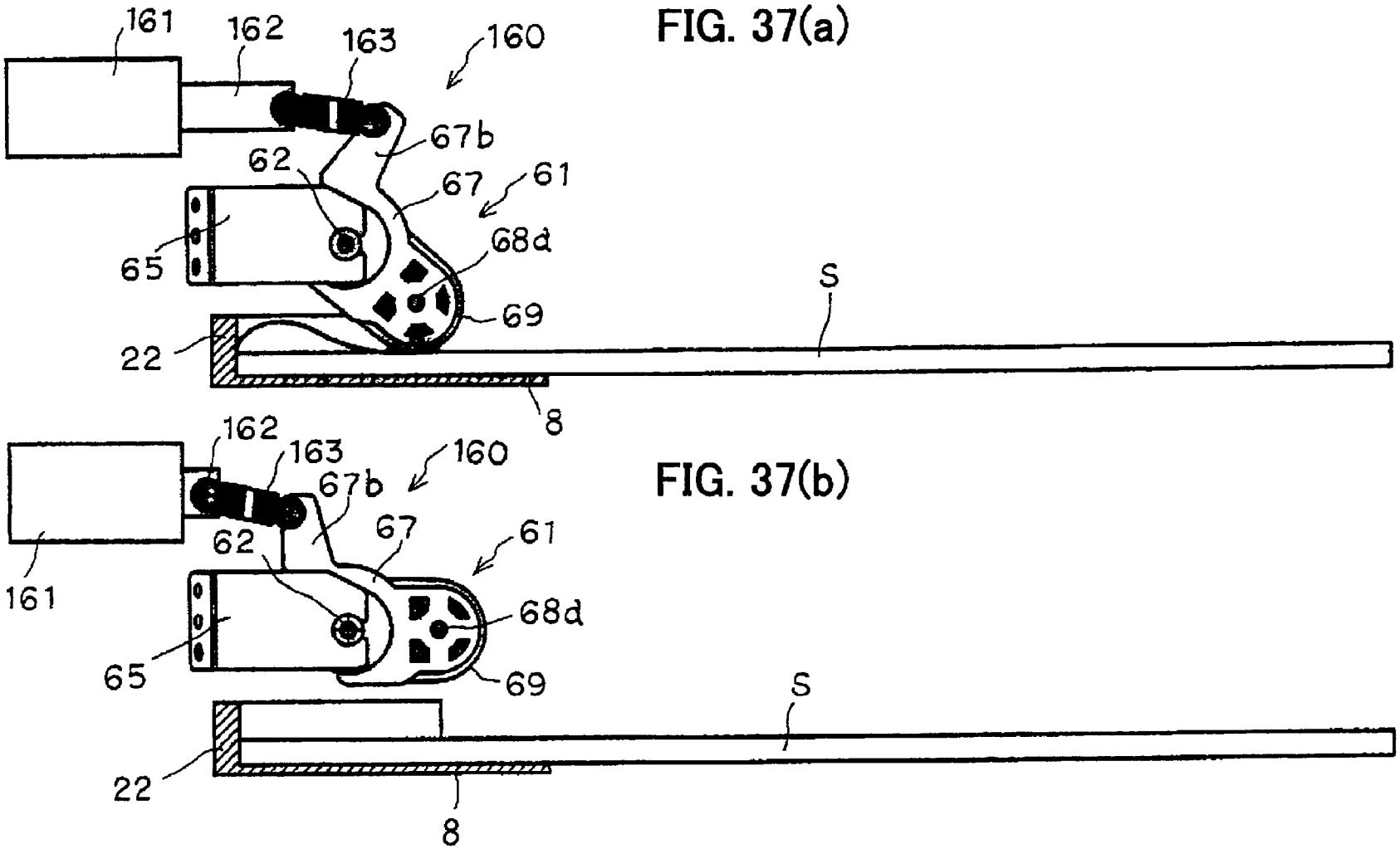
FIGS. 37(*a*) and 37(*b*) are views showing the support means of the belt unit that is the rotating bodies in the embodiment of the present invention, wherein FIG. 37(*a*) shows the belt unit at the activating position, and FIG. 37(*b*) shows the belt unit at the retracted position.

(d) Rotating Body Support Means 160 and Control (FIG. 37 to FIG. 38)

The belt unit 61 which is a rotating body can be supported to enable switching to the activating position and the retracted position. FIG. 37 shows a portion of support means 160.

The support means 160 is configured to include the solenoid 161 which is the switching drive source to rotate the support shaft 62, the support plate 67 and the support plate. Specifically, to the support plates 67 is established the lever 67*b* in a direction forming an 'L' shape in the lines connecting the support shaft 62, the following support pulley 68 (FIG. 19) and the support shaft 68*a* and to the leading end is connected the solenoid 161 plunger 162 via the spring 163.

The support plates 67, as described above, revolve as a unit with the support shaft 62 with a constant frictional force, and are configured to slidingly rotate around the support shaft 62 when an external force enough to overcome that constant frictional force is applied. The length from the support shaft 62 on the belt unit 61 is determined so that it is longer than the distance from the support shaft 62 to the top surface of the fixed stacking portion 8 (the first tray).

Therefore, when the belt unit 61 revolves as a unit with the support shaft 62, the leading edge of the belt unit 61 touches the surface of the fixed stacking portion 8 (the first tray) obliquely from above and is at the activating position shown in FIG. 37(*a*). The belt unit 61 support plate 67 overcomes the frictional force to slide on the support shaft 62 without being able to revolve any lower than that, and maintains the idle position shown in FIG. 19 (the activating position where the alignment belt 69 touches the sheets discharged to the storage means).

On the other hand, when the solenoid 161 is urged, the plunger 162 is retracted and the lever 67*b* is pulled via the spring 163 so that belt unit (rotating bodies) rotate around the support shaft 62 which is the rotating pivot point set higher than the discharge means. In other words, by applying from the solenoid 161 only enough external force to overcome the constant frictional force between the support plate 67 and the support shaft 62, the belt unit 61 revolves round the support shaft 62 to switch it to the position (retracted position) shown in FIG. 37(*b*) which is separated a constant distance above the sheet discharged to the fixed stacking portion 8 (the first tray) which is the storage means.

Setting the rotating bodies constantly to the activating position causes the rotating bodies to touch the sheet and apply a resistance force to the sheet portion being subsequently discharged, to act as a load on the discharge operation. This load acting with the sweeping action of the rotating bodies causes the sheet to be arranged and discharged obliquely.

There, the aforementioned support means 160 is controlled so that the rotating body move from the retracted position (FIG. 37(*b*) to the activating position (FIG. 37(*a*) so that the aforementioned belt unit (rotating bodies) 61 touches the sheet, with the portion separated only the determined distance of y1 from the trailing edge E in the discharge direction of the sheet discharged by the discharge means 6, regardless of the relationship of the sheet discharge reference and sheet size.

I Detailed Example of Control (FIG. 33 to FIG. 39)

Figure 39:
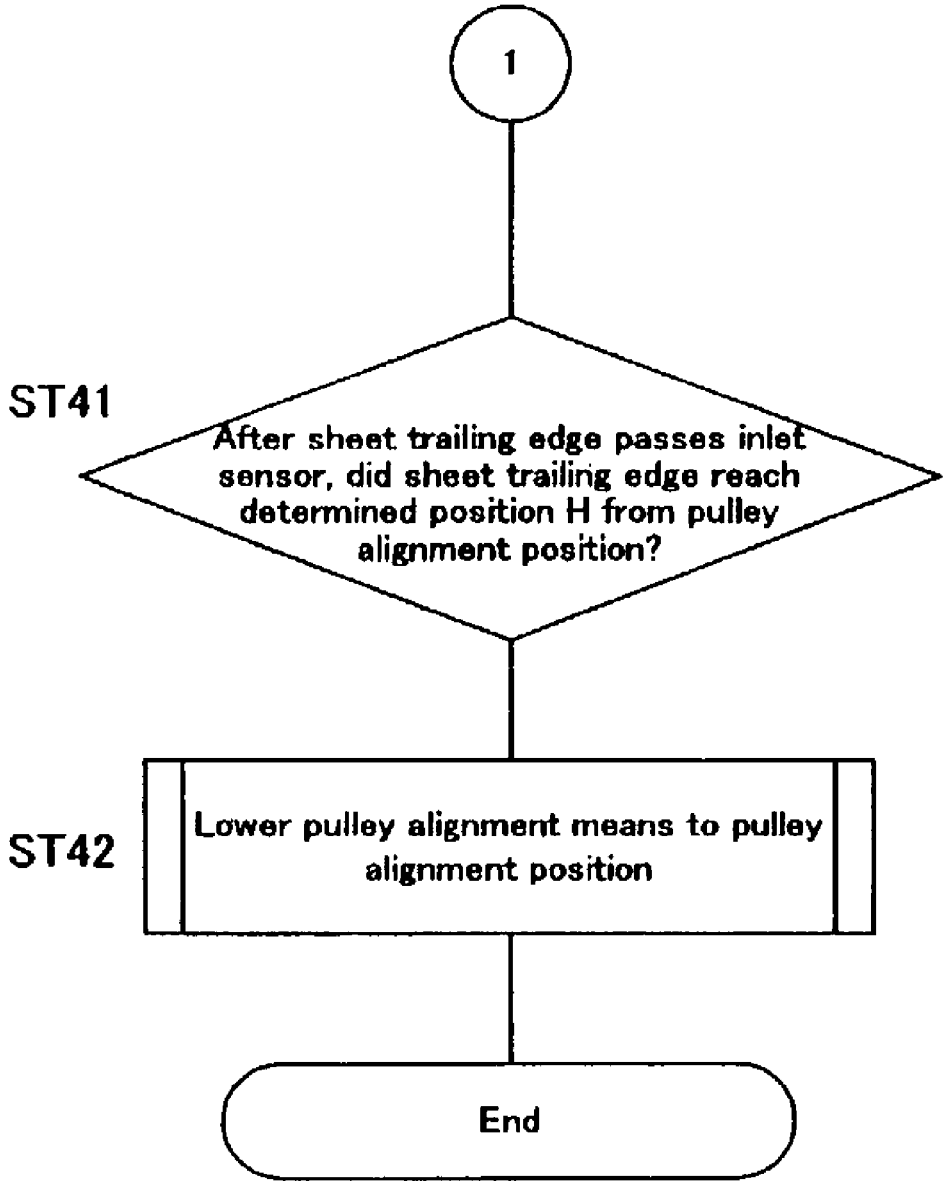
FIG. 39 is a view showing the control flow for controlling raising and lowering of the rotating bodies for alignment in the present invention.

Based on a program, the aforementioned CPU 111 controls the pre-alignment process (the movement process to the pre-alignment position) accompanying compensating control for differences in sheet size and sheet discharge references (FIG. 30, FIG. 31 and FIG. 32), or control for the differences in the number of sheets (FIG. 35 to FIG. 36) or rising and lowering control of the rotating bodies in FIG. 39.

Figure 30:
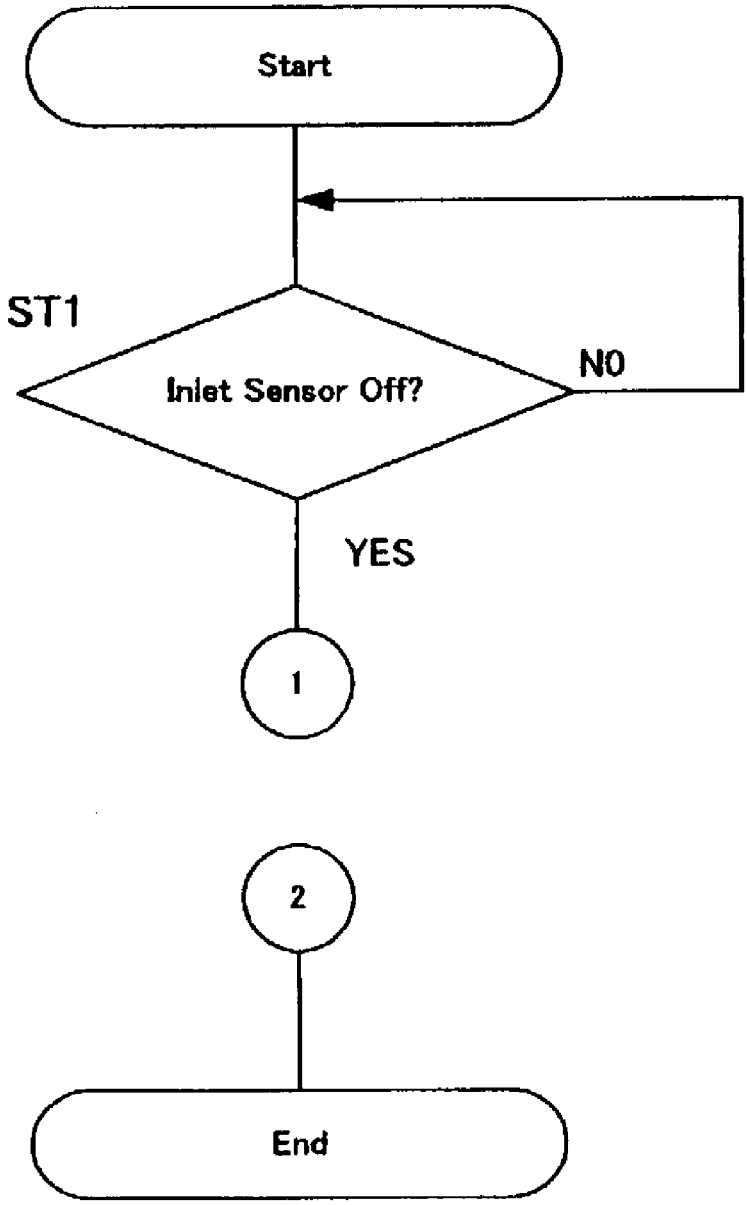
FIG. 30 is a drawing showing a portion of the flow of movement control using the pre-alignment means in the present invention.
Figure 31:
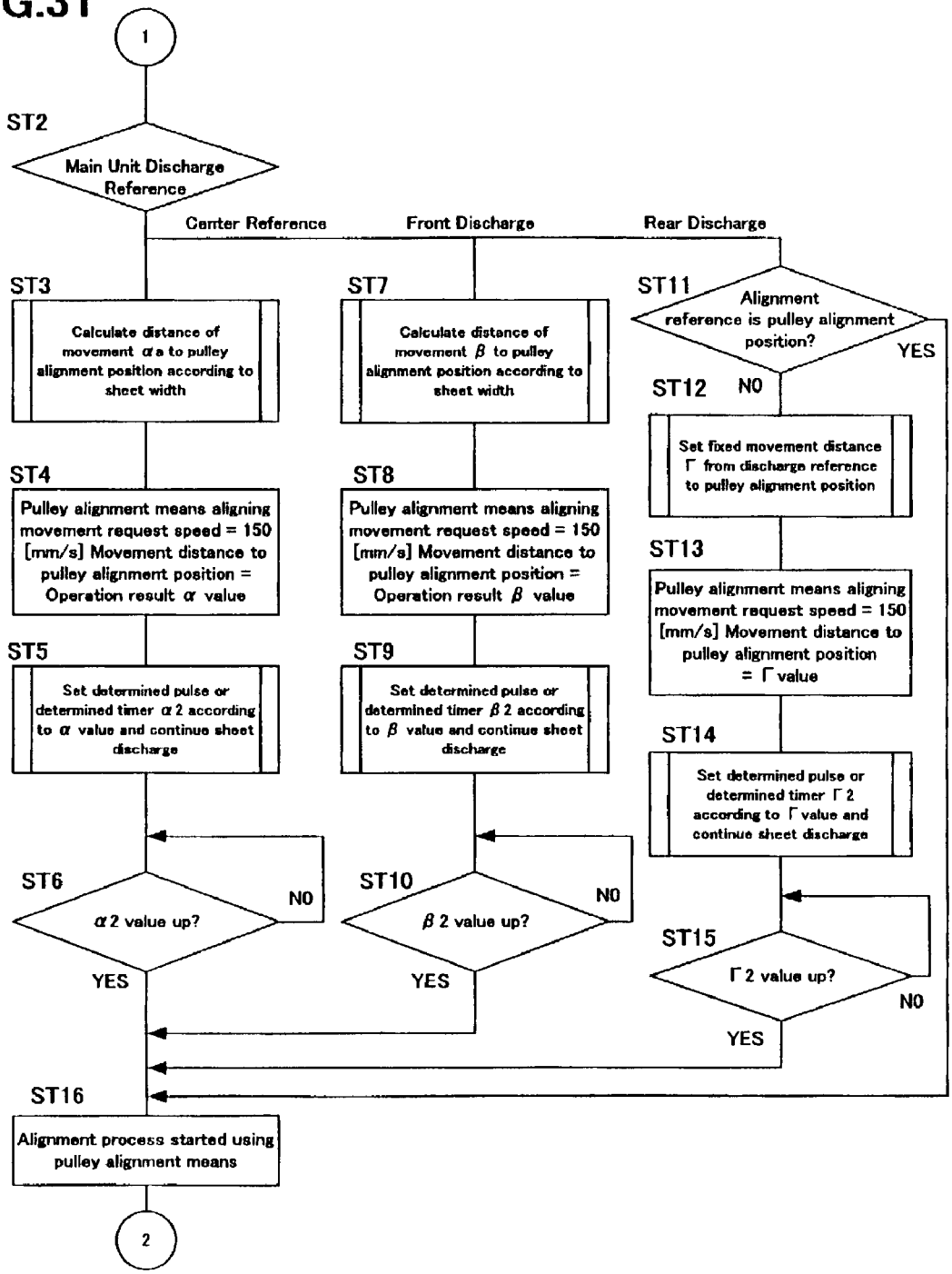
FIG. 31 is a view showing the control flow of the sheet discharge apparatus according to the present invention continued from FIG. 30.

(a) Controls According to Differences in Sheet Sizes and Sheet Discharge Reference (FIG. 30 to FIG. 31: Timing Control)

First, the system waits until the trailing edge of a sheet exits the inlet sensor 131 (step ST1). This is to prevent accidents by moving the support shaft 11 and the support shaft 12 in the shaft direction and sliding the sheet regardless of whether or not the trailing edge of the sheet is nipped by the paired transport rollers 3.

If the sheet trailing edge exits the inlet sensor 131, it proceeds to step ST2 in FIG. 31 and checks whether the sheet is being discharged from the image forming apparatus main unit 100 to either the "center reference," the "front reference," or the "rear reference" based on the data and instructions received from the image forming apparatus main unit 100 (step ST2). Here, looking downstream in the discharge direction at the discharge outlet, using the right side edge of the sheet as the reference is called the "front reference" and using the left side edge of the sheet is called the "rear reference." Note that with the "rear reference," there are cases in which the alignment reference will match and will not match the pre-alignment position, so this is checked (step ST11) and if the alignment reference is already matching the pre-alignment position, nothing is done and it proceeds to the step ST16 to start the alignment process using the pre-alignment movement means 40 (pre-alignment means).

After determining whether discharge is a "center reference," a "front reference" or a "rear reference," the distance of movement from each discharge reference to the pre-alignment position X1 is calculated to $\alpha$, $\beta$ and $\gamma$, and that distance and the required alignment speed (step ST3 to ST15) are determined and the alignment process to move to that position is started (step ST16).

In other words, for the "center reference" in FIG. 31, the distance of movement $\alpha$ to the pre-alignment position is calculated (step ST3) according to the width of the sheets (for example, D1 and D4 shown in FIGS. 27(*a*) and 27(*b*)), the operation results $\alpha$ are set as the required alignment position, and it determines 150 mm/s as the required alignment speed (step ST4). Further, to create the correct startup timing, a determined pulse or a determined timer $\alpha$2 is set according to the aforementioned a value, and sheet discharge is continued. In FIG. 31, the aforementioned $\alpha$2 value is up (step ST6) and after the sheet trailing edge reaches the timing position T2 or T1 shown in FIGS. 27(*a*) and 27(*b*), it proceeds to step ST16 to start the alignment process using the pre-alignment movement means 40 (pre-alignment means). This controls the movement (step ST16) of the pre-alignment movement means 40 so that the belt unit 61 (rotating bodies) touches the sheet at the correct timing position (the position of y1 shown in FIG. 38).

Also, for the "front reference," shown in FIG. 31, if discharging with the right edge of the tray as the reference, namely that shown in FIG. 14, the distance of movement $\beta$ to the pre-alignment position corresponding to the sheet width is calculated (for example, d1 and d4 shown in FIG. 14), the operation results $\beta$ are set as the required alignment position, and it determines 150 mm/s as the required alignment speed (step ST7) and sets the determined pulse or determined timer $\beta$2 to create the startup timing that is correct to correspond to the $\beta$ value and continues to discharge the sheet. In FIG. 31, the aforementioned $\beta$2 value is up (step ST10) and after the sheet trailing edge reaches the appropriate timing position, not shown in the drawings, it proceeds to step ST16 to start the alignment process using the pre-alignment movement means 40 (pre-alignment means). This controls the movement (step ST16) of the pre-alignment movement means 40 so that the belt unit 61 (rotating bodies) touches the sheet at the correct timing position (the position of y1 shown in FIG. 38).

Next, for the "rear reference" (step ST11), if discharging with the left side of the tray, namely that shown in FIG. 29, the distance of movement (distance γ) of the support shafts 11 and 12 on this finisher apparatus for this sheet is already known, so the constant distance of movement γ from the discharge reference is set as the required alignment position (step ST12), and the system determines 150 mm/s as the required alignment position γ and the required alignment speed (step ST13). Further, to create the correct startup timing, a determined pulse or a determined timer γ2 is set according to the aforementioned a value, and sheet discharge is continued. In FIG. 31, the aforementioned γ2 value is up (step ST15) and after the sheet trailing edge reaches the appropriate timing position, not shown in the drawings, it proceeds to step ST16 to start the alignment process using the pre-alignment movement means 40 (pre-alignment means). This controls the movement (step ST16) of the pre-alignment movement means 40 so that the belt unit 61 (rotating bodies) touches the sheet at the correct timing position (the position of y1 shown in FIG. 38).

In the alignment process, sheets are actually moved only the aforementioned calculated distance, and the alignment process starts by sending them to the pre-processing position (step ST64). Through this, sheets are transported and discharged by the rotation of the paired tray discharge rollers 4 and 5, and movement thereof in the shaft direction is executed by the aforementioned alignment process, which pushes sheets to the nipping position of the belt unit 61 which are the pre-alignment position X1.

Figure 32:
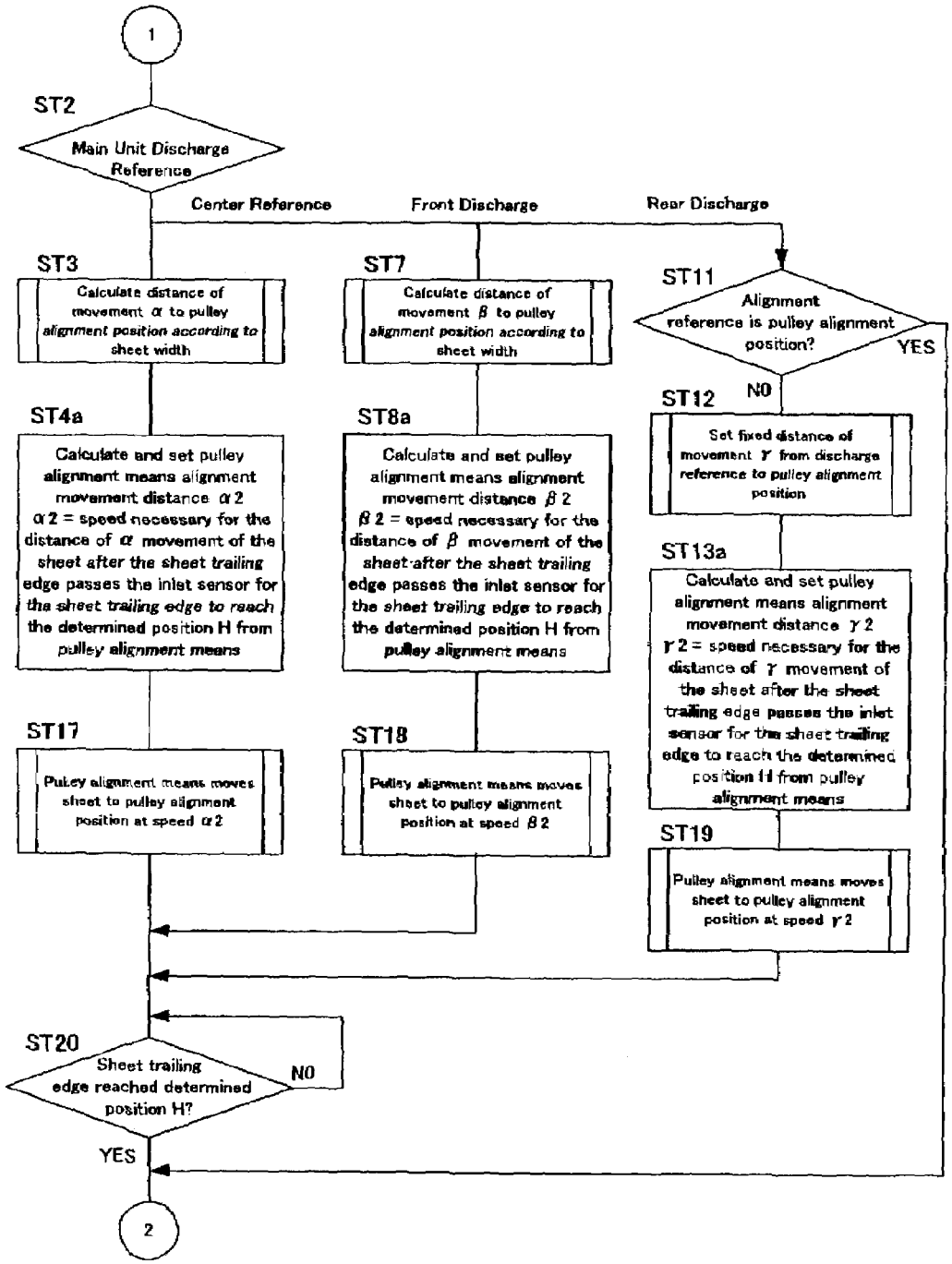
FIG. 32 is a drawing showing a portion of the flow of movement control using the pre-alignment means with speed control in the present invention.

(b) Controls According to Differences in Sheet Sizes and Sheet Discharge Reference (FIG. 32: Speed Control)

FIG. 32 shows an example of absorbing the movement offset caused by the sheet size and the sheet discharge reference, by controlling the speed of the pre-alignment movement means 40. In FIG. 32, corresponds to the portions of the aforementioned FIG. 31 to FIG. 31 and the same steps use the same symbols.

First, the system waits until the trailing edge of a sheet exits the inlet sensor 131 (step ST1), then checks whether the sheet is being transported to either of the "center reference," "front reference" or the "rear reference" from the image forming apparatus main unit 100 (step ST2). The distance of movement α, β and γ from each discharge reference to the pre-alignment position X1 is calculated, and the required alignment speed α2, β2, and γ2 that corresponds to that distance is determined and the alignment process to move to that position is started.

In other words, for the "center reference," in FIG. 32, the distance of movement α to the pre-alignment position that corresponds to the sheet width is calculated (for example D1 and D4 shown in FIG. 28) (step ST3), the results are set as the required alignment speed (aligning movement speed) α2 that corresponds to this (step ST4*a*). Here, α2 is the speed necessary to move the sheet horizontally only the distance of α until the sheet trailing edge reaches from the pre-alignment means to the predetermined position H (y1 in FIG. 38) after the sheet trailing edge passes the inlet sensor.

The sheet is moved at the aforementioned speed (step ST17) and waits at step ST20 in FIG. 32, until the sheet trailing edge reaches the predetermined position H and then ends the process. This controls the movement (step ST16) of the pre-alignment movement means 40 so that the belt unit 61 (rotating bodies) touches the sheet at the correct timing position (the position of y1 shown in FIG. 38).

Also, in the same was as for the "front reference," in FIG. 32, the distance of movement β to the pre-alignment position that corresponds to the sheet width is calculated (for example d1 and d4 shown in FIG. 14) (step ST7), the results β are set as the required alignment speed β2 that corresponds to this (step ST8*a*). The pre-alignment movement means 40 is moved at the aforementioned speed (step ST18) β2 and the system waits at step ST20 in FIG. 32, until the sheet trailing edge reaches the predetermined position H and then ends the process. Here, β2 is the speed necessary to move the sheet horizontally only the distance of β until the sheet trailing edge reaches from the pre-alignment means to the predetermined position H after the sheet trailing edge passes the inlet sensor.

Next, for the "rear reference" (step ST11), in FIG. 32, the distance of movement (distance γ) of the support shafts 11 and 12 on the finisher apparatus for this sheet is already known, so the constant distance of movement γ from the discharge reference is set as the required alignment position (step ST12), and the system calculates the required alignment speed (step ST13*a*) from that γ value. The pre-alignment movement means 40 is moved at the aforementioned speed (step ST19) γ2 and the system waits at step ST20 in FIG. 32, until the sheet trailing edge reaches the predetermined position H and then ends the process. Here, γ2 is the speed necessary to move the sheet horizontally only the distance of γ until the sheet trailing edge reaches from the pre-alignment means to the predetermined position H after the sheet trailing edge passes the inlet sensor.

Figure 35:
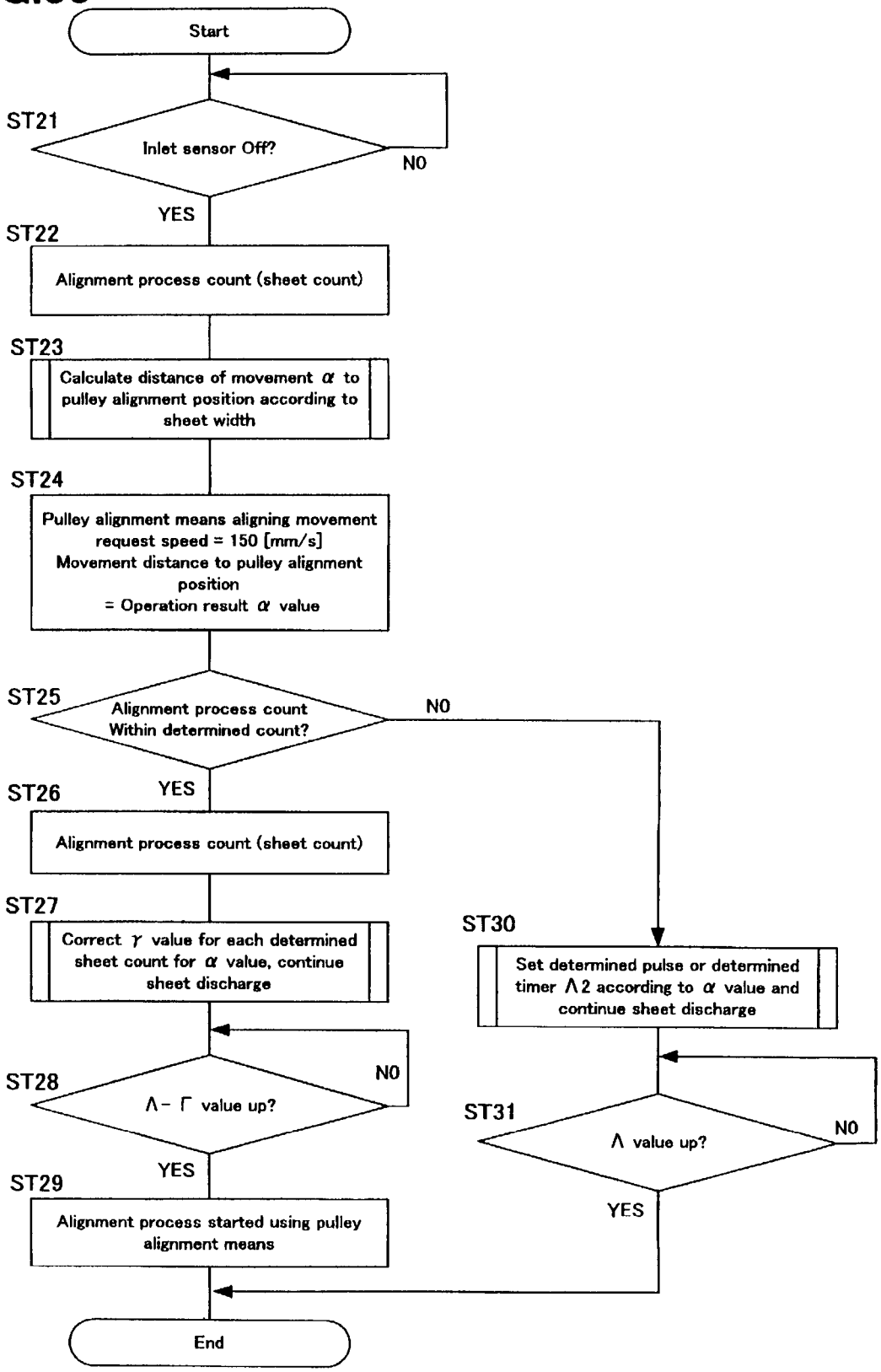
FIG. 35 is a drawing showing a portion of the flow of movement control using the pre-alignment means with speed control in the present invention.

(c) Controls According to Differences in the Number of Sheets (FIG. 35 Timing Control)

FIG. 35 shows the control to correct the offset caused by the difference in the number of sheets by changing the pre-alignment movement means 40 startup timing.

First, the system waits until the trailing edge of a sheet exits the inlet sensor 131 (step ST21), the counts the number of sheets by adding 1 to the aligning process (step ST22).

Next, the distance of movement α to the pre-alignment position X1 is calculated (step ST23) according to the width of the sheets (for example, D1 and D4 shown in FIG. 34), the operation results α are set as the required alignment position, and it determines 150 mm/s as the required alignment speed (step ST24).

Then, it determines whether the aligning process count is within a determined count value that does not require correct. If it is YES, it counts the number of sheets by adding 1 to the alignment process count (step ST26).

Further, to create the correct startup timing, a γ value is set for each determined number of sheets with regard to the α value above, and sheet discharge is continued.

Next, it determines if the contents the γ value subtracted from the A value are up (step ST28). Here, the A value is the determined pulse of the determined timer value that corresponds to α value above with no correction. If the decision at step ST28 is YES, corrections are added so the alignment process using the pre-alignment means is started (step ST29) and the process ends.

On the other hand, at step ST25, when the contents of the alignment process count exceed the determined count value, a determined pulse or a determined timer value A is set according to the aforementioned α value that is not corrected and sheet discharge is continued. Then, it waits for the A value to be up, and the process ends.

Figure 36:
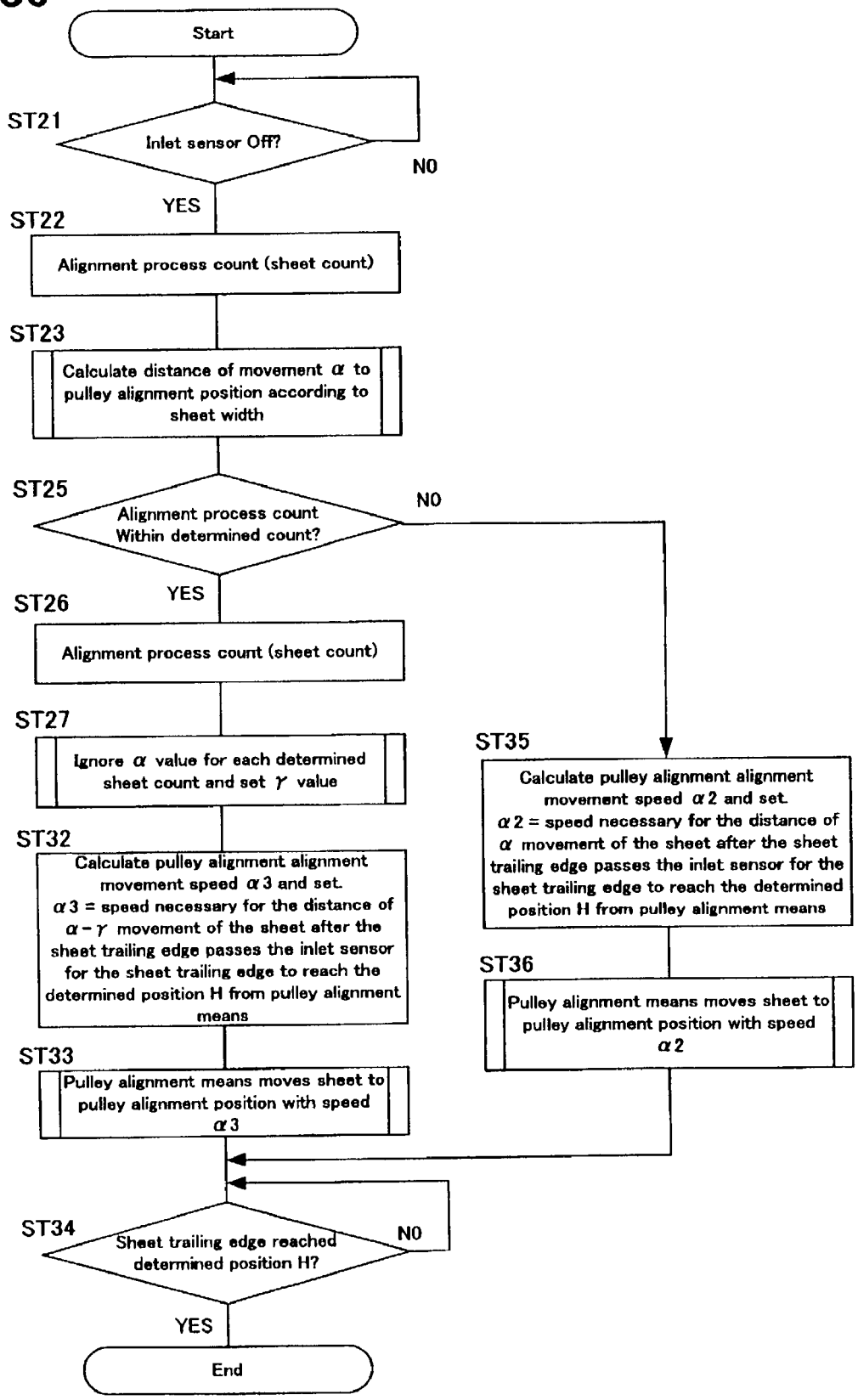
FIG. 36 is a view showing the control flow of the sheet discharge apparatus according to the present invention continued from FIG. 35.

(d) Controls According to Differences in the Number of Sheets (FIG. 36 Speed Control)

FIG. 36 shows the control to correct the offset caused by the difference in the number of sheets by changing the pre-alignment movement means 40 speed.

First, the system waits until the trailing edge of a sheet exits the inlet sensor 131 (step ST21), the counts the number of sheets by adding 1 to the aligning process (step ST22).

Next, it calculates the distance of movement α (for example D1 and D4 in FIG. 34) to the pre-alignment position X1 that corresponds to the width of the sheet (step ST23).

Then, it determines whether the aligning process count is within a determined count value that does not require correct. If it is YES, it counts the number of sheets by adding 1 to the alignment process count (step ST26).

Further, to create the correct startup timing, a γ value is set for each determined number of sheets with regard to the α value above, and sheet discharge is continued.

Next, it calculates the aligning movement speed α3 for the pre-alignment means (step ST32). Here, α3 is the speed necessary to move the sheet horizontally only the distance of α−γ until the sheet trailing edge reaches from the pre-alignment means to the predetermined position H after the sheet trailing edge passes the inlet sensor.

Then, the pre-alignment means moves the sheet to the pre-alignment position at the speed α3 (step ST33) stops the process when the sheet trailing edge reaches the predetermined position H (step ST34).

On the other hand, at step ST25, when the contents of the alignment process count exceeds the determined count value, it calculates and sets the pre-alignment means aligning movement speed α2 (step ST32) Here, α2 is the speed necessary to move the sheet horizontally only the distance of α until the sheet trailing edge reaches from the pre-alignment means to the predetermined position H after the sheet trailing edge passes the inlet sensor.

Then, the pre-alignment means moves the sheet to the pre-alignment position at the speed α2 (step ST36) stops the process when the sheet trailing edge reaches the predetermined position H (step ST34).

(e) Rotating bodies Ascending and Descending Control (FIG. 39)

FIG. 39 shows the control to switch the belt unit 61 (rotating bodies) from the retracted position (FIG. 37(*a*)) to the activating position (FIG. 37(*b*)).

In other words, it checks if the trailing edge has reached from the pre-alignment means to the predetermined position H after the trailing edge of the sheet passes the inlet sensor. If checked, it lowers the belt unit 61 (rotating bodies) to the activating position (pre-alignment position).

<Effects of the Actions of the Embodiment>

In conventional apparatuses, after sheets are completely discharged to the tray, either the alignment plate or the alignment bar pushes the sheets to move them to the alignment reference member to align the sheets, while with the controlled pre-alignment in this embodiment of the sheet discharge apparatus 1, the sorting means (offset means) positioned further upstream in the direction of sheet transport than the belt units 61 and 61 that are the alignment means, can align sheets using pre-alignment with high precision and high efficiency without having to add a dedicated alignment means.

Because the advancing and retracting of the slide joint plate 41 of the sorting means, the support shafts 11 and 12 and the paired tray discharge rollers 4 and 5 mounted on each shaft and the sheet transport by the paired tray discharge rollers 4 and 5 are performed in parallel simultaneously, the alignment operation to the pre-alignment position can be started while the sheet is being discharged by the paired tray discharge rollers 4 and 5 further increasing alignment efficiency.

Note that according to the present embodiment, finally, when pre-alignment is performed, it is necessary for this alignment to move the sheets to the positioning plate 22 (alignment reference position) by the belt units 61 and 61 after that, but before this alignment using the belt units 61 and 61, the sorting means sheet horizontal feed means (pre-alignment movement means) 40 moves the sheets SS to a position near the alignment position regulated by the positioning plate 22, so the time for alignment is shortened, the process for sheet alignment is more efficient than conventional apparatuses that move the sheets from a discharge position separated far from the alignment reference to the side alignment reference member.

Furthermore, the configuration according to this embodiment, calls for the sheets SS to be pre-aligned in advance by the sorting means, but by setting the slide movement distance of the slide joint plate 41 and the supporting shaft 11 and the supporting shaft 12 so that the sorting means directly aligns the sheets SS at the alignment reference position using the positioning plate 22, it is possible to provide a finisher apparatus that is even more compact.

Because the belt units 61 and 61 rotate to drive sheets to the positioning plate 22, which is the finishing position and the abutting plate 21 while sheets are being discharged by the paired tray discharge rollers 4 and 5 and are being aligned, an alignment action (pre-alignment) is applied to the sheets by the sorting means and alignment action is also applied by the belt units 61 and 61 enabling alignment to the finishing position with even more reliability.

In this embodiment, the aligning means (pulling means) 60 is configured to act to lower obliquely toward the sheet from the support shaft 62 to apply resistance force as a load on the sheets being discharged constantly for as long as the supporting shaft 12 is rotating in forward, but as shown in FIG. 35*a* and FIG. 35*b*, the solenoid 161 and support plate 67 protrusion 67*b* are interlocked by the spring 111 and with the excitation of the solenoid at a determined timing, the aligning means 60 can be separated from the sheet.

In this case, by controlling the solenoid 161 to cause the alignment action on the sheet by press a position at a determined distance from the sheet trailing edge, the period a load is applied to the sheet by the aligning belt 69 is made constant, regardless of the size of the sheet being discharged, thereby reducing the load on the sheet compared to prior embodiments in which the aligning belt 69 applied a constant load to cause the alignment action from the leading edge to the trailing edge of the sheet.

However, in this case, the reverse transport (pulling in) effect of the alignment belt 69 pushes the sheet back so the sheet trailing edge is not completely discharged to the fixed stacking portion 8 or is arranged obliquely, so rotating bodies such as the discharge paddle 20 or belts or rollers are arranged as forcible discharge means to add discharging force (forcefully pushing out) to the sheet.

Still further to this embodiment, a plurality of tray discharge rollers 4 and 5 are mounted to the supporting shaft 11 and the supporting shaft 12 and by making them slidingly move in the shaft direction on the supporting shaft 11 and the supporting shaft 12, the sheet discharge means 6 is structured to slide, but it is possible, for example, to structure the supporting shafts 11 and 12 that mount each of the tray discharge rollers 4 and 5 with a hollow shaft and structure the inside of the supporting shafts 11 and 12 passing a support shaft mounted with the discharge paddle 20 as the forcible discharge means to slide the tray discharge rollers 4 and 5 along discharge paddle 20 support shaft for each of the supporting shafts 11 and 12. In this case, it is acceptable that the discharge paddle 20 as the forcible discharge means be opposingly positioned with the belt unit 61 as the alignment rotating member by structuring to mount it to its own supporting shaft and it is unnecessary to mate the discharge paddle 20 to the support shaft or to structure to position this discharge paddle using a separately established positioning means.

Note that the apparatus of the present invention can be configured as a sheet discharge apparatus or can be configured as a simple sheet discharge apparatus that is not equipped with these, or can be configured as an image forming apparatus equipped with the sheet discharge apparatus.

The sheet discharge apparatus or the image forming apparatus as described above comprise discharge means to discharge sheets, storage means to receive sheets discharged from the aforementioned discharge means, an alignment reference member for aligning at least one edge of sheets discharged to the aforementioned storage means, and rotating bodies that touch sheets being transferred by the aforementioned discharge means to move sheets discharged to the aforementioned storage means to the aforementioned alignment reference member, the rotating bodies start the sweeping action on sheets being discharged, in others without waiting for the sheet to be complete discharged to align in advance so compared to the prior art of the sheet aligning operation there is no wasted time. In other words, because the prior art is configured to move sheets toward an alignment reference member by touching each sheet with the rotating bodies for alignment after completely discharging sheets to a storage tray from a discharge means, the time for the aforementioned rotating bodies to move to the position to touch the sheet, and the time required to drive the rotating bodies after moving to the contact position are wasted, but this invention eliminates that waste of time. Also, with the relationship of the change in the sheet stacking height (the number of sheets stacked) because of the differences of the sheet size and the difference of the discharge reference position, the horizontal movement amount to carry the sheets to the pre-alignment position differs, but a control means that varies the startup timing of the offset means or the drive speed to correspond to these changes so it is possible to always carry the sheet to the same pre-alignment position.

Furthermore, by establishing forcible discharge means at an upstream position substantially opposing the aligning rotating bodies in the sheet discharge direction to discharge the trailing edge of sheets to the aforementioned storage means, in a sheet discharge apparatus that touches sheets in the sheet discharge process to cause the alignment action, sheets are discharged with the appropriate inclination and the problems of the trailing edge in the direction of sheet discharge remains not completely discharged by the discharge means and being struck by subsequent sheets thus causing jams or of the load to the aforementioned sheet discharge causing sheets to be discharged obliquely and not being properly aligned and having subsequent sheets stacked thereupon, are alleviated.

What is claimed is:

1. A sheet discharge apparatus, comprising:

discharge means for discharging a sheet, storage means for receiving the sheet discharged from the discharge means, an alignment reference member for aligning at least one side of the sheet discharged to the storage means, a rotating body for contacting the sheet while the sheet is discharged from the discharge means to move the sheet discharged to the storage means to the alignment reference member, offset means for offsetting a position of the sheet discharged to the storage means relative to the rotating body by moving a position of the discharge means horizontally, and control means for changing one of a timing of starting the offset means and a drive speed of the offset means according to a size of the sheet.

2. A sheet discharge apparatus according to claim 1, wherein said control means has a function for changing one of the timing of starting the offset means earlier and the drive speed of the offset means higher according to a sheet having a first size relative to a sheet having a second size smaller than the first size.

3. A sheet discharge apparatus, comprising:

discharge means for discharging a sheet, storage means for receiving the sheet discharged from the discharge means, an alignment reference member for aligning at least one side of the sheet discharged to the storage means, a rotating body for contacting the sheet while the sheet is discharged from the discharge means to move the sheet discharged to the storage means to the alignment reference member, offset means for offsetting a position of the sheet discharged to the storage means relative to the rotating body by moving a position of the discharge means horizontally, and control means for changing one of a timing of starting the offset means and a drive speed of the offset means according to a sheet discharge reference of the discharge means.

4. A sheet discharge apparatus according to claim 3, wherein said control means has a function for making one of the timing of starting the offset means earlier and the drive speed of the offset means higher in one of cases that a center of the sheet in a sheet width direction is used as the discharge reference of the discharge means and that a side edge of the sheet at a side away from the alignment reference member in the sheet width direction is used as the discharge reference of the discharge means relative to a case that a side edge of the sheet at a side of the alignment reference member is used as the discharge reference of the discharge means.

5. A sheet discharge apparatus, comprising:

discharge means for discharging a sheet, storage means for receiving the sheet discharged from the discharge means, an alignment reference member for aligning at least one side of the sheet discharged to the storage means, a rotating body for contacting the sheet while the sheet is discharged from the discharge means to move the sheet discharged to the storage means to the alignment reference member, offset means for offsetting a position of the sheet discharged to the storage means relative to the rotating body by moving a position of the discharge means horizontally, and control means for changing one of a timing of starting the offset means and a drive speed of the offset means according to a number of sheets discharged from the discharge means to the storage means.

6. A sheet discharge apparatus according to claim 5, wherein said control means has a function for making one of the timing of starting the offset means earlier and the drive speed of the offset means higher according to the sheets having a first number relative to the sheets having a second number larger than the first number.

* * * * *